US010614786B2

(12) United States Patent
Barry

(10) Patent No.: US 10,614,786 B2
(45) Date of Patent: Apr. 7, 2020

(54) MUSICAL CHORD IDENTIFICATION, SELECTION AND PLAYING METHOD AND MEANS FOR PHYSICAL AND VIRTUAL MUSICAL INSTRUMENTS

(71) Applicant: Jabriffs Limited, Dublin (IE)

(72) Inventor: James Anthony Barry, Dublin (IE)

(73) Assignee: Jabriffs Limited, Dublin (IE)

( * ) Notice: Subject to any disclaimer, the term of this patent is extended or adjusted under 35 U.S.C. 154(b) by 109 days.

(21) Appl. No.: 15/947,309

(22) Filed: Apr. 6, 2018

(65) Prior Publication Data

US 2018/0357991 A1 Dec. 13, 2018

(30) Foreign Application Priority Data

Jun. 9, 2017 (IE) ..... S2017/0122
Jun. 16, 2017 (IE) ..... S2017/0132

(51) Int. Cl.
*G10H 1/00* (2006.01)
*G10H 1/38* (2006.01)
*G10H 1/34* (2006.01)

(52) U.S. Cl.
CPC ..... *G10H 1/0025* (2013.01); *G10H 1/0016* (2013.01); *G10H 1/0066* (2013.01); *G10H 1/342* (2013.01); *G10H 1/383* (2013.01); *G10H 1/386* (2013.01); *G10H 2210/576* (2013.01); *G10H 2220/036* (2013.01); *G10H 2220/096* (2013.01); *G10H 2240/056* (2013.01)

(58) Field of Classification Search
CPC ..... G10H 1/0025
USPC ..... 84/613, 637
See application file for complete search history.

(56) References Cited

U.S. PATENT DOCUMENTS 5,418,326 A * 5/1995 Ikeda ..... G10H 1/38 84/637
5,440,756 A * 8/1995 Larson ..... G10H 1/0008 704/278
5,481,066 A * 1/1996 Kitamura ..... G10H 1/38 84/613
5,760,325 A * 6/1998 Aoki ..... G10H 1/383 84/613
5,852,252 A * 12/1998 Takano ..... G10H 1/38 84/650
6,060,655 A * 5/2000 Minamitaka ..... G10H 1/0025 84/650
6,107,557 A * 8/2000 Fukada ..... G09B 15/003 84/318
7,145,070 B2 * 12/2006 Barry ..... G10H 1/342 84/723
7,151,214 B2 * 12/2006 Barry ..... G10H 1/0008 84/600
8,847,055 B2 * 9/2014 Rowe ..... G10G 1/02 84/609
2002/0029685 A1 * 3/2002 Aoki ..... G10H 1/38 84/613

(Continued)

*Primary Examiner* — David S Warren
(74) *Attorney, Agent, or Firm* — Hoffmann and Baron, LLP

(57) ABSTRACT

A method, apparatus, and User Interface, and product for assisting users learning to play the Chords of any selected Song quickly and easily and provide a Means to quickly and easily generate the individual Note sounds for the Chords of the selected Song employing a broad range of Virtual and Physical Instrument.

44 Claims, 44 Drawing Sheets

(56) References Cited

U.S. PATENT DOCUMENTS

| | | | | |
|---|---|---|---|---|
| 2012/0139861 | A1* | 6/2012 | Jung | G06F 3/0488 345/173 |
| 2013/0192447 | A1* | 8/2013 | Rowe | G10G 1/02 84/613 |
| 2014/0130654 | A1* | 5/2014 | Rowe | G10H 1/38 84/613 |
| 2016/0104471 | A1* | 4/2016 | Hyna | G10H 1/386 84/613 |
| 2016/0140944 | A1* | 5/2016 | Bergman | G06F 3/041 84/613 |
| 2017/0092247 | A1* | 3/2017 | Silverstein | G10H 1/00 |
| 2017/0263227 | A1* | 9/2017 | Silverstein | G10L 25/15 |
| 2017/0263228 | A1* | 9/2017 | Silverstein | G10H 1/00 |
| 2018/0144732 | A1* | 5/2018 | Kluge | G10H 1/36 |
| 2018/0357991 | A1* | 12/2018 | Barry | G10H 1/0025 |
| 2019/0206376 | A1* | 7/2019 | Strachan | G10G 1/02 |
| 2019/0237051 | A1* | 8/2019 | Silverstein | G10H 1/0025 |
| 2019/0279606 | A1* | 9/2019 | Silverstein | G06N 7/005 |
| 2019/0304418 | A1* | 10/2019 | Silverstein | G10H 1/00 |
| 2019/0378482 | A1* | 12/2019 | Vorobyev | G10H 1/0066 |

* cited by examiner

Fig. 1
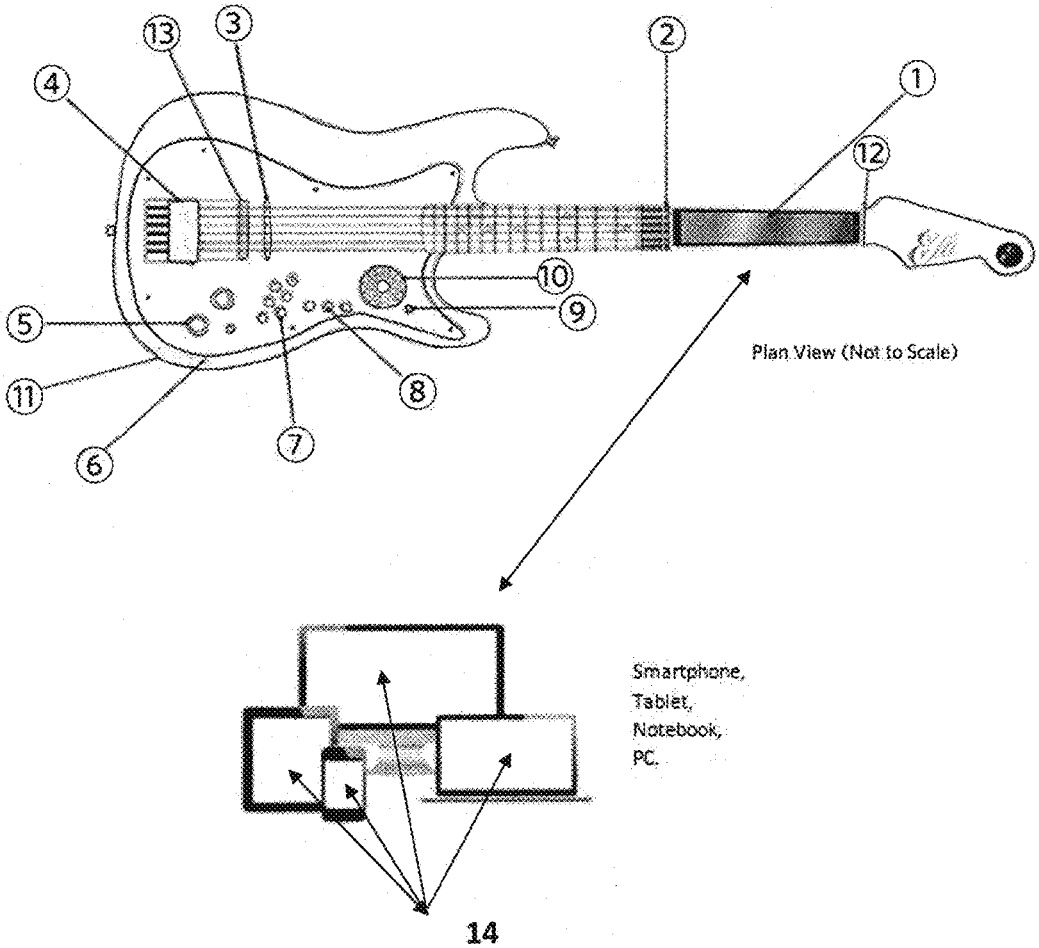
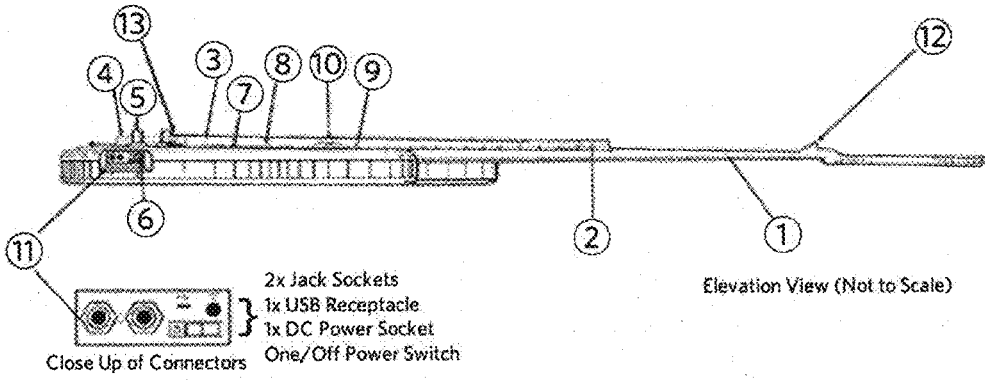

Fig. 2

① JABRiffs Display - integrated into neck of guitar
② String Housing / Bridge
③ Sensor
④ Bridge / Machine Heads
⑤ 2x Pots
⑥ LED power / charging indicator (see 11)
⑦ 6x Effects Button (material finish, flush chrome)
⑧ 3x Octave Buttons
⑨ Major / Minor Switch
⑩ Circle of Fifths (Key Selector)
⑪ Cutout Section Housing 4x Connectors and 1x Power Switch
⑫ Raised Screen Protector
⑬ Bridge

Fig. 3

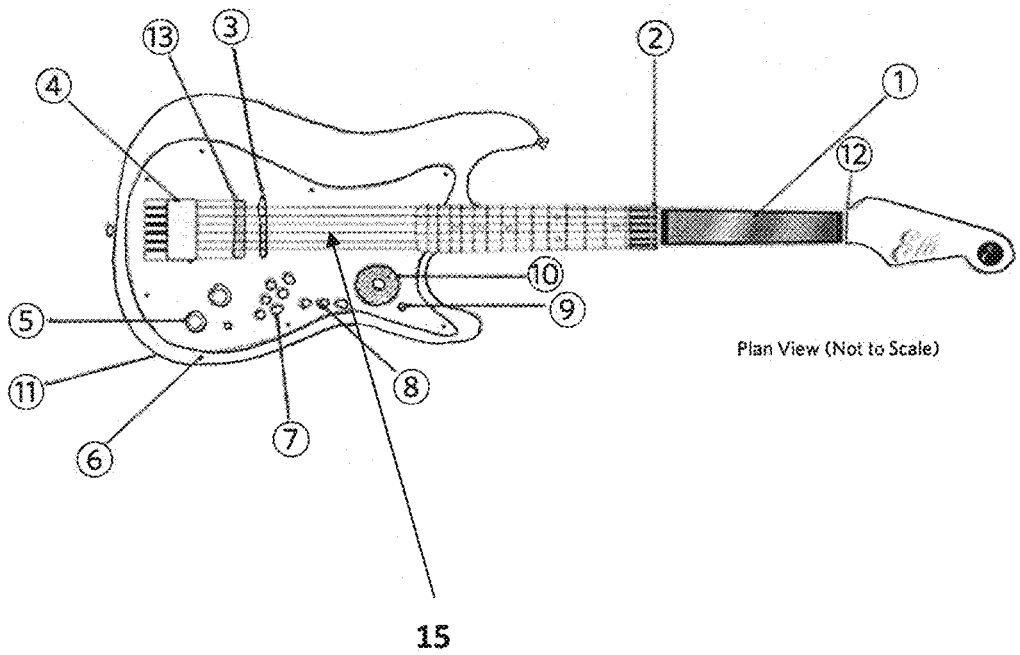

Fig. 20

Extract from a Beat File.

```
<status code="200"/>

<auftakt_result clicks_per_bar="3" overall_tempo="89.688255"
overall_tempo_straight="89.688255">
  <click_marks>
    <click index="  0"  bpm=" 88.569603"  probability="0.957078"  time="  0.093"
downbeat="false"/>
    <click index="  1"  bpm=" 88.573288"  probability="0.958151"  time="  0.432"
downbeat="false"/>
    <click index="  2"  bpm=" 88.577385"  probability="0.959201"  time="  0.771"
downbeat="true"/>
    <click index="  3"  bpm=" 88.581932"  probability="0.960225"  time="  1.110"
downbeat="false"/>
    <click index="  4"  bpm=" 88.587494"  probability="0.961223"  time="  1.448"
downbeat="false"/>
    <click index="  5"  bpm=" 88.587494"  probability="0.962192"  time="  1.787"
downbeat="true"/>
    <click index="  6"  bpm=" 88.587494"  probability="0.963132"  time="  2.125"
downbeat="false"/>
    <click index="  7"  bpm=" 88.587494"  probability="0.964040"  time="  2.464"
downbeat="false"/>
    <click index="  8"  bpm=" 88.587494"  probability="0.964833"  time="  2.803"
downbeat="true"/>
    <click index="  9"  bpm=" 88.587494"  probability="0.965518"  time="  3.141"
downbeat="false"/>
    <click index=" 10"  bpm=" 88.587494"  probability="0.966347"  time="  3.484"
downbeat="false"/>
```

Fig. 20A

```
<click index="  11"   bpm=" 88.698738"   probability="0.966994"   time="  3.826"
downbeat="true"/>

  <click index="  12"   bpm=" 88.809212"   probability="0.967727"   time="  4.167"
downbeat="false"/>

  <click index="  13"   bpm=" 88.914955"   probability="0.968299"   time="  4.509"
downbeat="false"/>

  <click index="  14"   bpm=" 89.019928"   probability="0.968974"   time="  4.849"
downbeat="true"/>

  <click index="  15"   bpm=" 89.127151"   probability="0.969513"   time="  5.189"
downbeat="false"/>

  <click index="  16"   bpm=" 89.234184"   probability="0.969992"   time="  5.529"
downbeat="false"/>

  <click index="  17"   bpm=" 89.329147"   probability="0.969587"   time="  5.868"
downbeat="true"/>

  ...


 </click_marks>

</auftakt_result
```

Fig. 21

Extract from a Chords Timeline file

```
<chord index="    1"     time="   0.464"     chord="    B:min"     probability
="0.835963">
        <altchord index="    0"     chord="   B:min7"     probability ="0.764822"/>
        <altchord index="    1"     chord="    B:maj"     probability ="0.757776"/>
        <altchord index="    2"     chord="   B:min6"     probability ="0.739542"/>
        <altchord index="    3"     chord="      B:7"     probability ="0.697469"/>
        <altchord index="    4"     chord="   B:maj7"     probability ="0.684588"/>
        <altchord index="    5"     chord="   B:maj6"     probability ="0.671347"/>

<chord index="    2"     time="   3.762"     chord="     F#:7"     probability
="0.758505">
        <altchord index="    0"     chord="   F#:maj"     probability ="0.755822"/>
        <altchord index="    1"     chord="   F#:aug"     probability ="0.708096"/>
        <altchord index="    2"     chord="  F#:maj7"     probability ="0.696357"/>
        <altchord index="    3"     chord="  F#:maj6"     probability ="0.672531"/>
        <altchord index="    4"     chord="   A#:aug"     probability ="0.626714"/>
        <altchord index="    5"     chord="    D:aug"     probability ="0.621320"/>

<chord index="    3"     time="   6.920"     chord="    A:maj"     probability
="0.794211">
        <altchord index="    0"     chord="    A:min"     probability ="0.759192"/>
        <altchord index="    1"     chord="   A:maj6"     probability ="0.720144"/>
        <altchord index="    2"     chord="   A:maj7"     probability ="0.715402"/>
        <altchord index="    3"     chord="      A:7"     probability ="0.694588"/>
        <altchord index="    4"     chord="   A:min6"     probability ="0.689559"/>
        <altchord index="    5"     chord="   A:min7"     probability ="0.664413"/>
```

Fig. 21A

The Chord vocabularies used by the Analyzer

Major/minor vocabulary - the minimum vocabulary:

noChord, all major chords, all minor chords.

Custom vocabulary - the vocabulary currently supported by the neck controller:

noChord, major, minor, majorSeventh, minorSeventh, diminishedSeventh, seventh, diminished.

Extended - the maximum vocabulary:

noChord, major, minor, majorSeventh, minorSeventh, diminishedSeventh, seventh, diminished, halfDiminishedSeventh, minorSixth, augmented.

Fig. 22

Extract from the list of supported keys (main scales and combined scales)

```
...

Key = B#-DORIAN              Signature =  7 * B#m    C##m       D#          E#
F##m       G##dim     A#

Key = B#-HARMONIC            Signature =  7 * B#m    C##m       D#          E#m
F##        G#         A##dim

Key = B#-MAJOR               Signature =  7 * B#     C##m       D##m        E#
F##        G##m       A##dim

Key = B#-MAJORMIXOLYDIAN     Signature =  8 * B#     C##m       D##m:D##dim E#
F##:F##m   G##m       A##dim:A#

Key = B#-MELODICASCENDING    Signature =  7 * B#m    C##m       D#aug       E#
F##        G##dim     A##dim

Key = B#-MINOR               Signature =  7 * B#m    C##dim     D#          E#m
F##m       G#         A#

Key = B#-MINORMELODIC        Signature =  9 * B#m    C##dim:C## D#:D#aug    E#m:E#
F##m:F##   G#:G##dim  A#:A##dim

Key = B#-MIXOLYDIAN          Signature =  7 * B#     C##m       D##dim      E#
F##m       G##m       A#

Key = B#-PHRYGIAN            Signature =  7 * B#m    C#         D#          E#m
F##dim     G#         A#m

Key = B-DORIAN               Signature =  3 * Bm     C#m        D           E
F#m        G#dim      A

Key = B-HARMONIC             Signature =  3 * Bm     C#m        D           Em
F#         G          A#dim

Key = B-MAJOR                Signature =  5 * B      C#m        D#m         E
F#         G#m        A#dim

Key = B-MAJORMIXOLYDIAN      Signature =  5 * B      C#m        D#m:D#dim   E
F#:F#m     G#m        A#dim:A

Key = B-MELODICASCENDING     Signature =  4 * Bm     C#m        Daug        E
F#         G#dim      A#dim

Key = B-MINOR                Signature =  2 * Bm     C#dim      D           Em
F#m        G          A

Key = B-MINORMELODIC         Signature =  4 * Bm     C#dim:C#m  D:Daug      Em:E
F#m:F#     G:G#dim    A:A#dim

Key = B-MIXOLYDIAN           Signature =  4 * B      C#m        D#dim       E
F#m        G#m        A
```

Fig. 22A

```
Key = B-PHRYGIAN            Signature =  1 * Bm     C          D           Em
F#dim      G          Am

Key = Bb-DORIAN             Signature = -4 * Bbm    Cm         Db          Eb
Fm         Gdim       Ab

Key = Bb-HARMONIC           Signature = -4 * Bbm    Cm         Db          Ebm
F          Gb         Adim

Key = Bb-MAJOR              Signature = -2 * Bb     Cm         Dm          Eb
F          Gm         Adim

Key = Bb-MAJORMIXOLYDIAN    Signature = -3 * Bb     Cm         Dm:Ddim     Eb
F:Fm       Gm         Adim:Ab

Key = Bb-MELODICASCENDING   Signature = -3 * Bbm    Cm         Dbaug       Eb
F          Gdim       Adim

Key = Bb-MINOR              Signature = -5 * Bbm    Cdim       Db          Ebm
Fm         Gb         Ab

Key = Bb-MINORMELODIC       Signature = -5 * Bbm    Cdim:Cm    Db:Dbaug    Ebm:Eb
Fm:F       Gb:Gdim    Ab:Adim

Key = Bb-MIXOLYDIAN         Signature = -3 * Bb     Cm         Ddim        Eb
Fm         Gm         Ab

Key = Bb-PHRYGIAN           Signature = -6 * Bbm    Cb         Db          Ebm
Fdim       Gb         Abm

...
```

B#-MAJORMIXOLYDIAN is an example of a combined scale - a main scale (B#-MAJOR) plus a borrowed chords scale (B#-MIXOLYDIAN). The result is a scale with 10 chords rather than the usual 7.

Fig. 23

Comparing Chord Timelines for the same song using different chord vocabularies

```
Analysis2\HC\majorminor.xml = N b F#A E b G D e F#b F#A E G D e F#N B E F#A E G D
E   b F#b F#A E   G D e F#G D F#b c#D...

Analysis2\HC\custom.xml     = N b F#A E b G D e F#b F#A E G D e F#N B F#  A E G   D
e b   F#b F#A E G   D e F#G D F#b D  ...

               Differences =                                        * -       - +
* + -           + -               * -,,,
```

Edit Distances = 24, Number of operations = 32, INS = 8, DEL = 16, SUB = 8. (NOP = 121)

```
Op[3066] = SUB   E to F#7

Op[3067] = DEL   F#

Op[3506] = DEL   D

Op[3651] = INS   D

Op[3797] = SUB   E to Em

Op[3942] = INS   Bm7

Op[3943] = DEL   Bm

Op[4818] = INS   Gmaj7

Op[4819] = DEL   G

Op[5987] = SUB   C#m to Dmaj7

...
```

Fig. 24

Extract from a song timeline

...

19) [ 64:3] 4 [255] 18 51650 N 0.615734 false false -1 1 NOP : NOP :

20) [ 65:3] 7 [259] 19 52444 B 0.737567 false false 50 4 NOP : NOP :

21) [ 67:2] 25 [266] 20 53833 F#7 0.669952 false true 100 3 NOP : SUB[265] E : INS[269] F# : ULN:25, 22) [ 73:3] 17 [291] 21 58809 A 0.709055 false false 100 4 NOP : NOP :

23) [ 78:0] 15 [308] 22 62186 E 0.659314 false false -1 2 NOP : NOP :

24) [ 81:3] 8 [323] 23 65159 Gmaj7 0.677321 false false 50 3 NOP : NOP : ULN:8,

25) [ 83:3] 26 [331] 24 66749 D 0.730343 false true 100 4 NOP : MOV 329 : ULN:26, 26) [ 90:1] 7 [357] 25 71904 Em 0.723160 false true 50 4 NOP : SUB[357] E :

27) [ 92:0] 9 [364] 26 73292 Bm7 0.622575 false true 50 1 NOP : SUB[367] Bm :

28) [ 94:1] 16 [373] 27 75078 F#7 0.658106 false false -1 2 NOP : NOP :

29) [ 98:1] 17 [389] 28 78248 Bm 0.738026 false false 100 4 NOP : NOP :

30) [102:2] 16 [406] 29 81611 F#7 0.760897 false false -1 5 NOP : NOP :

...

Fig. 25

Some sample scorecards for a given song

| Scale Degrees: | I | ii | iii | IV | V | vi | vii | | |
|---|---|---|---|---|---|---|---|---|---|
| Key = B-DOrIAN | 17 | - | 20 | 14 | 2 | - | 14 | not in key (70) | = 2 Am |
| 2 B 12 Em ... | | | | | | | | | |
| Key = B-HARMONIC | 17 | - | 20 | 15 | 30 | 17 | - | not in key (38) | = 14 A |
| 2 Am 2 B ... | | | | | | | | | |
| Key = B-MAJOR | 2 | - | - | 14 | 30 | - | - | not in key (91) | = 14 A |
| 2 Am 13 Bm ... | | | | | | | | | |
| Key = B-MAJORMIXOLYDIAN | 2 | - | - | 14 | 32 | - | 14 | not in key (75) | = 2 Am |
| 13 Bm 4 Bm7 ... | | | | | | | | | |
| Key = B-MELODICASCENDING | 17 | - | - | 14 | 30 | - | - | not in key (76) | = 14 A |
| 2 Am 2 B ... | | | | | | | | | |
| Key = B-MINOR | 17 | - | 20 | 15 | 2 | 17 | 14 | not in key (52) | = 2 Am |
| 2 B 11 E ... | | | | | | | | | |
| Key = B-MINORMELODIC | 17 | - | 20 | 29 | 32 | 17 | 14 | not in key (8) | = 2 Am |
| 2 B 4 N ... | | | | | | | | | |
| Key = B-MIXOLYDIAN | 2 | - | - | 14 | 2 | - | 14 | not in key (105) | = 2 Am |
| 13 Bm 4 Bm7 ... | | | | | | | | | |
| Key = B-PHRYGIAN | 17 | - | 20 | 15 | - | 17 | 2 | not in key (66) | = 14 A |
| 2 B 11 E ... | | | | | | | | | |

Fig. 26

Sample results of scoring key/modes using I, IV and V chords

Scoring Formula = Tonic Weighting = 1.38 Fourth Weighting = 1.1 Fifth Weighting = 1.0

The higher the score and the fewer not-in-key chords there are the better.

| | I | ii | iii | IV | V | vi | vii | (score) | (not in key) |
|---|---|---|---|---|---|---|---|---|---|
| Key = A-MAJORMIXOLYDIAN | 14 | 17 | - | 20 | 29 | 2 | 17 | 32 | 38 |
| Key = A-MINORMELODIC | 2 | 17 | - | 20 | 29 | - | 17 | 1 | 52 |
| Key = A-MIXOLYDIAN | 14 | 17 | - | 20 | 15 | 2 | 17 | 4 | 52 |
| Key = B-HARMONIC | 17 | - | 20 | 15 | 30 | 17 | - | 31 | 38 |
| Key = B-MINORMELODIC | 17 | - | 20 | 29 | 32 | 17 | 14 | 79 | 8 |
| Key = Cb-HARMONIC | 17 | - | 20 | 15 | 30 | 17 | - | 31 | 38 |
| Key = Cb-MINORMELODIC | 17 | - | 20 | 29 | 32 | 17 | 14 | 79 | 8 |
| Key = D-MAJOR | 20 | 15 | 2 | 17 | 14 | 17 | - | 8 | 52 |
| Key = D-MAJORMIXOLYDIAN | 20 | 15 | 2 | 17 | 16 | 17 | - | 12 | 50 |
| Key = E-DORIAN | 15 | 2 | 17 | 14 | 17 | - | 20 | 1 | 52 |
| Key = E-MINORMELODIC | 15 | 2 | 17 | 16 | 19 | - | 20 | 9 | 48 |
| Key = Fb-DORIAN | 15 | 2 | 17 | 14 | 17 | - | 20 | 1 | 52 |
| Key = Fb-MINORMELODIC | 15 | 2 | 17 | 16 | 19 | - | 20 | 9 | 48 |

These results indicate that B-MINORMELODIC (with a score of 79 and a not-in-key score of 8)

is the key that best accommodates the chords in this song timeline. Cb-MINORMELODIC has the same scores but Cb is just an enharmonic of B.

Fig. 27

Sample results showing key runs

```
...

 16) B-MinMel |    [ 53:1]   17 [209]   15  42510         D
0.848554 false false 100 8  NOP : NOP :

 17) B-MinMel |    [ 57:2]   17 [226]   16  45890         Em
0.830374 false false 100 7  NOP : NOP :

 18) B-MinMel |    [ 61:3]   12 [243]   17  49268         F#
0.880001 false false  -1 9  NOP : NOP :

 19)            |    [ 64:3]    4 [255]   18  51650         N
0.615734 false false  -1 1  NOP : NOP :

 20)            |    [ 65:3]    7 [259]   19  52444         B
0.737567 false false  50 4  NOP : NOP :

 21)   B-MinMel |    [ 67:2]   25 [266]   20  53833         F#7
0.669952 false  true 100 3  NOP : SUB[265] E : INS[269] F# : ULN:25,

 22)   B-MinMel |    [ 73:3]   17 [291]   21  58809         A
0.709055 false false 100 4  NOP : NOP :

 23)   B-MinMel |    [ 78:0]   15 [308]   22  62186         E
0.659314 false false  -1 2  NOP : NOP :

 24)   B-MinMel |    [ 81:3]    6 [323]   23  65159         Gmaj7
0.677321 false false  50 3  NOP : NOP : ULN:8,

...
```

This extract from a given song timeline shows two runs of chords in B-MINORMELODIC separated by a couple of chords that are not in B-MINORMELODIC.

Fig. 28

Sample visual representation of repeated patterns

This sample shows Scale degrees for the beginning of the given song in B-MINORMELODIC and a visual representation of the repeated patterns.

B minor = scale degree I - the tonic

F# major = scale degree V

E major = scale degree IV

```
bFAEbGDeFbFAEGDeFBFAEGDebFbFAEGDeFGDFbDfGDeFbAFAEGDeFbFA etc...
 #      # #     # #      # #     #  #  #   #  #     # #
15741634515746345-57463415157463456351356345175746345157 etc...
                       *..                                      (  2)  1 5 1
*..      *..             *..                      *..           (  9)  1 5 7
*...     *...            *...                     *...          (  8)  1 5 7 4
        *..             *..                      *..            ( 10)  5 1 5
        *...            *...                     *...           (  8)  5 1 5 7
        *........       *........               *........      (  5)  5 1 5 7
4 6 3 4 5
                        *...........            *...........    (  2)  5 1 5 7
4 6 3 4 5 6 3 5
                                          *..                   (  2)  5 1 7
 *..      *..     *..      *..               *..     *..        ( 11)  5 7 4
         *.....  *.....   *.....            *.....  *.....      (  9)  5 7 4 6
3 4
         *......          *......           *...... *......     (  8)  5 7 4 6
3 4 5
                                            *........           (  3)  5 7 4 6
```

Fig. 28A

```
3 4 5 1 5

                                                *.............        (  3)  5 7 4 6
3 4 5 1 5 7 4 6 3 4 5

                                  *..   *..                  *..      (  3)  5 6 3

          *....   *....    *....              *....   *....         ( 10)  7 4 6 3
4

          *.....           *.....             *.....  *.....        (  9)  7 4 6 3
4 5

                                                *.......             (  5)  7 4 6 3
4 5 1 5

       *..                                *..      *..               ( 10)  4 5 1

       *...                                        *...              (  9)  4 5 1 5

       *....                                       *....             (  7)  4 5 1 5
7

                                                                     (  2)  4 0 6 3
4

     *..     *..     *..      *..       *..      *..     *..      *.( 15)  6 3 4

                     *...                                            (  2)  6 3 4 1

     *...    *...             *...      *...     *...    *...     *.( 13)  6 3 4 5

     *....                              *....    *....            *.(  9)  6 3 4 5
1

     *.....                                      *.....           *.(  8)  6 3 4 5
1 5

     *...........                                *...........     *.(  4)  6 3 4 5
1 5 7 4 6 3 4 5

                                                                  *.(  2)  6 3 4 5
1 5 7 4 6 3 4 5 1 5

                                                                  *.(  2)  6 3 4 5
1 5 7 4 6 3 4 5 1 5 7 4 6 3 4 5
```

This sample shows chord names for the beginning of the given song in B-MINORMELODIC and a visual representation of the repeated patterns.

Fig. 28B

```
bFAEbGDeFbFAEGDeFBFAEGDebFbFAEGDeFGDFbDfGDeFbAFAEGDeFbFAEGDe...
 #     # #    # #     # #    #  #  #   #  #    # #    ...


                     *..                                ( 2)  b F#b
*..     *..            *..                     *..    ( 9)  b F#A
*...    *...           *...                    *...   ( 8)  b F#A E
       *..            *..                     *..     ( 9)  F#b F#
        *...             *...                       *...    ( 8)  F#b F#A
        *......          *......                    *...... ( 7)  F#b F#A E G D
        *........        *........                  *.......( 5)  F#b F#A E G D e
F#
                                                            ( 2)  F#b F#A E G D e
F#b F#
                         *...........               *.......( 2)  F#b F#A E G D e
F#G D F#
                                            *..             ( 2)  F#b A
 *..     *..    *..     *..                *..    *..   ( 11)  F#A E
         *....  *....   *....              *....  *.... ( 9)  F#A E G D
         *.....*.....   *.....             *.....*.....( 8)  F#A E G D e
         *......        *......            *......*.....( 7)  F#A E G D e F#
                                           *........     ( 3)  F#A E G D e F#b
F#
                                           *............( 2)  F#A E G D e F#b
F#A E G D e F#
          *...   *...    *...               *...   *... ( 10)  A E G D
          *....  *....   *....              *....  *....( 9)  A E G D e
          *.....         *.....             *.....*....( 8)  A E G D e F#
                                            *......     ( 4)  A E G D e F#b
                                                        ( 2)  E a G D e
    *..    *..    *..     *..      *..     *..    *..( 14)  G D e
                  *...                                  ( 2)  G D e b
    *...   *...           *...     *...    *...   *..( 12)  G D e F#
    *....                          *....   *....     ( 8)  G D e F#b
```

Fig. 28C

```
*.....                                  *.....     (  6)  G D e F#b F#

     *.........                              *......... (  4)  G D e F#b F#A E
G D

     *...........                            *..........(  3)  G D e F#b F#A E
G D e F#

       *..                              *..      *..      (  9)  e F#b

       *...                                      *...     (  7)  e F#b F#

       *....                                     *....    (  6)  e F#b F#A
```

Fig. 31

Key and Chord File (Carousel File)

```
<carousel>
  <filename>C:\JB\Analysis2\HC\custom.xml</filename>
  <beatsPerMinute>156</beatsPerMinute>
  <clicksPerBar>4</clicksPerBar>

  <key>B-MINORMELODIC</key>

  <chords>
     <chord clickIndex="-1" timeStamp="447"   lengthInClicks="17"  chordName="Bm"> </chord>
     <chord clickIndex="16" timeStamp="3849"  lengthInClicks="15"  chordName="F#7"></chord>
     <chord clickIndex="31" timeStamp="6849"  lengthInClicks="17"  chordName="A"> </chord>
     <chord clickIndex="48" timeStamp="10247" lengthInClicks="13"  chordName="E7"> </chord>
     <chord clickIndex="61" timeStamp="12846" lengthInClicks="3"   chordName="Bm7"></chord>
     <chord clickIndex="64" timeStamp="13445" lengthInClicks="16"  chordName="G"> </chord>
     <chord clickIndex="80" timeStamp="16642" lengthInClicks="17"  chordName="D"> </chord>
     ...
 </chords>

</carousel>
```

Fig. 32

"The Gambler" Key Change Scale Degrees

E#-DORIAN (91) : -3-3---747374737-473747374737473737473747----------

E#-HARMONIC (91) : -3-3------3---3----3---3---3---3-3---3----------

E#-MAJOR (91) : --------4---4----4---4---4---4-----4---4----------3----------

E#-MAJORMIXO (91) : -------747-747-7-47-747-747-747-7-747-747----------3----------

E#-MELODICAS (91) : --------4---4----4---4---4---4-----4---4----------

E#-MINOR (91) : -3-3---7-737-737--737-737-737-73737-737-7----------

E#-MIXOLYDIA (91) : -------747-747-7-47-747-747-747-7-747-747----------

E-DORIAN (91) : -----7----------7----------4---4-4---4---4-41----4---4-4------4-4-4---

E-HARMONIC (91) : ----------5-----5---5----15-4---5-----5----------5-

E-MAJOR (91) : ----------1415141415141514 14-51-1415141415 1-31

E-MAJORMIXOL (91) : -----7----------7----------1415141415141514 14-51-1415141415 1-

E-MELODICASC (91) : ----------4-5-4-4-5-4-5-4-415---4-5-4-4-5----4-4-

E-MINOR (91) : -----7----------7----------1--4----------

E-MINORMELOD (91) : -----7----------7----------4-5-4-4-5-4-5-4-415-4-4-5-4-4-5----4-

E-MIXOLYDIAN (91) : -----7----------7----------141-14141-141-1414--1-141-14141-1--1

E-PHRYGIAN (91) : ----------1--4----------

Eb-DORIAN (91) : 14341-1---4---4----4---4---4---4-4---4----------1---------

Eb-HARMONIC (91) : 1-3-1-1-5---5----5---5---5---5-----5---5----6-----6---6-----6-----6-----6-14-----

Eb-MAJOR (91) : -4-4---151415141-5141514151415141415141 51----------

Eb-MAJORMIXO (91) : -4-4---151415141-5141514151415141415141 51----------

Eb-MELODICAS (91) : 14-41-1-5-4-5-4--5-4-5-4-5-4-5-4-4-5-4-5----------1-----

Eb-MINOR (91) : 1-3-1-1----------6-----6---6-----6-----6-----6-14-------6--

Eb-MINORMELO (91) : 14341-1-5-4-5-4--5-4-5-4-5-4-5-4-4-5-4-5----6-----6---6-----6-----6-----6-14
-

Eb-MIXOLYDIA (91) : -4-4---1-141-141--141-141-141-14141-141-1----------

Eb-PHRYGIAN (91) : 1-3-1-1----------2-262-2-262-262-2--62-2-262-2-262142-

Fig. 33

| Gmaj | Note No. | G7 | Note No. | Gsus4 | Note No. | Gsus2 | Note No. |
|---|---|---|---|---|---|---|---|
| G | 55 | G | 55 | G | 55 | G | 55 |
| B | 59 | B | 59 | X | | A | 57 |
| D | 62 | D | 62 | D | 62 | D | 62 |
| G | 67 | G | 67 | G | 67 | G | 67 |
| B | 71 | B | 71 | C | 72 | D | 74 |
| G | 79 | F | 77 | F | 77 | F | 77 |

| Gm | Note No. | Gm7 | Note No. | Gm5us4 | Note No. | Gm5us2 | Note No. |
|---|---|---|---|---|---|---|---|
| G | 55 | G | 55 | | | | |
| D | 62 | D | 62 | | | | |
| G | 67 | F | 65 | | | | |
| Bb | 70 | Bb | 70 | | | | |
| D | 74 | D | 74 | | | | |
| G | 79 | G | 79 | | | | |

| Go | Note No. | Go7 | Note No. |
|---|---|---|---|
| Bb | 58 | X | |
| Db | 61 | X | |
| G | 67 | G | 55 |
| X | | Db | 61 |
| X | | Fb | 64 |
| X | | Bb | 70 |

MUSICAL CHORD IDENTIFICATION, SELECTION AND PLAYING METHOD AND MEANS FOR PHYSICAL AND VIRTUAL MUSICAL INSTRUMENTS

The present invention relates to provide a computer implemented method, a computer system, and User Experience (UX) Interface capable of assisting users to play any track almost instantly while they absorb the music concepts essential to longer-term success.

BACKGROUND TO THE INVENTION

The present invention is an improvement to invention disclosed in International Publication No. WO 2004/008430 and U.S. Pat. No. 7,145,070 and International Publication No. Wo 01/95052 and U.S. Pat. No. 7,151,214 by the same inventor.

Most people buy Musical Instruments with dreams of emulating their on-stage heroes. However, the Majority quit before even learning to play their First Song. The Root cause of the staggering drop-out rate is the steep learning curve associated with playing a Musical Instrument of any kind. In addition to understanding concepts related to Musical theory, would-be players need to develop the dexterity required to quickly form and play Chords and Notes on the Musical Instrument. Confused by dry theory and frustrated with clumsy performances, learners can quickly grow disenchanted with the process.

In Addition, those musicians who persevere face an additional challenge when attempting to recreate their favourite music: it is not widely known, but popular Songs do not limit their Chord selection to a Single Key but frequently borrow Chords from other scales. Adapting to such difficulty is often beyond the skills of all but a few dedicated beginners.

The drop-out rate is likely to rise further as the ubiquity of smartphones and tablets simultaneously offers continual distraction and expectations of instant gratification.

The present invention addresses the challenges outlined above through a combination of hardware and software components that enables novices to play any track almost instantly while they painlessly absorb the music concepts essential to longer-term success.

SUMMARY OF THE INVENTION

It is an aim of the present invention to provide a method, a system, and User Experience (UX) Interface for assisting users to play any track almost instantly while they absorb the music concepts essential to longer-term success.

According to the present invention a computer system may be provided. The computer system comprises a touch screen device one or more data processors; and one or more non-transitory computer readable storage media containing instructions of a computer software application configured to cause the one or more processors to perform operations including:

displaying a Chord Selection Matrix Template on a first region of the touch screen device, the Chord Selection Matrix Template being associated with a Musical Key or Key Combination, the Chord Selection Matrix Template being divided into a plurality of Chord Element positioned in a row and column configuration, each Chord Element representing the scale degree position and the Chord value of an individual Chord within the calculated musical Key or Key combination for the selected digital music file, displaying a Chord Scale Degree Timeline on a second region of the touch screen device, the Chord Scale Degree Timeline being associated with a selected digital musical file, the Chord Scale Degree Timeline being divided into a plurality of Chord Sectors along the Timeline, each Chord Sector representing the scale degree position and the Chord value of an individual Chord within the identified musical Key or Key combination for the selected digital musical file, wherein the Chord Scale Degree Timeline displays the Chords of the selected musical file in their identified scale degree position and in the order and for the duration that they need to be played.

wherein a Chord Scale Degree Timeline is generated based on a Chord File associated with the selected digital music file, the Chord File at least comprising identified parameters of the selected digital music file including Chords, and a Chord Timeline indicating the time duration and playing order of the detected Chord, wherein each Chord Sector on the Scale Degree Timeline is associated with a Chord Element in the Chord Selection Matrix Template for the selected musical Key or Key combination, the Chord Element is associated with a Chord Assignment file comprising at least the Note names, the order of the Notes, and the Note assignments to individual Activation Control Members of a musical instrument;

assigning, in response to a user selection of a musical instrument and the selection of a Chord Element and in accordance with the Chord Assignment File, the Notes to each of the Chord Elements;

receiving a triggering input associated with the selection of a Chord Element in the Chord Selection Matrix Template;

assigning the Notes associated with the selected Chord Element to the corresponding Activation Control Member; and playing audio sounds associated with the individual Notes assigned to the selected Activation Control Members when each of the individual Activation Control members is activated.

According to embodiments of the present invention a computer Software Application for analysing the Chords of any Song in the user's library may be provided. The Software Application, based on the Chord Analyses, calculates a Single Key/Mode or a Key/Mode Combination, and places all the Chords notified in the Chord File at specific Scale Degree positions within the calculated Key/Mode or the Key/Mode Combination. One of the objectives of the Chord Analysis exercise may be to identify and establish a Musical Key or a Combination Musical Key, and, thereafter, generate a Chord File (Carousel File) for the selected Song, where all the notified Chords will fit Scale Degree positions within the Musical Key/Mode or the Combination Key/Mode that is advised. It has been found that by using the computer software application to identify the Key/Mode and the Chord File data may achieve the following objectives:

a) Assist a user with learning to play the Chords of any selected Song quickly and easily and provide a Means to quickly and easily generate the individual Note sounds for the Chords of the selected Song employing a broad range of Virtual and Physical Instrument examples. A range of Musical Instrument sound choices may be offered for selection to the user;

b) Assist to quickly and easily create original Musical compositions deploying the Notes of any Chord of a selected Musical Key/Mode and provide a Means to play the individual Note sounds of a selected Chord employing Virtual or Physical Instrument Embodiments. A range of Musical Instrument sound choices are offered for all Embodiments.

According to embodiments the present invention, a Touch Screen Device may be provided where a User Interface, which displays for any song analysed by the Software Application, a Waveform image, a Chord Selection Matrix Template, a Timeline showing individual Chord Sectors, and a Control Member Activation Area. The Control Member Activation Area being displaying Activation Control Members associated with a selected virtual or physical musical instrument.

According to embodiments of the present invention, a physical musical instrument may be provided, which may be fitted with a touch screen device according to embodiments of the present invention. For example a traditional electric guitar may be fitted with a Touch Screen Device according to embodiments of the present invention. The Touch Screen Device being capable of running a User Interface capable of displaying for each song analysed by the Software Application, a Chord Selection Matrix Template. The Touch Screen Device displays within the Chord Selection Matrix Template a set of Activation Control Members associated with the physical musical instrument. For example, in the case of the electrical guitar, the Activation Control Area on the Touch Screen may resemble the fretboard of a guitar with a set of Virtual strings, which when adjusted by the user emulate the function of the actual guitar strings i.e. Hammer on/off, Pull Off and string Bends etc. The physical musical instrument provides physical strings, 15, as the main Activation Control members.

According to embodiments of the present invention, the Software Application, based on the Chord Analysis, will construct the User Interface. The User Interface will advise the user to select at least one Chord Selection Matrix Template capable of accommodating all the identified Chords of the selected song. The User Interface also displays a Chord Timeline, where each Chord Sector within the Timeline intuitively directs the user to select the exact Element in the Matrix that corresponds to Chords Sectors displayed along the Timeline. Optionally, an "Auto Display" option is provided by the interface to highlight the Elements within the Matrix that corresponds to the Chords Sectors playing along the Timeline.

According to embodiments of the present invention, each Element of the Chord Selection Matrix Template has a Chord File associated with that Element. Each Chord File lists the note assignment positions and their MIDI note identifier for each string and is editable by the user. When the user selects an Element, the Software Application assigns the note identifiers from that Chord File to individual Activation Control Members of a selected musical instrument e.g. Virtual Strings of a guitar, which may be displayed in an Activation Control Area of the User Interface in the exact order that they are defined in the Chord File. For example, when the user activates any of the Virtual Strings of a virtual guitar fret board associated with the selected Element, the audio sounds of the individual notes assigned to each Activation Control Member will be played, at the amplitude that corresponds to the position within the activation area where the user activated the Virtual String. The notes assigned to each string in the Chord File are assigned as standard MIDI numbers or as reference identifiers to pre-recorded audio sounds for a broad range of musical instruments. The note identifiers, string activation amplitude indicators and the instrument selection Control Change Messages comply with MIDI industry standard protocol. It should be noted that the Activation Control Members may be of any form associated with a selected musical instrument. For example in the case of a piano or a synthesizer, the Activation Control Members may resemble a keyboard containing a row of keys. As each Element in the Chord Selection Matrix is selected, the note and Activation Control Member assignments are displayed in the Activation Control Area. For example, in the case of a virtual guitar, the user strums or picks the virtual strings in the sector position within the Activation Control Area to reflect the volume they wish to play the note assigned to the activated string.

According to embodiments of the present invention, the user can select the Chord Selection Matrix Template advised by the Software Application by selection means. For example, the user may select the Chord Selection Matrix Template from a dropdown menu displayed on the User Interface or by selecting it from a predetermined menu displayed on a toolbar presented on region of the use Interface. Furthermore, the user may select the advised Template from a range of control members fitted on the body of the musical instrument or presented on the computer system. Moreover, the Key Mode or Key Mode combination may be selected from a scrollable menu displayed on the Touch Screen Device or from range control members presented on the computer device or musical instrument.

According to the present invention, layout configuration means may be provided to allow the user to configure the layout of a Chord Selection Matrix Template for a very broad range of musical Keys/Modes. For example, the user may select a layout from a drop down menu presented on the touch screen display or from a range of control members presented on the musical instrument or the computer system.

According to embodiments of the present invention, the user selection of the Chord Selection Matrix Template and/or the layout configuration from a drop-down menu may be assisted by an interfacing device e.g. a computer mouse, a button placed on the computer system or a musical instrument, and the like.

According to embodiments of the present invention, The Software Application may be used by the user to author their own musical creations. For example, the user may interact with the User Interface to start a music creation session, where the user selects the desired Chord Selection Matrix Template for the desired musical key or Key/Mode combination and then activate individual Chord Element to formulate their own music creation. The user may select the individual Elements from a list of Chord Elements stored in the system memory to create their own bespoke Chord Matrix. The Chord Element list may have been generated from previously analysed songs. Once the user has selected the Individual Elements, the user triggers the Activation Control Members of the selected instrument to compose their music creation. For example, the user strums or picks the Virtual and/or Physical Strings of a guitar in a manner that reflects their creative instincts.

According to embodiments of the present invention, the User Interface may offer to the user a selectable ""Auto Play"" option. By selecting this option, the individual Chord Elements are automatically selected by the Software Application in sync with the Chord Sector playing in the Timeline. "Auto Play" will allow the user to concentrate exclusively on developing their strumming and picking techniques and with learning the note assignments for the Activation Control members, e.g. Virtual Strings and/or Physical Strings. In "Auto Play" the Chord Element Selection is synchronised with the cursor moving across each Chord Sector in the Timeline. The Chord Timeline can be slowed down to assist the user in learning and practising their strumming and picking techniques.

According to embodiments of the present invention, the User Interface may offer to the user a selectable "Auto Display" option. By selecting the "Auto Display" option, the individual Chord Elements are automatically highlighted by the Software Application in sync with the Chord Sector playing in the Timeline. "Auto Display" will assist the user in learning the Element positions that corresponds to the data presented in the Chord Sectors. The Chord Timeline can be slowed down to assist the user in becoming familiar with the Element positions for the various Chords.

BRIEF DESCRIPTION OF THE DRAWINGS

The following drawings are provided as an example of an inventive Embodiment to explain further and describe various aspects of the invention.

FIGS. 1 to 3 show examples of a musical instrument and associated components according to embodiments of the present invention.

FIGS. 20 and 20A. Extract from a Beat File.

FIG. 21. Extract from a Chord Scale Degree Timeline File.

FIG. 21A. The Chord vocabularies used by the analyser.

FIG. 22. Extract from the List of supported Keys.

FIG. 23. Comparing Chord Timelines using different Vocabularies.

FIG. 24. Extracts from a Chord Timeline.

FIG. 25. Sample scorecard for a given Song.

FIG. 26. Sample results of scoring.

FIG. 27. Sample results showing Key runs.

FIGS. 28, 28A, 28B and 28C. Sample visuals representation of repeated patterns.

FIG. 32. Chord progressions showing Key Change from Eb to E Major

FIG. 33. Table showing some "G" Chord Note Assignments and MIDI numbers.

DETAILED DESCRIPTION

Figure 4:
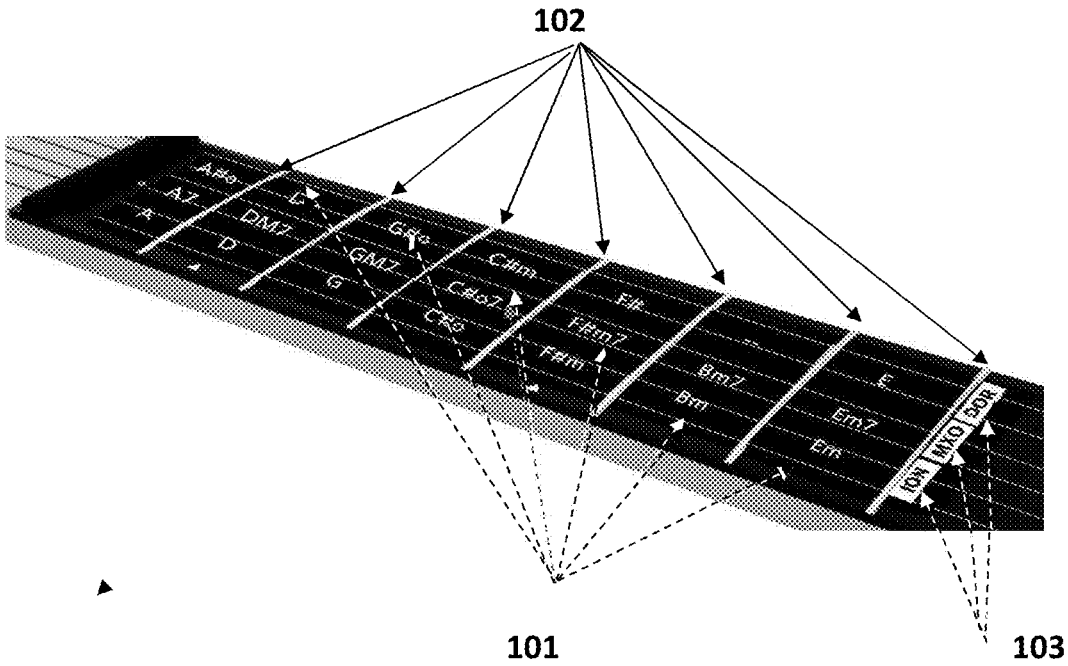
FIG. 4 shows an example of a musical instrument fitted with touch screen device displaying a Chord Selection Matrix Template according to embodiments of the present invention.

The present invention will be illustrated using the exemplified embodiments shown in the FIGS. 1 to 46, which will be described in more details below. It should be noted that any references made to dimensions are only indicative and do not restrict the invention in any way. While this invention has been shown and described with reference to certain illustrated embodiments thereof, it will be understood by those skilled in the art that various changes in form and details may be made therein without departing from the scope of the invention encompassed by the appended claims. Furthermore, while the invention has been described with references to a particular musical instrument, it should be understood by those skilled in the art that changes in form and details may be made to facilitate other musical instruments without departing form the scope of the invention encompassed by the appended claims.

FIGS. 1 to 3 shows an example of an apparatus according to the present invention comprising a touch screen device 1 running a User Interface according to embodiments of the present invention. For illustration purposes only, the apparatus may resemble a musical instrument such as a traditional electric guitar. The touch screen device 1 may be provided with a processor, a storage memory, a touch sensitive display screen and communication capability to and with external devices using any of Bluetooth, Wi-Fi USB etc. The apparatus shown in FIG. 1 may be provided a touch screen device 1, which may be referred to also as a controlling device or a computer system, a string housing 2, a range of sensors 3 for detecting different parameters, bridge/machine heads 4 that may incorporate the different strings, potentiometers (or Pots) 5, at least one LED 6, a range of effect buttons 7, a Major/Minor switch 9, a music key selector 10, connectors 11 for connecting the device to an amplifier or another device, a bridge 13 and Physical Strings 15. The apparatus may further be provided with a raised screen protector 12, which protects the touch screen device. For example, the raised screen protect 12 may protect the touch screen device from breaking when the apparatus is accidentally dropped. The touch screen device 1 could be of any type and may not necessary be integrated into the apparatus FIG. 1. For example, the touch screen device 1, may be in the form of a mobile device, or another computer system running a computer software application according to embodiments of the present invention. The touch screen device, may be connected to the apparatus in different ways to allow user to control certain functionality from the various control members provided on the apparatus body. For example, the touch screen device 1 may be connected to the apparatus via a set of connection point, USB connection, Bluetooth, WI-FI and the like. The touch screen device 1 may be removably secured, via a clip or the like, at a desired location of the apparatus e.g. the neck of the guitar a shown in FIG. 1. The apparatus may comprise a special compartment that can accommodate a connection with different types of touch screen devices. Alternative, the apparatus may be provided with an integrated touch screen device.

Figure 5:
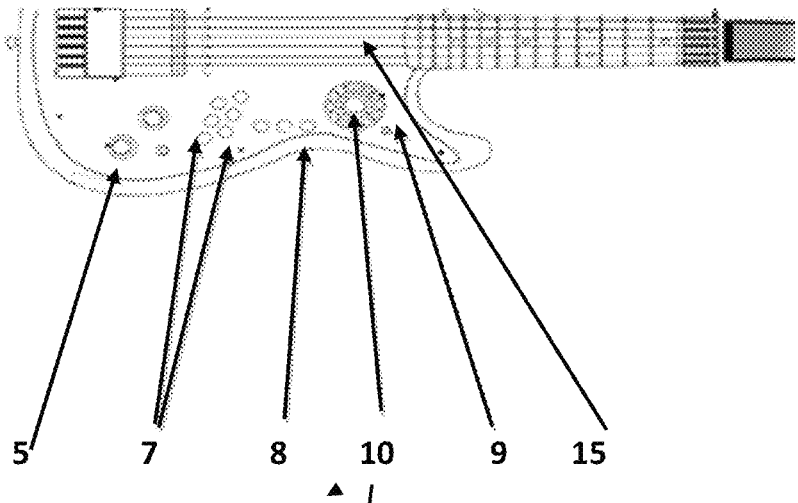
FIGS. 5 and 6 show example of selection means positioned on a musical instrument for selecting and or changing the Key mode selection according to embodiments of the present and an image showing the Circle of Fifths configuration layout.
Figure 6:
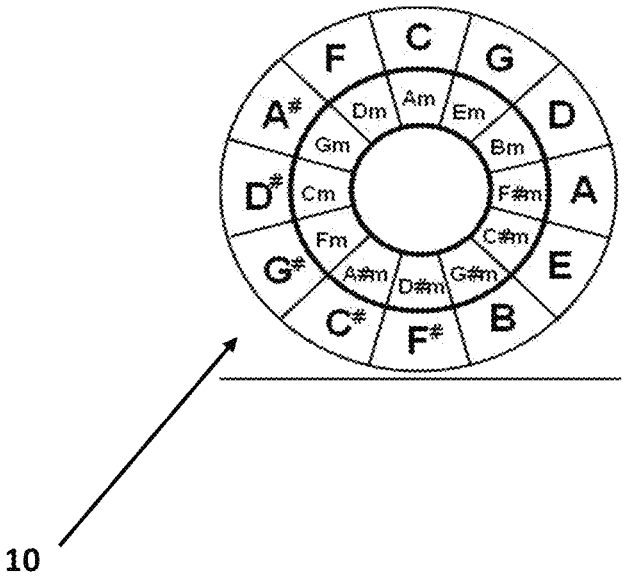
Figure 7:
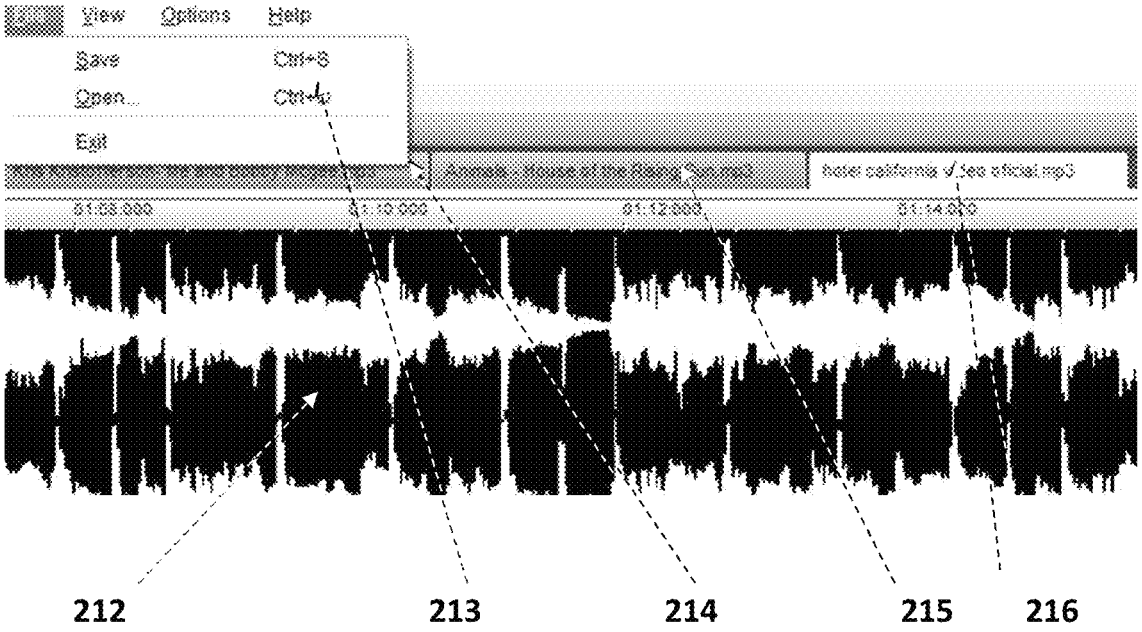
FIG. 7 shows an example of a song selection in a User Interface according to embodiments of the present invention.

FIGS. 5 and 6 shows examples of selection means on the apparatus of FIG. 1. For example, FIG. 5 shows an example of a switch or knob 10 positioned on the apparatus of FIG. 1 for selecting the desirable Musical Key or Key Combination. The Key/Mode selection for the Chord Matrix on the Touch Screen Device can also be assigned remotely from a connected device.

Figure 4A:
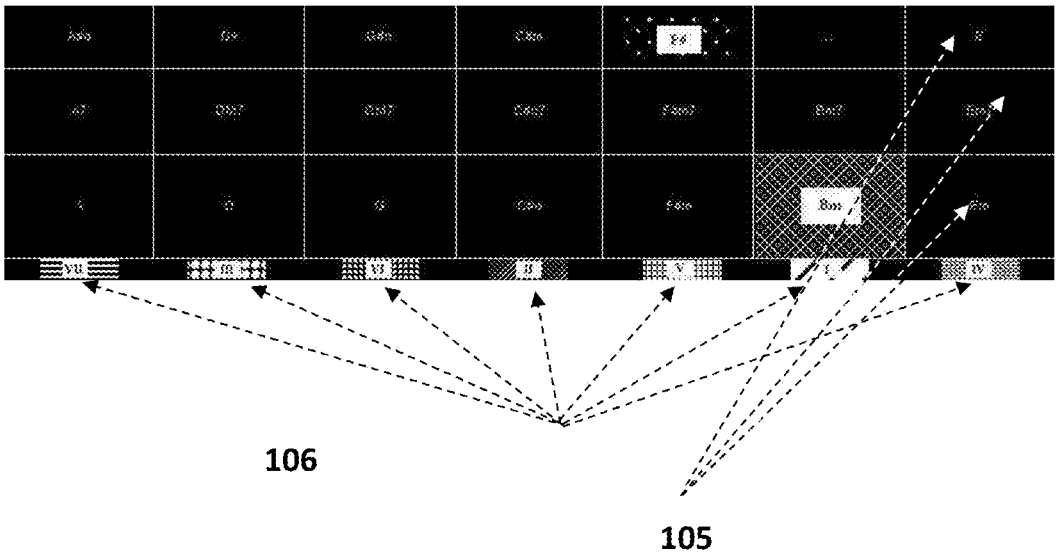
FIG. 4A shows an example of a Chord Selection Matrix Template displayed on the touch screen display according to embodiments of the present invention.

FIGS. 4 and 4A show an example of a touch screen device 1 running the computer software application according to embodiments of the present invention. The touch screen device 1 may be configured for running a computer software application configured for displaying on the touch screen display a Chord Selection Matrix Template being associated with a Musical Key or Key Combination. The Chord Selection Matrix Template being divided into a plurality of Chord Elements positioned in a row and column configuration, as shown in FIGS. 4 and 4A. For example, the Chord Selection Matrix Template may be configured to display a Matrix of three rows 105 by eight columns. Each row, may be configured to display the individual Chords for a selected Key/Mode in their Scale Degree position across the first seven Columns 106. For example, as shown in FIG. 4A, the bottom Row displays the basic Triad Chords of the Key/Mode, while the middle Row displays the seventh Chords of the Key/Mode, and the top Row displays the borrowed Chords from another Key/Mode. The touch screen display 1 may be provided with a scrollable Key Mode selection menu. For example, one of the matrix columns may be configured as a scrollable Key Mode selection menu. For example, in FIG. 4, section 103 of the touch screen display 1 may configured as a scrollable Mode selection menu. On the touch screen device 1 adjacent to the surface there may be provided Chord separators 8 to assist the users in selecting the different Chord positions. The touch screen device 1 may be provided with Control Activation Members associated with a user selected musical instrument. In FIG. 4, Control Activation Members may resemble the strings of a guitar. As shown in FIG. 4, six virtual strings are displayed on the Touch Screen display 101. As shown in FIG. 4, above the touch screen device, adjacent to its surface, there may be provided Chord separators 102 to assist with finger selection of the different Chord Elements positions, when the touch screen device is integrated in an apparatus resembling an electric guitar The user can select a Musical Key from a menu displayed on the Touch Screen Device or by selecting the Musical Key from a range of switches on the body of the Instrument, as shown in FIG. 5. Modes can be selected from the scrollable menu displayed on the Touch Screen Device.

Figure 11:
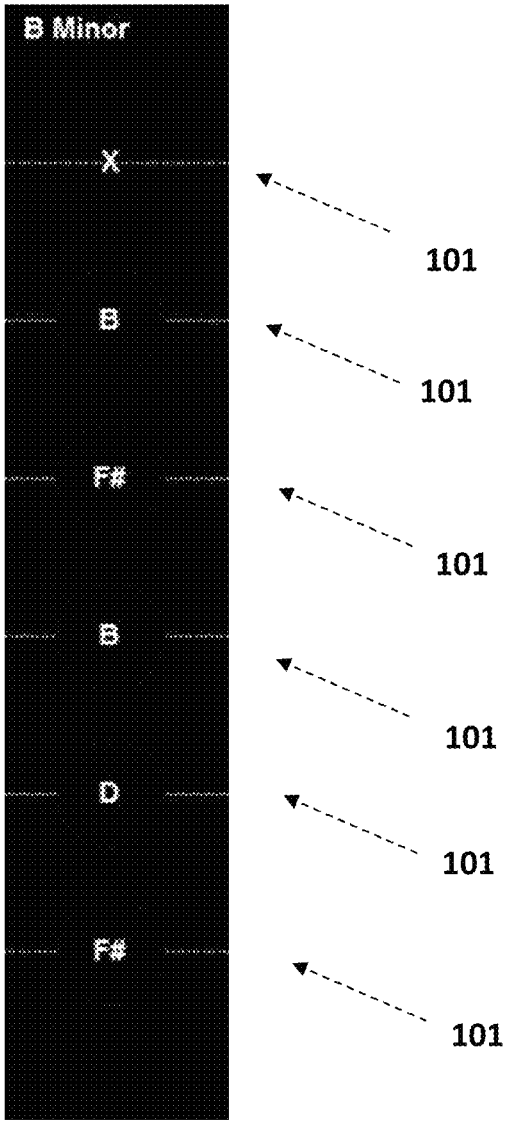
FIG. 11 shows an example of Notes and String assignments for the selected Chord FIG. 12. Image showing the Key information and the view selection menu.

Each Element of the Chord Selection Matrix Template displayed on the User Interface has a Chord File associated with that Element. The Chord File lists the note assignment positions for each string and is editable by the user. An example of a Chord File is shown in FIG. 33. When a user activates an Element, the software running in the Touch Screen Device assigns the note identifiers from that Chord File to the individual Activation Control Members 101. The Activation Control Members 101 may be displayed in an Activation Control Area provided on the touch screen device 1 in the exact order as they we defined in the Chord File, as shown in FIG. 11 e.g. in the form of Virtual strings 101. The Activation Control Members 101 may further be part of the apparatus e.g. in the form of physical Strings 15 of a musical instrument. When the user activates the Activation Control Members e.g. strings, associated with the selected Element in the Matrix, the audio sounds of the individual notes assigned to each Virtual and/or Physical string are played at the amplitude level representative of the activation of the Activation Control Members.

According to embodiments of the present invention, Chord Selection Matrix Templates, with their individual Element Labelling, are configured for every Key/Mode. For example, FIGS. 22 and 22A shows the Key/Modes for B scale Chords. For a single Key song, the Chord Selection Matrix Templates will display the basic Triad Chord of the selected Key on the bottom Row For example, in FIGS. 4A, 106, the basic Triads for B Minor are displayed on the first Row in their Scale Degree positions. The Seventh Chords of B Minor are displayed in the middle Row, while for a single Key song the top Row may remain blank. The additional of a fourth Row will also allow the display of the seventh Chords for combination Key/Modes.

There is provided a computer Software Application which will electronically analyse any song from the user's library to prepare and construct the User Interface that will advise the selection of the appropriate Chord Selection Matrix Template for the analysed song. The User Interface also displays a Chord Timeline, where each Chord Sector will intuitively direct the user to the exact Element that corresponds to the Chords displayed along the Timeline. Optionally, a "Auto display" option is selectable which will highlight the Elements within the Matrix that corresponds to the Chords playing along the Timeline.

As show in FIGS. 7 to 10, there is also provided a means to display, using the data produced by the analysis of any song a Waveform Image and a Chord Timeline interface which displays time duration Sectors for each Chord of the selected song. Each Chord Sector in the Timeline contains the Chord name identifier, its Roman Numeral Scale Degree identifier together with a unique Colour Coded Identifier Bar that indicates the Scale Degree Column and Row in the Matrix for that Chord. Each Chord Sector 110 can display the unique Colour Coded Identifier Bar in any of three Row positions within its Chord Sector.

Figure 10:
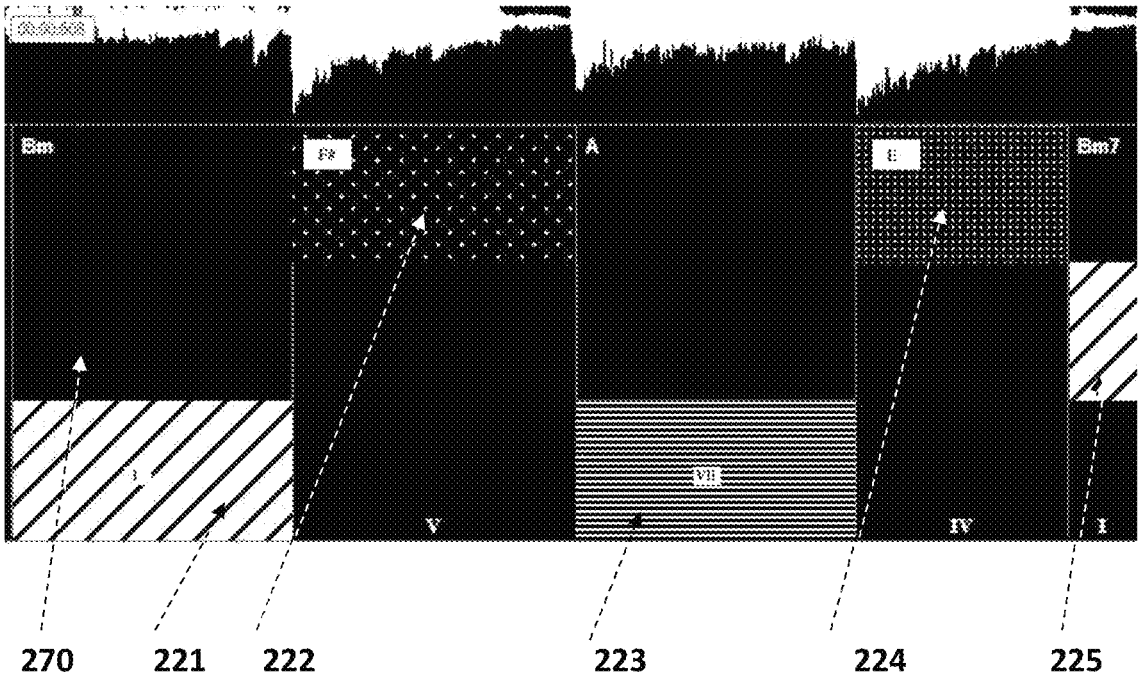

Each Row position within the Chord Sector indicates the Chord value of that Chord using a unique colour coded identifier, as shown in FIG. 10. For example, if the Colour Coded Identifier Bar is placed at the bottom of the Row, 221, 223, it is stating that the Chord is the basic Triad Chord, If the Colour Coded Identifier Bar is placed in the middle position, 225, it is stating that the Chord is a seventh of that Chord. If the Colour Coded Identifier Bar is placed in the top Row of the Sector, 222,224, it is stating that it is a Borrowed Chord from another scale.

As shown in FIG. 11, the notes of the current active Chord, as they have been assigned to each string of the Instrument are displayed.

The Chord Timeline data and its structure are developed from the analysing of the individual Chords of a song. For each Chord in a song that is electronically analysed there can be a number of alternative Chords choices offered, some with similar or very close degree of probability. There are many valid reasons for this ambiguity; quality of the media, quality of the performers, background noise, applied effects, mastering quality etc. To greatly increase the accuracy of the Chord analysis results that are presented in the Timeline, significant further analysis of the detected Chords is undertaken. This further analysis will establish Key/Mode relationships, where Key changes occur and whether any Borrowed Chords from another Key have been identified and make corrections, substitutions, deletions and adjustments as appropriate.

A Combination Key/Mode is advising that there is a predominance of Chords in a primary Key and that a number of high probability Chords are being Borrowed from another scale. The Key/Mode identifier will always display the primary Key Label first followed by the borrowed scale name. This Key/Mode identification naming order is important for the construction and presentation of the Chord Selection Matrix Template.

Figure 12:
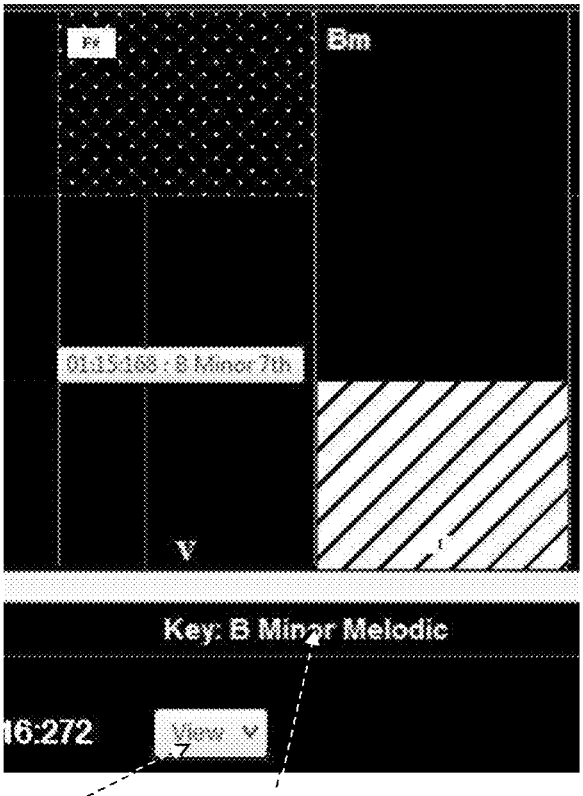
Figure 14:
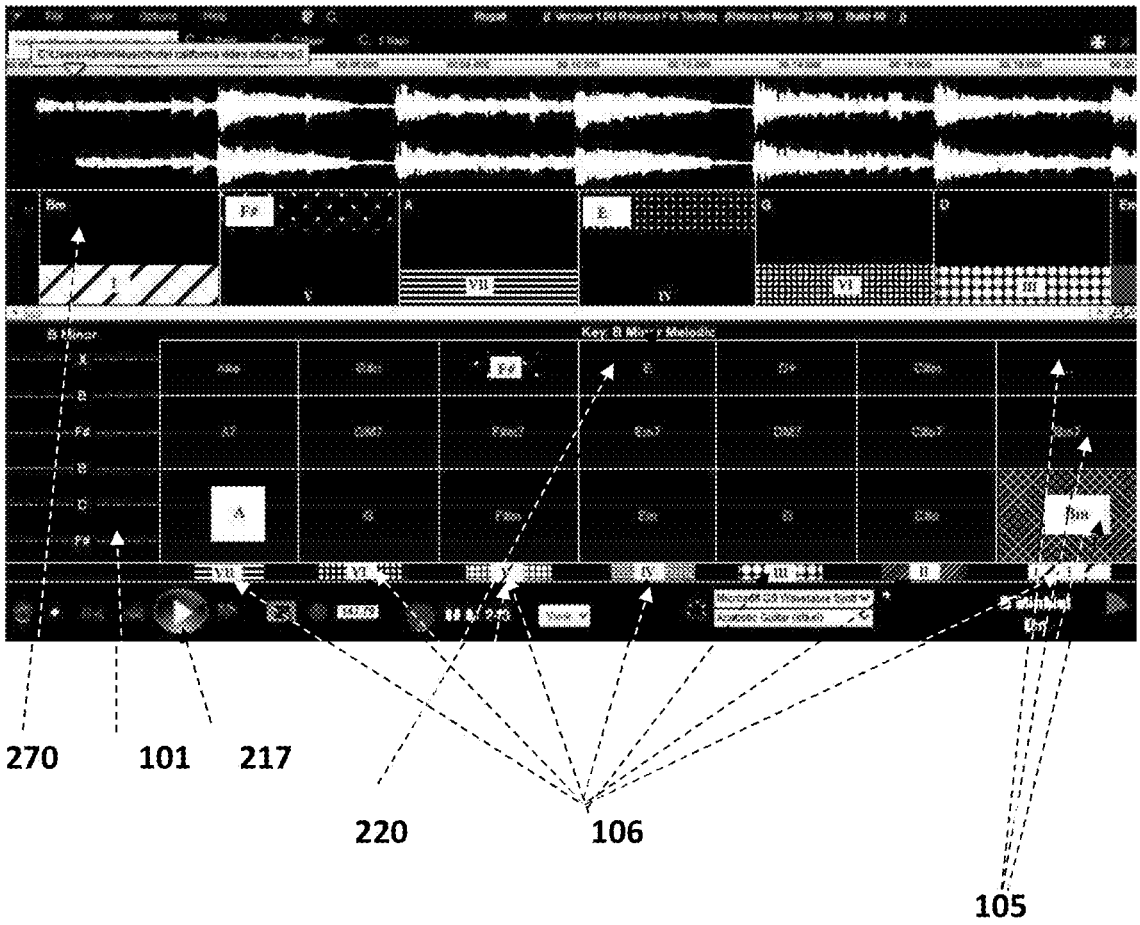
FIG. 14. Image showing Scale Degree Timeline and Element Selection Simulation FIG. 15. Chord Scale Degree TimeLine Sectors on the Element Selection Simulation FIG. 16. Image showing the Scale Degree in The Element Selection Simulation FIG. 17. Image showing tempo slow down and pitch preserve.

As an example is shown in FIGS. 12 and 14, where in a region 220 of the touch screen the detected Key for the song, e.g. "B" Minor Melodic, is displayed. The identification of a Combination Key/Mode, such as B Minor Melodic, is stating that the primary Key is B Minor and that there are Chords Borrowed from the B Melodic Scale.

For a Combination Key, the Chord Selection Matrix Template may be constructed as follows. For example, In FIG. 4A the basic Triads for B Minor are displayed on Row 1 in their Scale Degree positions, 106. The Seventh Chords of B Minor are displayed in the middle Row in their Scale Degree positions. The Borrowed Chords may be displayed on the top Row. In this example, the Chords of B Melodic which are not common to the B Minor scale are displayed on the top Row in their Scale Degree positions. Additional Rows can be added to display Sus2, Sus4, Augmented, 9, 11, etc., Chords to be selected by the user. The additional of a fourth Row will also allow the display of the seventh Chords for combination Key/Modes.

There are many Chord analysis products available in the public domain. The level of Chord detection accuracy for even the very best products is in the low/mid 70% range. These Chord detection accuracy levels can be improved to provide a more fulfilling and enjoyable experience for the user. Employing a third party Chord analysis application, a Chord analysis data File is generated for a selected song. Further analysis on this raw data File is undertaken by the Software Application to improve the Chord accuracy level and to provide an output File that allows the correct Chord Selection Matrix Template be identified According to embodiments of the present invention describes a Method and Means whereby a Software Application running on a controlling Device may be provided. The computer software application is configured to analyse the Chords of any Song in the user's library and from this further Analysis, a Single Key/Mode or a Key/Mode Combination is calculated, where all the Chords notified in the Chord File will have specific Scale Degree positions within the Key/Mode or the Key/Mode Combination that is calculated and advised. One of the objective of the Chord Analysis exercise is to establish a Musical Key/Mode and with that Key/Mode information, generate a Chord File for the selected Song, where all the notified Chords fit the Scale Degree positions of the Musical Key/Mode or the Combination Key/Mode that is advised. Using the data provided by the Musical Key/Mode identification and the Chord File Data, a Chord Scale Degree TimeLine is presented for the selected Song to assist with learning to play the Chords of the selected Song quickly and easily. The Software Application also provides a Means to allow the quick and easy triggering of the individual Note sounds for the Chords of the selected Song employing a broad range of Virtual and Physical Instrument Embodiments. A broad range of Musical Instrument sound choices are offered for all Embodiments.

For each Musical Key/Mode or Combination Key/Mode that is selectable, an associated Chord Selection Matrix Template has been developed, where each Element of the Matrix Template has a Chord Assignment File associated with that Element. Each Chord Assignment File contains the Note assignment names, the Notes assigned to the individual Activation Control Member for different Embodiments and the MIDI Note identifier number for each Note assigned to each Activation Control Member. The Chord Assignment File is editable by the user. When the user selects an Element within the Matrix, the Software Application will assign the Note name and MIDI Number from the associated Chord Assignment File to the individual Activation Control Members in the exact order that they are defined in the Chord Assignment File. When the user activates any of the Activation Control Members associated with a selected Element, the audio sounds of the individual Notes assigned to each Activation Control Member will be played. The Software Application also provides a Means to allow the quick and easy triggering mechanisms for the individual Note sounds for the selected Chords employing a broad range of Virtual and Physical Instrument Embodiments. A range of Musical Instrument sound choices are offered for all Embodiments. The Midi Note stream from the Chord Scale Degree Timeline is accessible to be played on any Midi supported Software or Hardware Device. The individual Midi Notes can be captured, saved and be edited using most standard Midi Creation Software Applications.

According to embodiments of the present invention, in the examples where the Chord selection and activation is facilitated on an apparatus similar to the one presented in FIG. 1, the software application may intuitively identify and direct the selection of the Matrix Element that corresponds to the individual Chords as they are displayed along the Scale Degree Timeline.

According to embodiments of the present invention, different examples of music instruments may be provided for use as music learning tools and for performing and for original content Creation.

According to embodiments of the present invention, a method is provided to assist with learning to play along with any selected Song employing a Physical Stringed Instrument Embodiment and a Means is provided to play the Chord Note sounds of the selected Song quickly and easily.

According to embodiments of the present invention, a method is provided to assist with learning to Author Original Musical Creations employing a Physical Stringed Instrument Embodiment and a Means is provided to play the Chord Note sounds of the selected Chords quickly and easily on the Physical Stringed Instrument.

According to embodiments of the present invention, a method is provided to assist with learning to quickly play along with any selected Song employing a Virtual Keyboard Instrument Embodiment and a Means is provided to play the Chord Note sounds of the selected Song quickly and easily on the Virtual Keyboard Instrument.

According to embodiments of the present invention, a method is provided to assist with learning to Author Original Musical Creations employing a Virtual Keyboard Instrument Embodiment and a Means is provided to play the Chord Note sounds of the selected Chords quickly and easily on the Virtual Keyboard Instrument.

According to embodiments of the present invention, a method is provided to assist in learning to quickly play along with any selected Song employing a Virtual Stringed Instrument Embodiment and a Means is provided to play the Chord Note sounds of the selected Song quickly and easily on the Virtual Stringed Instrument.

According to embodiments of the present invention, a method is provided to assist with learning to author original Creations employing a virtual and/or a physical musical instrument and associated software to play the Chord Note sounds of the selected Chords quickly and easily on the Virtual Stringed Instrument.

According to embodiments of the present invention, a range of physical and virtual devices may be provided that can assist the user. For example, according to the present invention, a Virtual Reality (VR) or Augmented Reality (AR) headset may be provided arranged to execute the method of the present invention.

To assist with learning to play along with a selected Song, a Chord Analysis exercise is undertaken which will calculate a Musical Key/Mode together with the generation of a final Chord File for the selected Song, where all the notified Chords will have specific Scale Degree positions within the Musical Key/Mode or the Combination Key/Mode that is advised. Using the data provided by the Musical Key/Mode identification and the Chord File, a Chord Scale Degree Timeline is presented for the selected Song to assist with learning to play the Chords of the selected Song quickly and easily. The Software Application also provides a Means to assist users to quickly and easily generate the individual Note sounds for the Chords of the selected Song employing a range of Virtual and Physical Instrument Embodiments. A selection of Musical Instrument sounds may be offers in each case, as shown in FIGS. 34 to 37 as 275.

Additionally, for every Musical Key/Mode or Combination Key/Mode that is selectable, an associated Chord Selection Matrix Template is developed, where each Element of the Matrix Template has a Chord Assignment File associated with that Element which contains the Note assignment names, the Notes assigned to the individual Activation Control Member for different Embodiments and the MIDI Note identifier number for each Activation Control Member. The Chord Assignment File is editable by the user. When the user selects an Element from the Matrix, the Software Application will assign the Note name and MIDI Number from that Chord Assignment File to the individual Activation Control Members in the exact order that they are defined in the Chord Assignment File. When the user activates any of the Activation Control Members associated with a selected Element, the audio sounds of the individual Notes assigned to each Activation Control Member will be played.

The Musical Key/Mode or Combination Key identification together with the final Chord File are produced by the further Analysis of the Chords of the selected Song. For each Chord in a Song that is electronically analysed there can be many alternative Chords choices offered, some with similar or very close degree of probability. There are many valid reasons for this ambiguity; quality of the media, quality of the performers, background noise, applied effects, mastering quality etc.

To greatly increase the accuracy of the Chord Analysis results, significant further Analysis of the detected Chords is undertaken. This further Analysis will establish Key/Mode relationships, where Key changes occur and whether any Borrowed Chords from another Key scale have been identified and for the Software Application to make corrections, substitutions, deletions and adjustments as appropriate.

There are many Chord Analysis products available in the public domain. The level of Chord detection accuracy for even the very best products is in the low/mid 70% range. These Chord detection accuracy levels can be improved to provide a more fulfilling and enjoyable experience for the user. Employing a third party Chord Analysis application a Chord Analysis data File is generated for a selected Song. Further Analysis on this raw data File is undertaken to significantly improve the Chord accuracy level and from this further Analysis a Single Key/Mode or a Key/Mode Combination is calculated, where all the Chords notified in the Chord File will have specific Scale Degree positions within the Key/Mode or the Key/Mode Combination that is advised. One of the objectives of the Chord Analysis exercise is to identify and establish a Musical Key/Mode and any Key/Mode changes as they occur and thereafter to generate a Chord File for the selected Song.

The Key and Chord File (Carousel file), shown in FIG. 31, is generated from an audio file e.g. in .wav, .mp3 etc. format.

Figure 29:
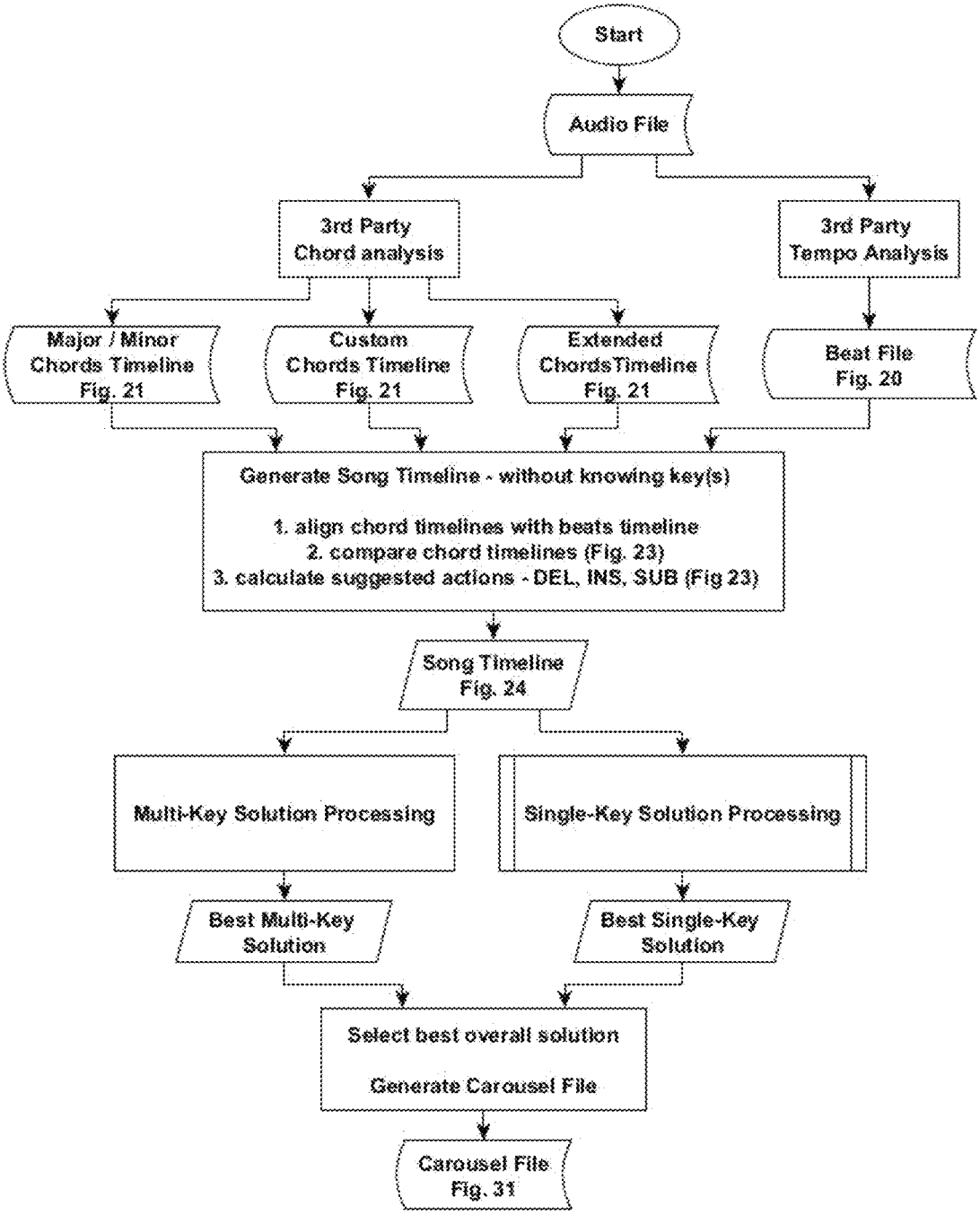
FIG. 29. Flowchart of the process to generate the Key and Chord Carousel file.
Figure 30:
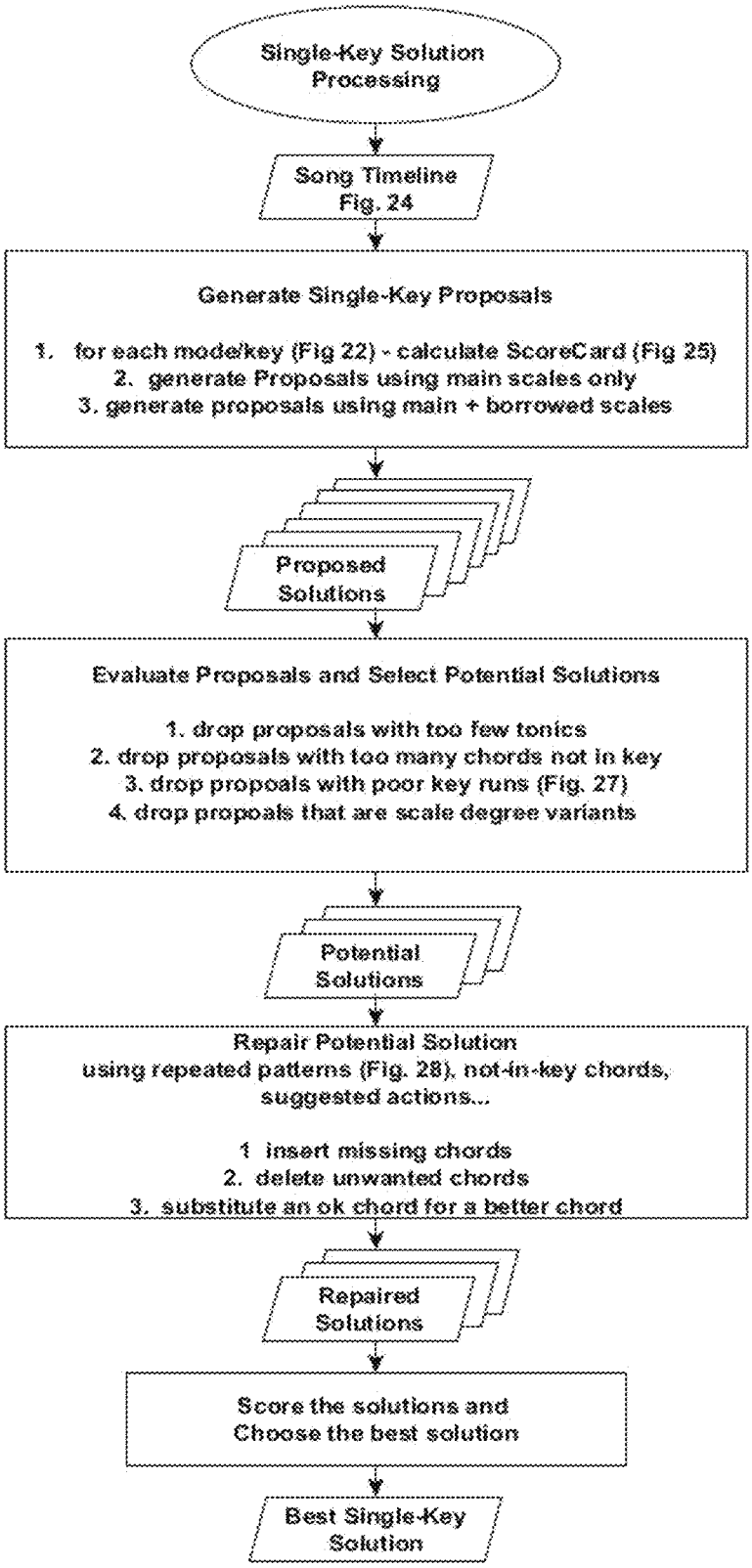
FIG. 30. Flowchart showing details of a Single Key selection processing FIG. 31. Final output Key/Mode and Chord Details File (Carousel File).

Flow charts are presented in FIGS. 29 to 30. to provide a general overview of the processes involved from the receipt of the raw Chord data from a third party application through to the generation of the Key and Chord File (Carousel file).

A third party application is used to analyse the audio file and provide a Beat File which identifies the DownBeat positions, as shown in FIG. 20. The Downbeat information facilitates the identification of Bars within a Song.

A third party application is also used to analyse the audio file and provide a Chords Timeline File, as shown in FIG. 21. The Analysis is run three times using different Chord vocabularies. The three vocabularies (Major/minor, custom, and extended) are listed in FIG. 21A.

As the third party Chords Timeline Analysis is typically not highly accurate, the Chord Timeline must be modified and repaired by finding and fixing bad Chords using various techniques including:

- establishing what Key(s) the Song is in
- look for (anomalies in) repeated patterns—in Chord progression, Chord lengths, Chord offsets, etc. . . .
- use counters—calculated from the Timeline: number of tonics etc. . . .
- use known facts—list of most common Key changes, etc. . . .
- learn from differences between the three Chords Timelines—provides suggested actions (DEL, INS, SUB)

A Song may be in a Single Key (Single-Key Song) or it may involve Key changes (multi-Key Song).

All the Chords in a Single-Key Song should belong to one Key (the main Scale). However, in certain circumstances, we accept Chords that do not belong to the main scale if they belong to a Second scale—called the Borrowed Chords scale.

A valid Single-Key Song is a Song where all the Chords belong to either:

a main scale a combination of two scales—a main scale and a borrowed Chords scale.

FIGS. 29 and 30, present exemplified flow charts, which outline the process involved in analysing the Chords provided by a third party application for a selected Song and using that data to generate a Key and Chord File (Carousel file). It is Firstly assumed that the Song is a Single-Key Song and establish if the Chords advised fits any Single Key. All possible Single Key solutions are identified and after some repairs have been affected the best matching Keys are selected as potential candidates. Separately, it is assumed that the Song is a multi-Key Song and Analysis is undertaken to identify the best potential multi-Key candidate for the selected Song. The best candidate from the Single and multiple Key solutions will be used to generate the Key and Chord File (Carousel File).

FIG. 21 shows the format of the Chord Analysis data for the Song "Hotel California". The First Chord identified, at time 0.464, is suggested as being "Bm" with a probability of 0.835. Alternative Chord options, with their probabilities are also provided for comparison. The Second Chord, at a time of 3.762, is suggested as being "F #7" with a probability of 0.7585. The nearest alternative suggested for "F #7" is "F # maj" with a probability of 0.7556 which is very close to "F #7". For every Chord advised there are a range of alternatives Chord suggestions provided with their probability ratings.

FIGS. 22 and 22A shows, as an example, a table showing the individual Chords for "B" Key/Mode scales with their Chords arranged in their Scale Degree positions.

FIG. 23 shows a comparison between two of the three Chord Analysis Files. The differences show what Chords to substitute, delete or insert to get from one Chord Timeline to the other. The differences are shown graphically and in list format.

FIG. 24 shows an extract from a Song as a Chord Timeline. The Timeline is the result of merging the information in the three Chord Timelines and the beats file into a Single Timeline. Each Chord in the Song Timeline may have suggested actions—such as moving a Chord, substituting a Chord, inserting a Chord or a NOP (Agreement about this Chord between Files). These suggested actions may be applied as part of the repair process.

FIG. 25. When some of the obvious suggested actions from FIG. 23 and FIG. 24 have been implemented, the Single File, as produced in FIG. 24. is run against each Key Chord Scale, as shown in FIGS. 22 and 22A, to establish which Key Scale most closely accommodate the Majority of these Chords. The aggregate of the Chords, in their Scale Degree positions, for each Single Key/Mode, is calculated and the "not in Key/Mode" Chords are identified.

In FIG. 26, a weighting is applied to the I, IV and V Scale Degree position to calculate a score. The highest scoring Key/Mode is identified as the best potential candidates for a Single Key/Mode solution.

In FIG. 27, from the data analyses as shown in FIG. 26 the Key of "B" Minor Melodic is identifies as the appropriate Key/Mode. A Key Run for this Key is developed to identify the gaps in the run and the exceptions that cause the run to break.

FIGS. 28, 28A, 28B and 28C, a Chord Progression File for the selected Key/Mode is created following the further analyses of the Key Run results. The Chord Progression File for the Song is shown with their Roman Numeral Scale Degree numbers and with their full Chord name identifiers. The positions, where earlier Analysis could not find a Chord fit for the candidate Key/Mode, a—indicator is shown. Further Analysis, as indicated in FIGS. 28, 28A, 28B and 28C is undertaken, to identify sequences of Chord that repeat throughout the Song. The Chord repeat results will provide suggestions as to a suitable Chord to fit the—position. The Chord repeat Analysis in this Embodiment is undertaken using Scale Degree identifiers and Chord name identifiers.

In FIG. 29, an exemplified Flowchart is shown with the steps to be performed following the receipt of the Chord data from the third party application, as shown in FIGS. 20 and 20A, through to the presentation of the Key and Chord File (Carousel file), as shown in FIG. 31

FIG. 30, shows an exemplified flowchart detailing a Single Key solution processing as outlined in FIG. 29

In FIG. 31, the Key/Mode Chord Output File (Carousel File) is generated from the Analysis referenced above. Further Analysis is undertaken to this output File to adjust the Seventh Chord Labels to fit the selected Key/Mode. For Major Keys. all Tonic Sevenths must be Major Sevenths, All Subdominant Sevenths must be Major Sevenths and all Dominant Sevenths must be Sevenths. This File is the input File for the Scale Degree Timeline UX interface and for the selection of the corresponding Chord Selection Matrix Template for the selected Song.

In FIG. 32, the Chord Progression table is shown for a Song where a Key change is identified. The chosen Song is "The Gambler". Even a quick scan of the progression tables would indicate that the Song starts in the Key of Eb Major and changes to E Major during the playing of the Song. This invention identifies individual scale Keys, Key/Modes, Combination Keys, Borrowed Chords and Key changes for a selected Song.

In FIG. 33, the Chord File showing the individual Notes of each Chord and their String assignment details.

A Physical Stringed Instrument Embodiment of the Invention resembles a traditional electric guitar, which has been modified with a Touch Screen Device fitted into the neck of the Instrument. The Touch Screen Device has a processor, storage memory and a touch sensitive display screen and communication capability to and with external Devices.

The Physical Stringed Instrument facilitates the manual selection of a Musical Key FIGS. 3 and 5 shown as 10, where, as an example only, a rotary or touch based switch will present the Musical Key options in a Circle of Fifths layout as shown in greater detail in FIG. 6. The default settings for the rotary switch is for Major Key selection, FIGS. 3 and 5 shown as 9, shows, as an example only, a switch to toggle between Major and Minor Key selection on the rotary switch. Manual Key change can be applied during playing, up or down a single step in the Circle of Fifths Key by selecting the appropriate + or − switch as outlined in 7. The notes assigned to a selected Chord can be raised by one and two octaves by activating the appropriate switches +1, +2, 8. Real time effects can be applied with switches, shown as example only in 7. Effects parameter adjustment can be applied, in real time, with variable pots, shown, as an example only, in 5. Physical Strings as Activation Control Members are fitted as shown at 15

This Embodiment describes a Means to choose a Chord Selection Matrix Template on the Touch Screen Device, fitted to the neck of the Instrument, where the individual Chords detected for the chosen Song will have an associated Element displayed within the Matrix.

The invention describes a Means to configure and layout a Chord Selection Matrix Template for a broad range of Musical Keys/Modes.

To exemplify the present invention, the physical Stringed Instrument shown in FIGS. 1 and 3 may be used, where every Musical Key/Mode or Combination Key/Mode that is advised and selectable has an associated Chord Selection Matrix Template. Each Element of the Chord Selection Matrix represents a unique Chord for the advised Key/Mode. Each Chord represented as an Element has an associated Chord Assignment File which contains the Note names, the Note assignments to individual Activation Control Member for different Embodiments together with the MIDI Note identifier number of each assigned Note. The Chord Assignment File is editable by the user. When the user selects a Chord Element from within the Matrix, the Software Application will assign the Note name and MIDI Number from that Chord Assignment File to the individual Activation Control Members in the exact order as defined in the Chord Assignment File. When the user activates any of the Activation Control Members associated with a selected Element, the audio sounds of the individual Notes assigned to each Activation Control Member will be played. A Chord Scale Degree Timeline is generated using the data presented in the Key/Mode and Chord file, as shown in FIG. 31. The Scale Degree Timeline displays a sequence of individual Chord Sectors for the selected Song. The Chord Sector layout has been designed to display data within the Sector that will intuitively direct the user to select the exact Element on the Touch Screen Device that corresponds to data displayed within each Sector. The Colour of the identifier Bar within each Chord Sector advises the Scale Degree position and hence the Matrix Column number. The positioning of the identifier Bar within each Chord Sector advises the quality of the Chord and hence its Matrix Row number.

In this Physical Stringed Instrument Embodiment, the Chord Selection Matrix Template has been advised by the Key and Chord File as being "B" Minor Melodic, as shown in FIG. 31. The Chord Selection Matrix Template for "B" Minor Melodic is displayed in FIGS. 14 to 15. There are two name Labels advised for this Song which means that it is a Combination Key.

As shown in FIGS. 4 and 4A, the Touch Screen Device 1 displays a Matrix of three Rows and seven Columns and a menu column FIG. 4A shows each Row displaying the individual Chords for a selected Key/Mode in their Scale Degree position across the first seven Columns. The Bottom Row displays the basic Triad Chords of the Key/Mode. The Middle Row displays the Seventh Chords of the Key/Mode. The Top Row displays the borrowed Chords from another Key/Mode.

A Combination Key/Mode is advising that there is a predominance of Chords in the primary Key and that many high probability Chords are being borrowed from another scale. The Key/Mode name Label will always display the primary Key name first followed by the borrowed scale name. This naming order is important for the organisation of the Chord Selection Matrix Templates. For the Song "Hotel California" the output File is advising a Combination Key "B" Minor Melodic, 220. The identification of a Combination Key/Mode, such as "B" Minor Melodic, is stating that the primary Key is "B" Minor and that there are Chords Borrowed from the "B" Melodic scale.

Figure 15:
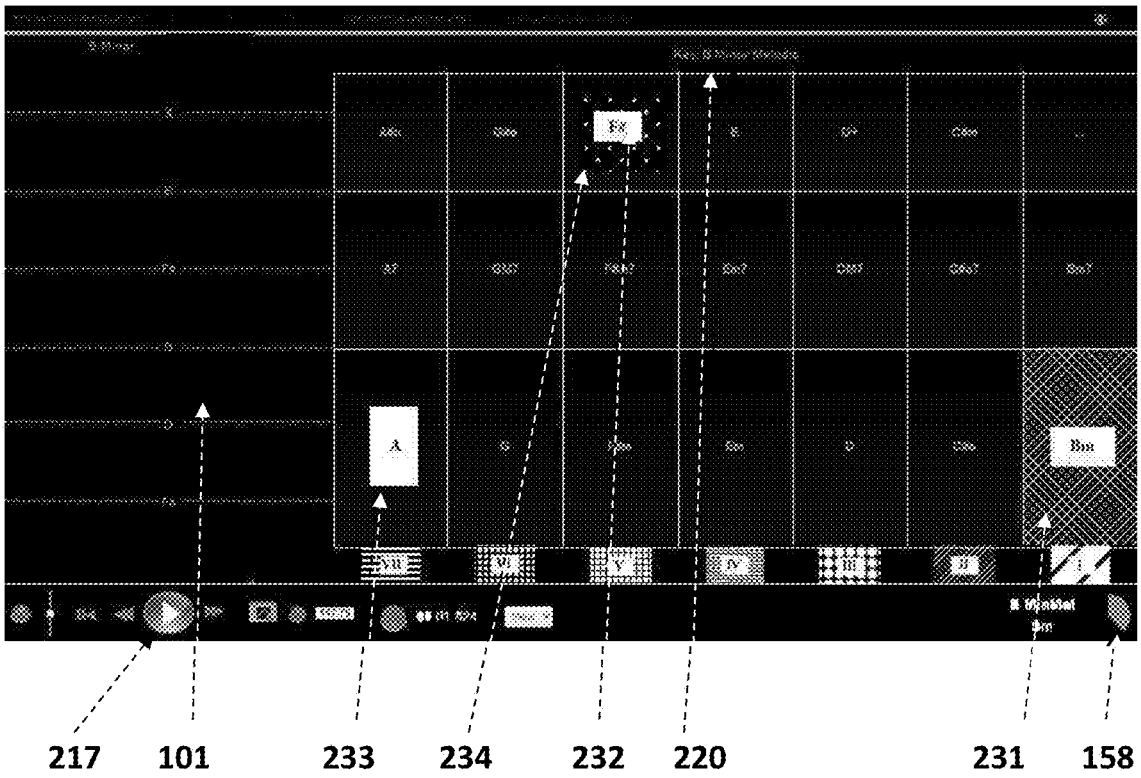
Figure 16:
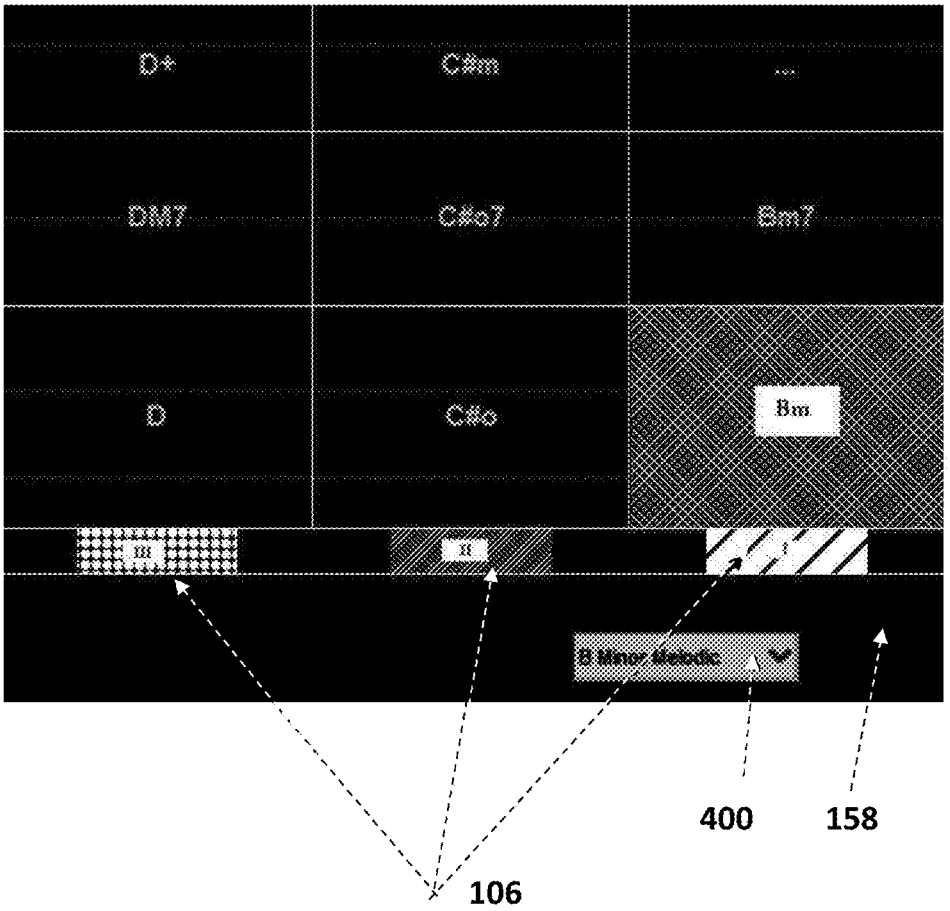

For a Combination Key, the Matrix will be constructed as follows. For example, In FIG. 4A, 106, the basic Triads for the primary Key, "B" Minor, are displayed on Row 1 in their Scale Degree positions in a Circle of Fifths layout. The Seventh Chords of the primary Key "B" Minor are displayed in the Middle Row in their Scale Degree positions. The Borrowed Chords from "B" Melodic may be displayed on the Top Row of the Matrix in their Scale Degree positions. When a Combination Key/Mode is advised, the Chords of the Borrowed scale "B" Melodic, which are not common to the primary "B" Minor scale are displayed on the Top Row in their Scale Degree positions. FIG. 4A displays the Columns in the "Circle of Fifths" order. FIGS. 14 and 15 display the Columns in ascending Scale Degree order.

As shown in FIG. 31, the First Chord identified for the Song from the File is "Bm" with a timestamp start at 447 ms and with its end at 3849 ms. As a result, the associated Chord Sector representing this Chord in the Scale Degree Timeline will start at 447 ms and finish at 3849 ms. In the Chord Selection Matrix Template for "B" Minor Melodic, shown in FIGS. 14 and 15, the "Bm" Chord Element position is in Row 1 Column 1 which is in the Scale Degree Position labelled by the Roman Numeral "I". All Chords in the Scale Degree position, Roman Numeral "I", have a specific colour coded identification bar. As the "Bm" Matrix Element is positioned on the Bottom Row of the Chord Selection Matrix Template, the Colour Coded Identifier will be position at the Bottom of the Chord Sector in the Scale Degree TimeLine.

In FIG. 10, 221, the "Bm" Sector in the Scale Degree Timeline starting at 447 ms and ending at 3849 ms. The Colour coded identifier bar is advising that the Element is in the first column. The identification Bar is displayed at the Bottom of the Sector which is advising that the Element is on the Bottom Row of the Matrix.

The Chord Sector data displayed for "Bm" in the Scale Degree Timeline is advising that the corresponding Element is in Row 1 Column 1.

Additionally, the Chord "Bm" Name is displayed at the Top left of the Sector together with its Roman Numeral Scale Degree number shown at the Bottom, as shown in FIG. 10, 270.

As shown in FIG. 31, the Second Chord identified for the Song is "F #7". The Chord Sector in the Scale Degree Timeline will start at 3849 ms and finish at 6849 ms. As shown in FIGS. 14 and 15, in the Chord Selection Matrix Template for "B" Minor Melodic, the "F #7" Chord Element position is in Row 3 Column 5 which is in the Scale Degree Position Labelled by the Roman Numeral "V", 234. A Chord represented in the third row for a Combination Key represents a borrowed chord. As there are only three Matrix Rows presented in this example, the "F #7" is adjusted to the Triad "F #". All Chords in the Scale Degree position, Roman Numeral "V", are displaying with a specific colour coded Identification Bar. As the corresponding Matrix Element is positioned on the Top Row of the Chord Selection Matrix Template, the Colour Coded Identifier will be position at the Top of the "F #" Chord Sector in the Scale Degree Timeline.

FIG. 10, 222, shows the "F #" Sector in the Scale Degree Timeline starting at 3849 ms and ending at 6849 ms. The Colour coded identification bar is advising that the Element is in Column 5. The identification Bar is displayed at the Top of the Sector which is advising that the Element is on the Top Row of the Matrix.

The Chord Sector data displayed for "F #" in the Scale Degree Timeline is advising that the corresponding Element is in the third Row and fifth Column.

Figure 9:
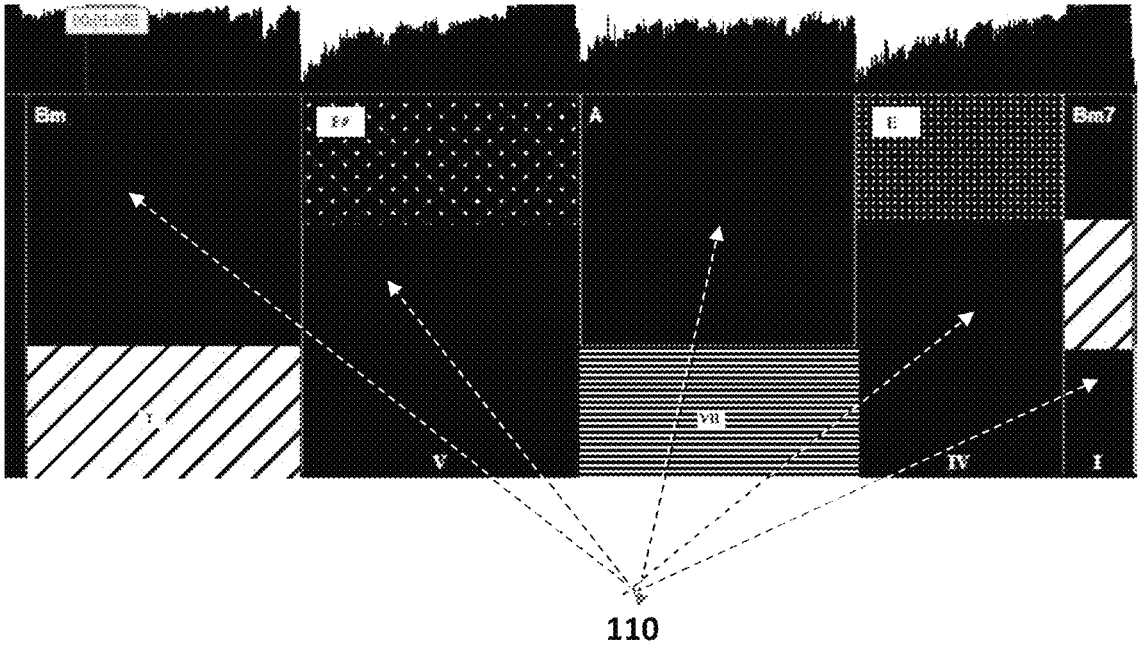

Additionally, the Chord "F #" Name is displayed at the Top left of the Sector together with its Roman Numeral Scale Degree shown at the Bottom, as shown in FIG. 9.

In FIG. 31, the Third Chord identified for the Song is "A" with a timestamp start at 6849 ms and with its end point at 10247 ms. Therefore, the Chord Sector representing this Chord in the Scale Degree Timeline will start at 6849 ms and finish at 10247 ms. As show in FIGS. 14 and 15, for "B" Minor Melodic the "A" Chord Element position is in the first Row and seventh Column which is in the Scale Degree Position labelled by the Roman Numeral "VII", 233. All Chords in the Scale Degree position, Roman numeral "vii", have a specific colour coded identification bar. As the corresponding Matrix Element is positioned on the Bottom Row of the Chord Selection Matrix Template, the Colour Coded Identifier will be position at the Bottom of the Chord Sector.

FIG. 10, 223. shows the "A" Chord Sector in the Scale Degree Timeline starting at 6849 ms and ending at 10247 ms. The Colour coded identification Bar is advising that the Element is in Column 7. The identification Bar is displayed at the Bottom of the Sector which is advising that the Element is on the Bottom Row of the Matrix.

The Chord Sector data displayed for "A" in the Scale Degree Timeline is advising that the corresponding Element is in Row 1 Column 7.

Additionally, the Chord "A" Name is displayed at the Top left of the Sector together with its Roman Numeral Scale Degree shown at the Bottom, as shown in FIG. 9

The Fourth Chord identified for the Song in FIG. 31 is the "E7" Chord. The Chord Sector in the Scale Degree Timeline will start at 10247 ms and finish at 12846 ms. In the Chord Selection Matrix Template for "B" Minor melodic, as shown in FIGS. 14 and 15, the "E7" Chord Element position is in Row 3 Column 4 which is in the Scale Degree Position Labelled by the Roman Numeral IV. A Row 3 Chord for a Combination Key Means that it is a Borrowed Chord and as there are only three Matrix Rows presented in this Embodiment the "E7" Chord is adjusted to the Triad "E". All Chords in the Scale Degree position, Roman Numeral "IV", have a specific colour coded identification bar. As the corresponding Matrix Element is positioned on the Top Row of the Chord Selection Matrix Template, the Colour Coded Identifier will be position at the Top of the "A" Chord Sector in the Scale Degree Timeline.

In FIG. 10, 224, the "E" Sector in the Scale Degree Timeline starts at 10247 ms and ending at 12846 ms. The colour Coded Identification Bar is advising that the Element is in Column 4. The identification Bar is displayed at the Top of the Sector which is advising that the Element is on the Top Row of the Matrix. The Chord Sector data displayed for the "E" Chord in the Scale Degree Timeline is advising that the corresponding Element is in the third Row and fourth Column. Additionally, the Chord "E" name is displayed at the top left of the Chord Sector together with its Roman Numeral Scale Degree shown at the Bottom In FIG. 31, the Fifth Chord identified for the Song is "Bm7" with a timestamp start at 12846 ms and with its end point at 13445 ms. Therefore, the Chord Sector representing this Chord in the Scale Degree Timeline will start at 12846 ms and finish at 13445 ms. As shown in FIGS. 14 and 15, for "B" Minor Melodic the "Bm7" Chord Element position is in second Row and first Column which is in the Scale Degree Position Labelled by the Roman Numeral "I". All Chords in the Scale Degree position, Roman Numeral "I", have a specific colour coded identification bar. As the corresponding Matrix Element is positioned in the Middle Row of the Chord Selection Matrix Template, the Colour Coded Identifier will be position in the Middle of the Chord Sector "Bm7" in the Scale Degree Timeline. FIG. 10, 225, shows the "Bm7" Sector in the Scale Degree Timeline starting at 12846 ms and ending at 13445 ms. The identification bar is advising that the Element is in Column 1. The identification Bar is displayed in the Middle of the Sector which is advising that the Element is in the Middle Row of the Matrix. The Chord Sector data displayed for "Bm7" in the Scale Degree Timeline is advising that the corresponding Element is in the Middle Row and first Column. Additionally, the Chord "Bm7" Name is displayed at the Top left of the Sector together with its Roman Numeral Scale Degree shown at the Bottom, as shown in FIG. 9.

Figure 8:
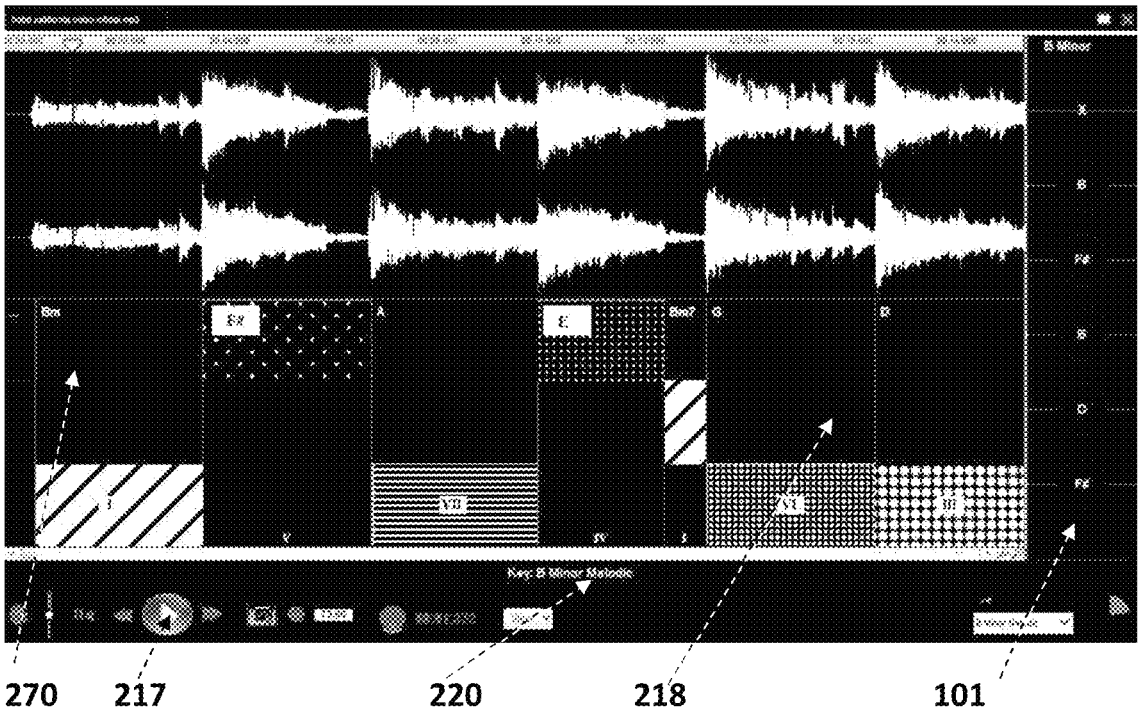
FIGS. 8 to 10 show an example of a User Interface displaying a song waveform and a Chord Scale Degree Timeline with Chord Notes according to embodiments of the present invention.

In FIG. 8, when the play button, 217, is selected, the Cursor, 270, moves into the first Chord Sector. The Notes for the "Bm" Chord, as they have been assigned to each individual String on the Instrument will be displayed, in their assigned order, in the Note display window, 101.

Each Element of the Chord Matrix displayed on the Touch Screen has a Chord File associated with the Element. The Chord File lists the Note assignment positions for each String and is editable by the user, as shown in FIG. 33. When a user activates an Element, the software running in the Touch Screen Device assigns the Note identifiers from that Chord File to the individual Virtual and/or physical Strings of the Instrument in the exact order as they we defined in the File, as shown in FIG. 33. When the user activates the Strings associated with the selected Element in the Matrix, the audio sounds of the individual Notes assigned to each String are outputted at the amplitude and for the duration of the String activations and vibrations. The Key/Mode can be selected from a menu displayed on the Touch Screen Device or by selecting the Key from a range of switches on the body of the Instrument, as shown in FIG. 5. Modes can be selected from the scrollable menu displayed on the eighth Column of the Touch Screen Device 103, as shown in FIG. 4.

Figure 17:
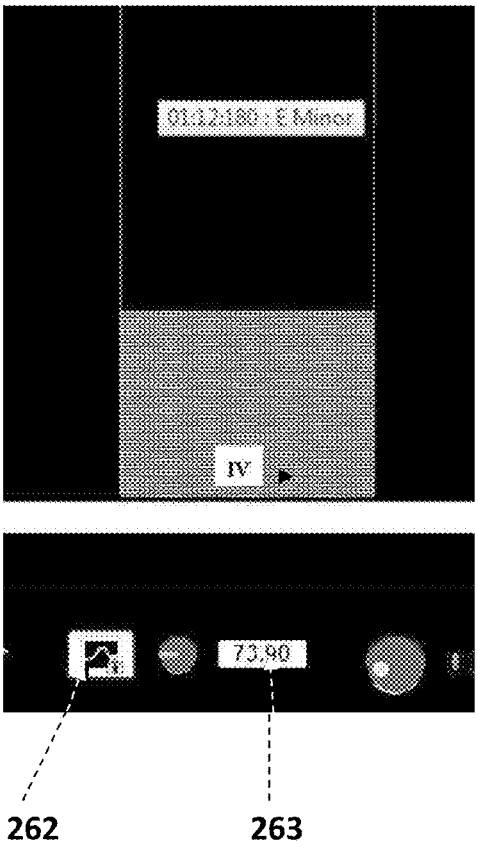
Figure 18:
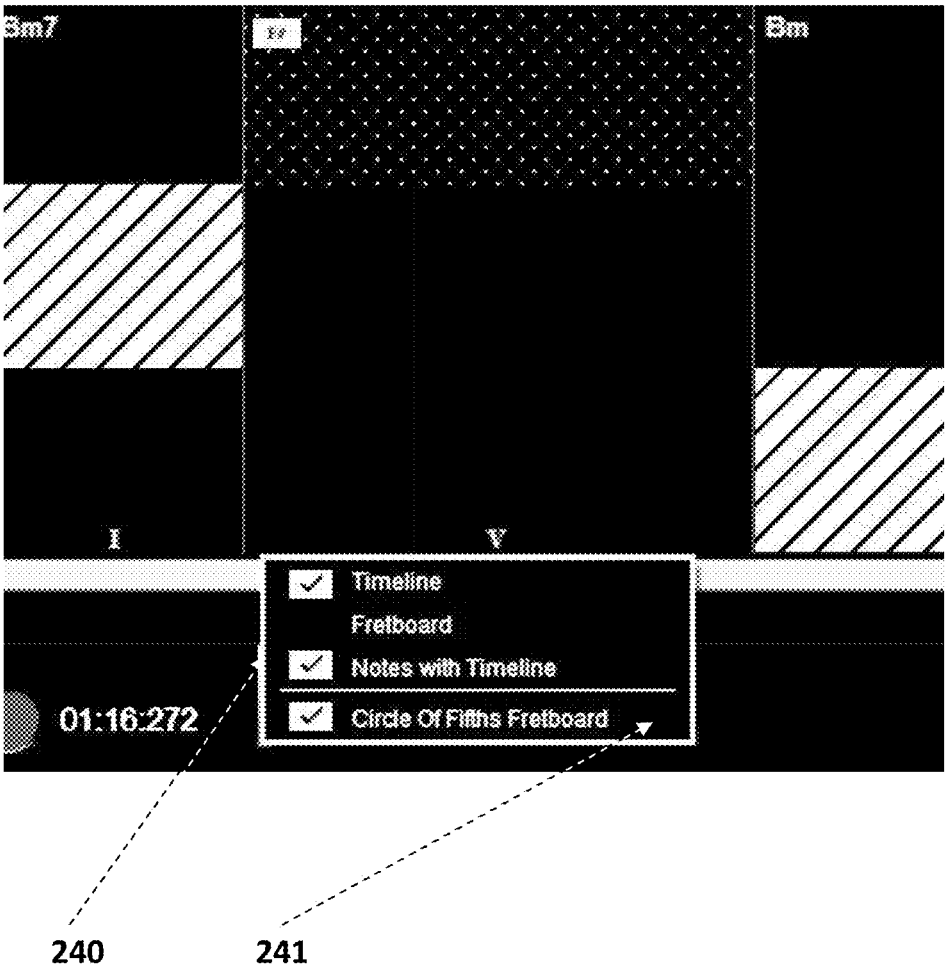
FIG. 18. Display menu for Circle of Fifths selection for display.
Figure 19:
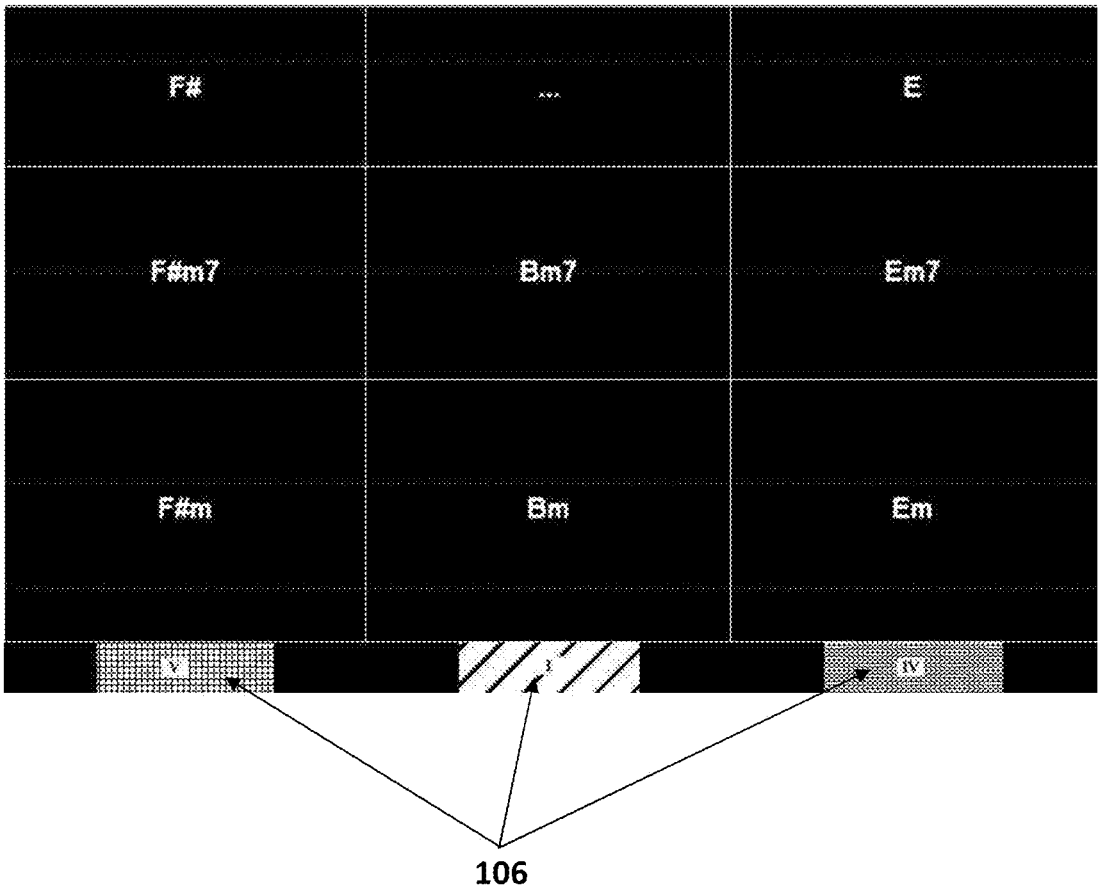
FIG. 19. Image showing a Circle of Fifths representation for the Matrix.

As shown in FIG. 17, 263, the Chord Scale Degree TimeLine can be slowed down to assist the user in learning the Chords and their Note associations, while the pitch can be preserved for the Song, 262.

Additionally, an Element Selection Simulation (Auto Display) is selectable to provide additional assistance to beginners in identifying the exact Matrix Elements that correspond with the Chords playing in the Chord Scale Degree Timeline for the selected Song, as shown in FIGS. 14 and 15.

Figure 13:
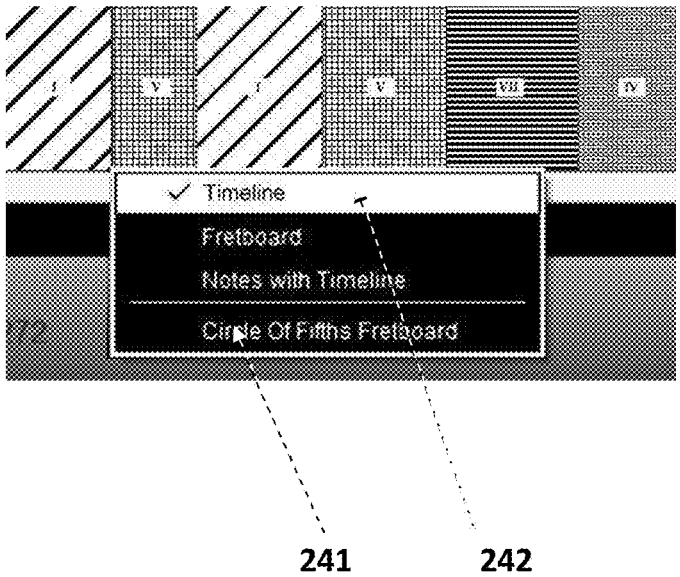
FIG. 13. Image showing the menu options offered by the view window.

As shown in FIG. 12, the user can select the Element Selection Simulation (Auto Display) view and then select the Fretboard option, as shown in FIG. 13. The Chord Selection Matrix Template Image will be displayed as in FIGS. 14 and 15. A full screen view of the Element Selection Simulation is selectable or it can be viewed in Combination with the Scale Degree Timeline.

The Element Selection Simulation Image displays seven individual Columns in three rows for each Chord in their Scale Degree positions. Each Column shows it Scale Degree Roman Numeral identifier together with its unique colour coded Scale Degree identifier, as shown in FIG. 14. The Element Selection Simulation Image displays three Rows, as show in FIG. 14.

As shown in FIG. 14, when the play button, 217, is selected the Cursor will start to move across the Scale Degree Timeline. The First Chord Sector displays a specific Colour coded identifier bar positioned at the Bottom of the Sector. This data is advising that the Element corresponding with this Chord is on the first Row and first Column of FIG. 15. The Element Selection Simulation Matrix highlights this Row 1 Column 1 Element in a highlighted background, 231. To indicate to the user the duration of the Chord playing in the Scale Degree TimeLine at its starting point at 447 ms and its ending point at 3849 ms, a time down circular Image is displayed, 158

As shown in FIG. 14, the next upcoming Chord Sector in the Scale Degree Timeline displays a specific colour coded identifier bar positioned at the Top of the Sector. This data is advising that the Element corresponding with this Chord Sector is on the third Row and fifth Column. The Element Selection Simulation Matrix highlights this Element 232 with a Highlighted background, 234, to indicate to the user, in a graphic form, the time remaining to the selection of this Element, a time down circular Image is displayed within the Element As shown in FIG. 14, the next Chord Sector in the Scale Degree Timeline displays a specific colour coded identifier bar positioned at the Bottom of the Sector. This data is advising that the Element corresponding with this Chord is on the first Row and seventh Column. The Element Selection Simulation Matrix highlights this Row 1 Column 7 Element with a highlighted background, 233. As the Cursor exits a Chord Sector in the Scale Degree Timeline, the highlighted colour, for the referenced Elements will change in sequence as above. If the same Chord identifier is displayed in a Chord Sector, which has only a Single Chord Sector separation, then the Element identifier will be shown within the previously highlight Element. As each Element is highlighted, the Note and String assignments are displayed.

As shown in FIG. 17, 263, the Chord Scale Degree Timeline can be slowed down to assist the user in learning the association between the Chord Sector data and the corresponding Element position within the Element Selection Simulation Matrix.

In an example, the Scale Degree Columns may be displayed in ascending order. Many users would be more familiar with a "Circle of Fifths" Chord presentation. The user may select to view a "Circle of Fifths" layout for the Chord Selection Matrix Template on the Touch Screen Device, as shown in FIG. 13.

A Combination Key/Mode is advising that there is a predominance of Chords in a primary Key and that some high probability Chords are being Borrowed from another scale. The Key/Mode identifier will always display the primary Key Label first followed by the borrowed scale name. This Key/Mode identification naming order is important for the construction and presentation of the Chord Selection Matrix Template.

As an example, in FIG. 14, 220, the software application is advising that the detected Key for the Song is "B" Minor Melodic. The identification of a Combination Key/Mode, such as "B" Minor Melodic, is stating that the primary Key is B Minor and that there are Chords Borrowed from the "B" Melodic Scale.

For a Combination Key, the Matrix will be constructed as follows. For example, in FIG. 4A and FIG. 14 the basic Triads for "B" Minor are displayed on the Bottom Row 1 in their Scale Degree positions. The Seventh Chords of "B" Minor are displayed in the Middle Row in their Scale Degree positions The Borrowed Chords are always displayed on the Top Row In this example, the Chords of "B" Melodic which are not common to the "B" Minor scale are displayed on the Top Row in their Scale Degree positions.

In a further Embodiment of this invention, an ""Auto Play"" option is selectable. By selecting this option, the individual Chord Elements on the Touch Screen Device are automatically selected by the Software Application to mirror the Chord Sector playing in the Scale Degree Timeline similar to the technique described for the Element Selection Simulation (Auto Display). Additionally, the Chord Elements in the Chord Selection Matrix Template will be highlighted in sync with the Scale Degree Timeline playing. The user does not have to be distracted with the Element selection and just concentrated on developing and perfecting their strumming and String picking techniques. The Midi Note stream from the Chord Scale Degree Timeline is accessible to be played on any Midi supported Software or Hardware Device. The individual Midi Notes for each String can be captured, saved and be edited using most standard Midi Creation Software Applications.

An "Auto Display" option is selectable. By selecting this option, the individual Chord Elements on the Touch Screen Device are automatically highlighted by the Software Application to mirror the Chord Sector playing in the Scale Degree Timeline. The Chord Elements are highlighted in sync with the Scale Degree Timeline playing. "Auto Display" will assist in identifying and selecting the exact Element that corresponds to the data presented in each Chord Sector as the Cursor is moving across the Scale Degree Timeline. The Chord Scale Degree Timeline can be slowed down to assist in becoming familiar with the Element positioning for the various Chords in their Scale Degree positions. Users select the Elements on the Touch Screen Device as each Element is highlighted and thereafter just strums or picks the Strings as they wish.

If a Key change is detected in a Song, a flag is displayed at the Key change point on the Scale Degree Timeline. This Flag will advise the new Chord Selection Matrix Template selection.

For this Physical Stringed Instrument Embodiment, users may wish to create their own compositions. The user selects on the Instrument the Chord Selection Matrix Template that supports the range of Chords they favour for their composition. Thereafter the user selects, in any order, the Elements that corresponds to the Chords they wish to play whilst simultaneously activating the Virtual and/or the physical Strings on the Instrument in a manner that will generate the Note sounds that will represent their composition aims. The Midi Note stream from the selection of the Elements and from the activation of the Strings is accessible to be played on any Midi supported Software or Hardware Device. The individual Midi Notes from the Creation stream can be captured, saved and be edited using most standard Midi Creation Software Applications.

Figure 34:
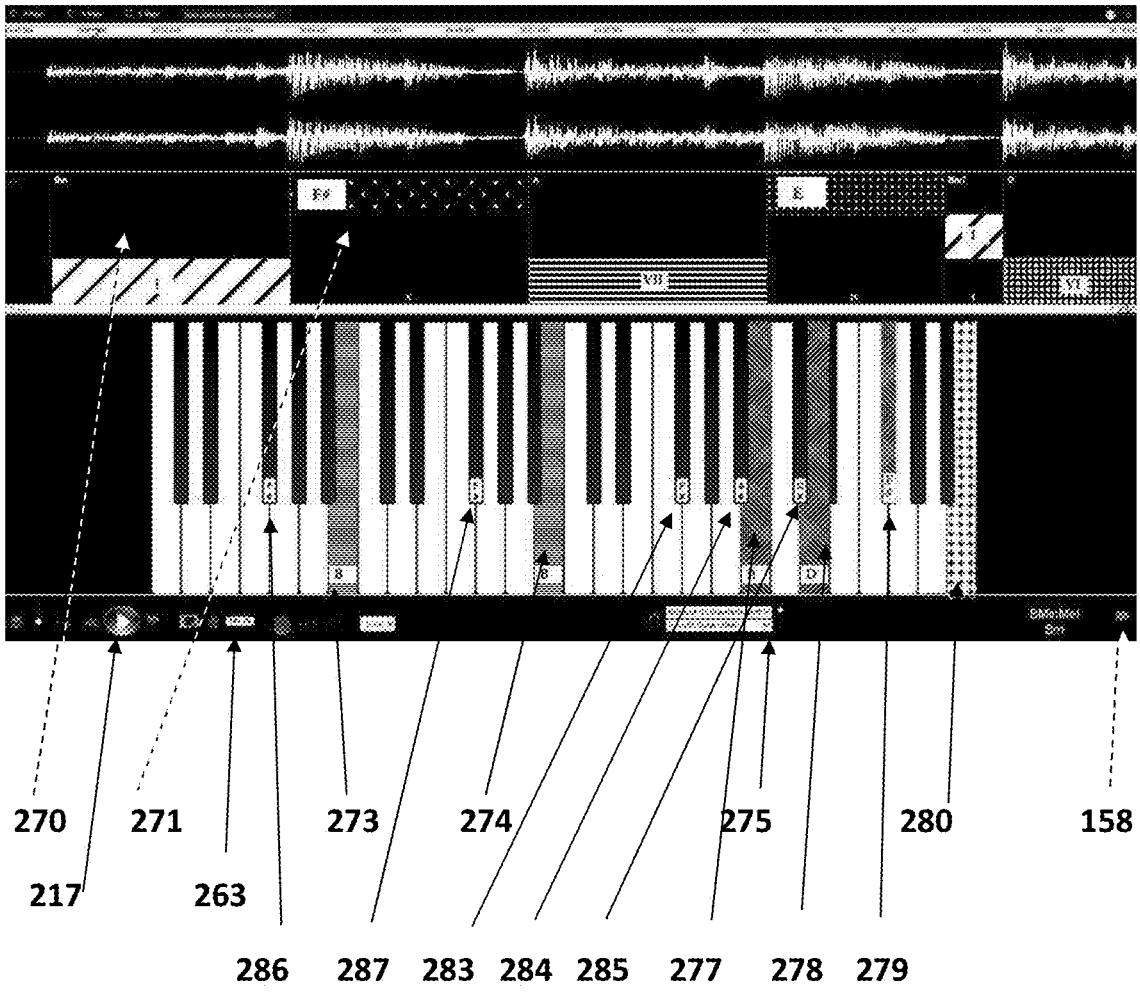
FIG. 34. Embodiment with Keyboard for Play along with selected Song.

FIG. 34 shows an example of a software application that may be provided to assist with learning to quickly play any selected Song employing a Virtual Keyboard Instrument Embodiment and a Means is provided to identify and play, with the Right Hand, the individual Notes of each Chord of the selected Song quickly and easily whilst simultaneously identifying the Root Note of the selected Chords across two lower Octaves for Left Hand playing. It is generally accepted that when playing Keyboard Instruments, the Right Hand most commonly plays the Chords of a selected Key whilst the Left Hand most commonly plays only the Root Note of the Chord across one or two lower Octaves. As advised in the earlier Embodiment, for the selected Song "Hotel California", a Key/Mode of "B" Minor Melodic was advised and a Chord File was produced as described in FIG. 31. Using the data from FIG. 31, a Scale Degree Timeline was developed. The structure, design and details of the Scale Degree Timeline were disclosed earlier.

Figure 41:
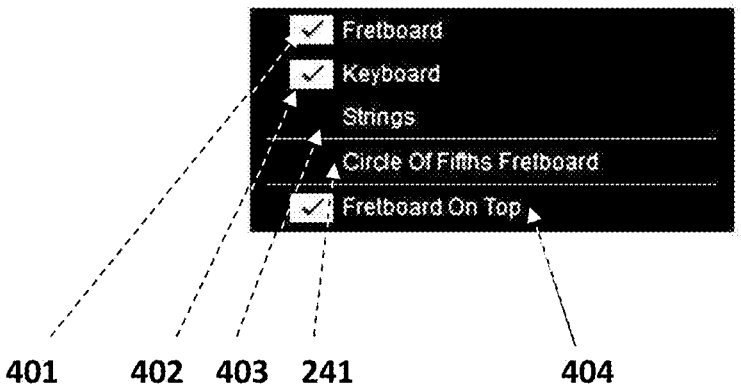
FIG. 41. Select Embodiment layout.
Figure 42:
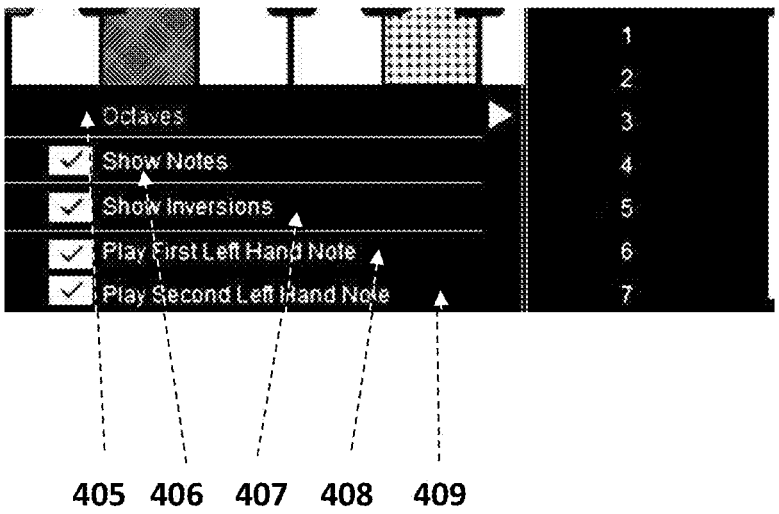
FIG. 42. Keyboard Embodiment Layout options.
Figure 43:
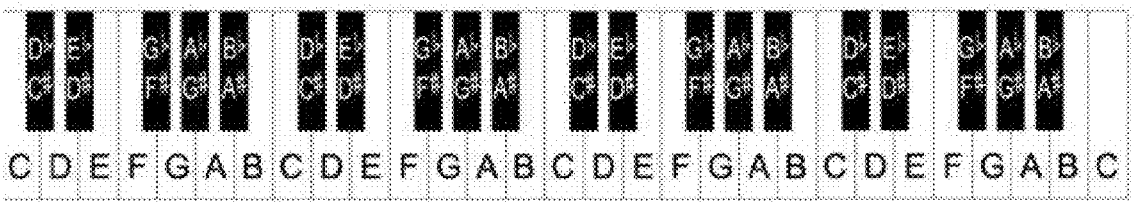
FIG. 43. Musical Note layout for a standard Keyboard Embodiment.

As shown in FIG. 41, from the dropdown menu select the option Keyboard 402. FIG. 34 shows a Touchscreen Device displaying a Scale Degree Timeline for the selected Song together with a Virtual Keyboard Instrument image. The individual Virtual Keys of the Virtual Keyboard Instrument, presented on the Touchscreen, are the Activation Control Members for this Embodiment. As shown in FIG. 42, the Virtual Keyboard can be configured to display a range of Octaves, display Notes, display Inversions, play Left Hand Notes.

The Scale Degree Timeline in FIG. 34 is constructed using the data outlined in FIG. 31 which shows the First Chord as being "Bm". When the Play button is activated the Cursor will move into the First Chord Sector identified as "Bm. The Software Application running in the Touchscreen Device will automatically highlight the individual Note positions of the advised Chord, "Bm" on the associated Virtual Keys on the Virtual Keyboard as advised in the Chord Assignment File. The Virtual Keyboard Note layout corresponds to the layout shown in FIG. 43.

The Notes assigned to the "Bm" Chord for the Right Hand, in this Embodiment are as follows: Note "B" in the position as shown in 277, Note "D" as shown in 278, and Note "F #" as shown in 279. When the Highlighted Virtual Keys on the Touchscreen are selected, the Notes associated with each Virtual Key will be played by the Software Application in response to the activation of the Virtual Key Control Member. The volume of the output sound, for each selected Key, can be varied from high to low by selecting the activation point within the Virtual Key boundary from Bottom to the Top of the image. Vibrato can be applied to a Note by moving the finger along the Virtual Key in a horizontally motion.

To add some variation to Musical Creation and to minimise the requirement to make significant movement of the Right Hand between Chord selections, Chord Inversions are used extensively in Keyboard playing. In this Embodiment the Software Application shows the First Inversion where the Root Note is shown in a different colour a full Octave above the Root Note in 280. The Second Inversion for Chord "A" is "C #", FIG. 37, 307. The Second Chord outlined in FIG. 31 is "F #" and shown in the Scale Degree Timeline, 271. When the Play button is activated, 217, the cursor will move into the First Chord Sector identified as "Bm", 270. The Software Application running in the Touchscreen Device will automatically highlight, in a subliminal fashion, the individual Note positions of the next advised Chord, which for the selected Song is "F #", 271. The Virtual Keyboard Note layout corresponds to the layout shown in FIG. 43. The Notes assigned to the "F #" Chord in this Embodiment are as follows: Note "F #" in the position as shown in 283, Note "A #" at 284 and Note "C #" at 285. When the Cursor moves into the "F #" Chord Sector the subliminal colours will change to the activation highlighted colours and the Notes of the upcoming Chord "A" will be displayed in the subliminal colour in their Note assignment positions.

For the Left Hand, when the Cursor is in the Chord Sector for "Bm" the application software running in the controlling Device will Highlight, the Root Note "B" across 2 lower Octaves, FIG. 34 at 273 and 274. When the Highlighted Virtual Keys, for the Left Hand are selected, the Notes associated with each Virtual Key will be played by the Software Application in response to the activation of the Virtual Key Control Member. The volume of the output sound, for each selected Key, can be varied from high to low by selecting the activation point within the Virtual Key boundary from Bottom to the Top of the image. Vibrato can be applied to a Note by moving the finger along the Virtual Key in a horizontally motion. The Root Notes for the upcoming Chord "F #" will be highlighted, subliminally, across two lower Octaves on the Virtual Keyboard, FIG. 34 at 286 and 287.

A time down indicator is provided, FIG. 34 at 158 to advise when the next Chord change will occur. The Scale Degree Timeline can be slowed down to assist the user in learning the Chord progressions, Chord Note associations, Chord Inversions and Note positions on a Keyboard. As an option, the Software can automatically play the sounds of each Note assigned to each Chord in the Scale Degree Timeline as the Cursor enter each Sector. The Midi Note stream from the triggering of the Control Members is accessible to be played on any Midi supported Software or Hardware Device. The Midi stream information can be captured, saved and be edited using most Midi Creation Software Applications. As an alternative to the availability of Touch screen selection, the Chord Triad Notes and their Sevenths could be assigned to the Numeric Keys 1-4. The First and Second Inversions to Numeric Keys 5 and 6 with the Left Hand Lowest Octave to Numeric Key 7 and the Higher Octave Note to Numeric Key 8.

Figure 37:
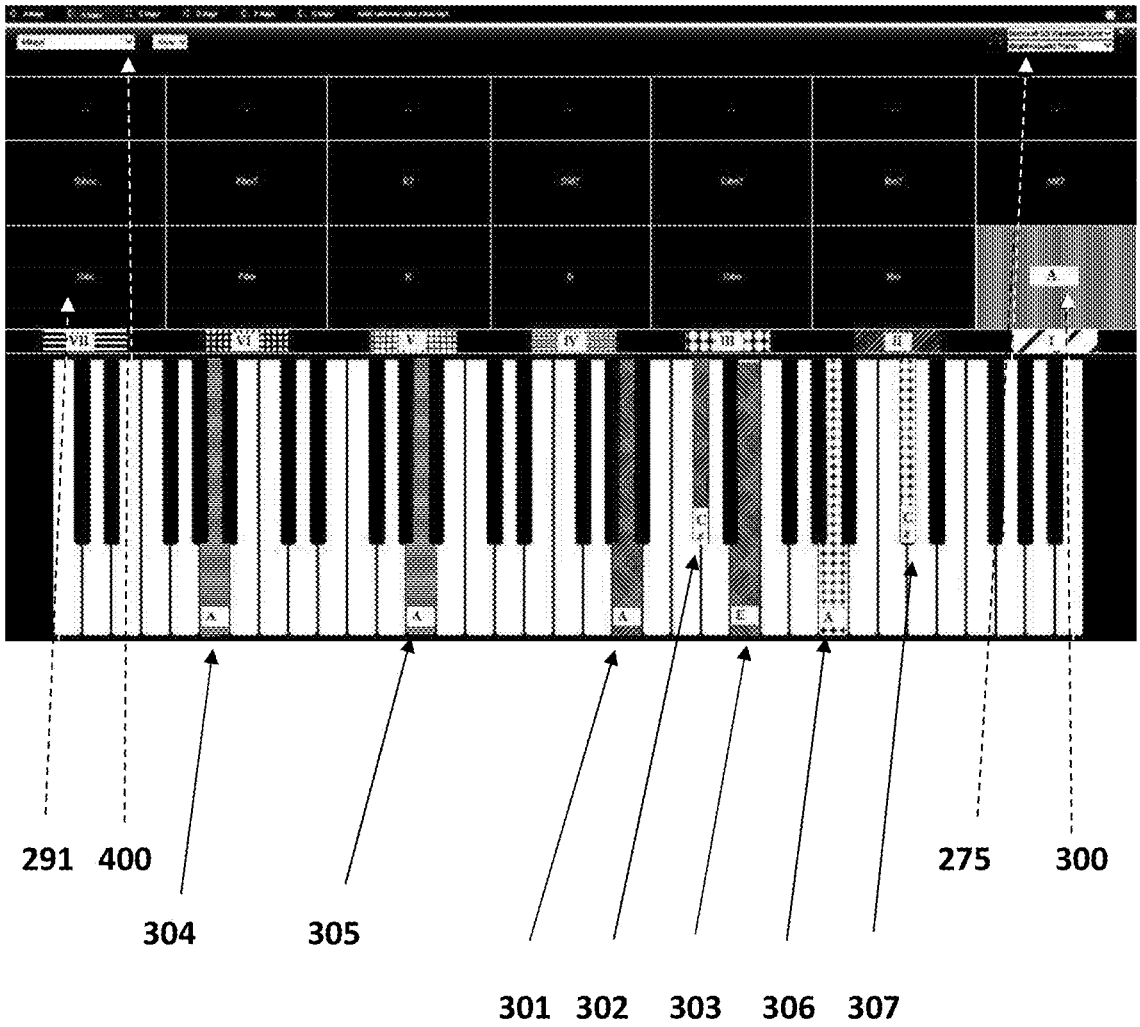
FIG. 37. Create Original Musical content with Keyboard Embodiment.

FIG. 37 shows an example of the present invention to assist users with learning to quickly author original Creations, in any musical Key, employing a Virtual Keyboard Instrument and a Means is provided to identify and play, with the Right Hand, the individual Notes of any Chord within the selected Key, quickly and easily whilst simultaneously identifying, for the Left Hand, the Root Note of the selected Chords across two lower Octaves. It is generally accepted, that when playing Keyboard Instruments that the Right Hand most commonly plays the individual Chords whilst the Left Hand most commonly plays only the Root Note of the Chord across one or two lower Octaves.

From the options presented in FIG. 41, select the Touchscreen layout configuration that is desired for the Creation process on the preferred Instrument Embodiment. Here we select 402. The Virtual Keyboard can be configured to display a range of Octaves, display Notes, display Inversions, and play Left Hand Notes.

For every Musical Key/Mode or Combination Key/Mode, an associated Chord Selection Matrix Template has been developed, where each Chord Represented as an Element of the Matrix Template has a Chord Assignment File associated with that Element, The Chord Assignment File contains the Note assignment names, the Notes assigned to the individual Activation Control Member for different Embodiments and the MIDI Note identifier number for each Note assigned to an Activation Control Member. The Chord Assignment File is editable by the user. When the user selects an Element, the Software Application will assign the Note name and MIDI Number from the associated Chord Assignment File to the individual Activation Control Members in the exact order that they are defined in the Chord Assignment File. When the user activates any of the Activation Control Members associated with a selected Element, the audio sounds of the individual Notes assigned to each Activation Control Member will be played.

In this embodiment, for a touchscreen device, the selection will be Keyboard, 402, together with a Chord Selection Matrix Template (Fretboard) 401, as shown in FIG. 41. Select the desired Key/Mode or Combination Key that is favoured for the Musical Creation from a menu of options as example the Keys/Modes options for the Key "A", FIG. 40, 401. In this Embodiment as an example only the Key of "A" Major is selected shown as 400.

For a Single Key Song, the Matrix Templates will display the basic Triad Chord of the selected Key on the Bottom Row. In this example, FIG. 37, the basic Triads for the Key of "A" Major are displayed on Row 1 in their Scale Degree positions. The Seventh Chords of the Key of "A" Major are displayed in the Middle Row of the Matrix. For a Single Key Song, the Top Row remains blank but could contain any other advanced Chords in their Scale Degree positions.

A Combination Key/Mode is advising that there is a predominance of Chords in a primary Key and that many high probability Chords are being borrowed from another scale. The Key/Mode identifier will always display the primary Key Label First followed by the borrowed scale name. This Key/Mode identification naming order is important for the construction and presentation of the Chord Selection Matrix Template.

As an example, FIG. 14, is advising that the detected Key for the Song is "B" Minor Melodic. The identification of a Combination Key/Mode, such as "B" Minor Melodic, is stating that the primary Key is "B" Minor and that there are Chords Borrowed from the "B" Melodic Scale.

For a Combination Key, the Matrix will be constructed as follows. For example, In FIG. 4A and FIG. 14 the basic Triads for "B" Minor are displayed on the first Row 1 in their Scale Degree positions. The seventh Chords of "B" Minor are displayed in the Middle Row in their Scale Degree positions, FIG. 14. The Borrowed Chords may be displayed on the Top Row, FIG. 14. In this example, the Chords of "B" Melodic which are not common to the "B" Minor scale are displayed on the Top Row in their Scale Degree positions.

In FIG. 37, when the Tonic Chord, in the Scale Degree position indicated with the Roman Numeral I" and identified with a unique colour code is selected shown as 300, the Software Application running in the Touchscreen Device will automatically highlight the individual Note positions of the advised Chord, "A" on the associated Virtual Keys on the Virtual Keyboard as advised in the Chord Assignment File. The Virtual Keyboard Note layout corresponds to the layout shown in FIG. 43. The Notes assigned to the "A" Chord in this Embodiment for the Right Hand are as follows: Note "A" in the position as shown in 301, Note "C #" as shown as 302 and Note "E" as shown in 303. When the Highlighted Virtual Keys on the Touchscreen are selected, the Notes associated with each Virtual Key will be played by the Software Application in response to the activation of the Virtual Key Control Member. The volume of the output sound, for each selected Key, can be varied from high to low by selecting the activation point within the Virtual Key boundary from Bottom to the Top of the image. Vibrato can be applied to a Note by moving the finger along the Virtual Key in a horizontally motion.

To add some variation to Musical Creation and to minimise the requirement to make significant movement of the hand between Chord selections, Chord Inversions are used extensively in Keyboard playing. In this Embodiment the Software Application shows the First Inversion where the Root Note "A" is shown in a different colour a full Octave above the Root Note "A", as shown in FIG. 37, 306. The Second Inversion Note is displayed as "C #", FIG. 37, 307. The Root Notes of the selected Chord "A", for the Left Hand, are shown in a specific colour across two lower Octaves, FIGS. 37, 304 and 305.

Whenever an Element within the Chord Selection Matrix is selected the Notes of the Chord associated with that Element will be highlighted on the Virtual Keys on the Touchscreen Device as defined in the Chord Assignment File. As an option, the software can automatically play the sounds of the Notes assigned to each Element once the Element has been selected. The Midi Note stream from the triggering of the individual Key Control Members or from the individual Chord Element selection is accessible to be played on any Midi supported Software or Hardware Device. The Midi stream information can be captured, saved and be edited using most Midi Creation Software Applications.

As an alternative to the availability of Touch screen selection, The Chord Elements can be selectable by the assignment of each Element to a specific Key on the Keyboard, i.e. the Bottom Row assigned to the Keys Z-M, the Middle Row A-J. with the Top Row assigned to the Keys Q-U. The Triad Notes and their Sevenths could be assigned to the Numeric Keys 1-4. The First and Second Inversions to Numeric Keys 5 and 6 with the Left Hand Lowest Octave to Numeric Key 7 and the Higher Octave Note to Numeric Key 8

Figure 35:
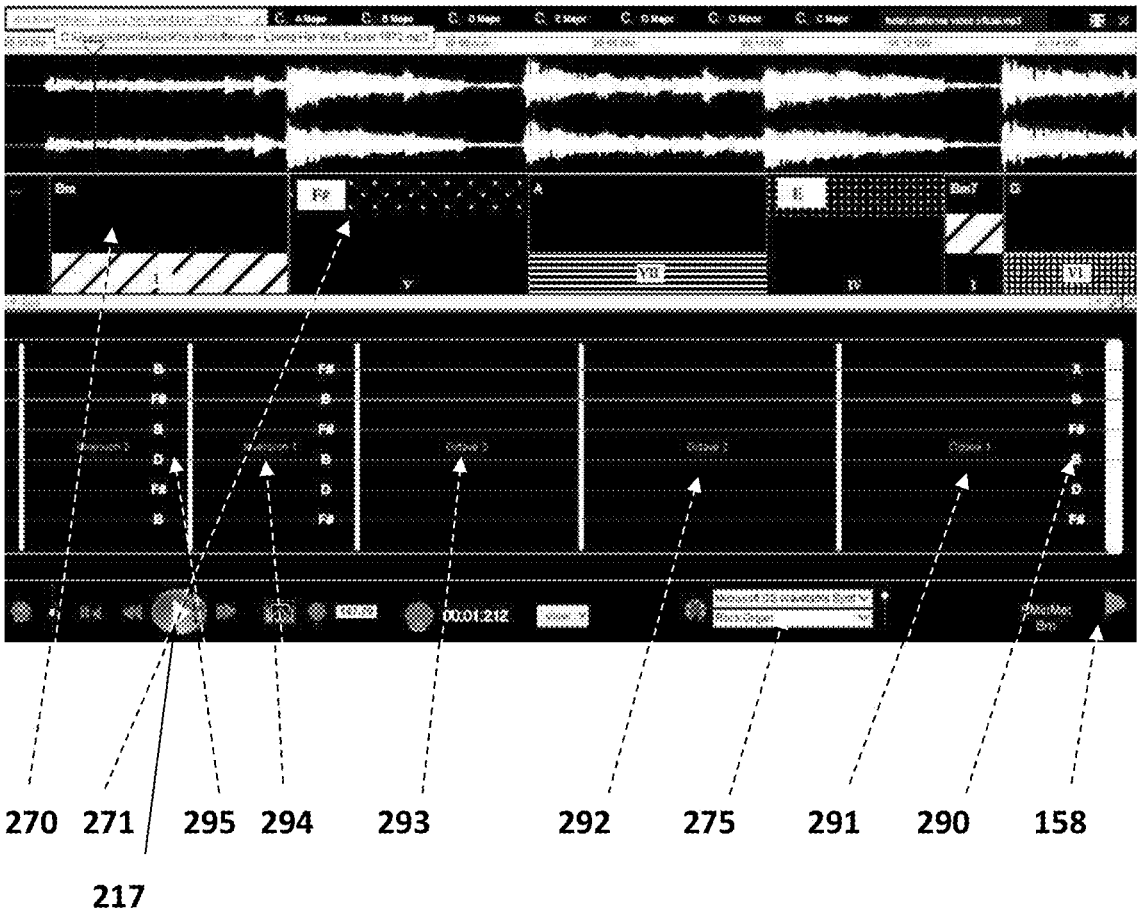
FIG. 35. Embodiment with Strings for Play along with selected Song.

In FIG. 35, a further example of the present invention is presented that may assist users in learning to quickly play the Chords of any selected Song employing a Virtual Stringed Instrument and a Means is provided to play the individual Notes of the Chord of the selected Song quickly and easily. This example can be activated by selecting the string option, 403, as shown in FIG. 41. FIG. 35 shows a Touchscreen Device displaying a Scale Degree Timeline for the selected Song together with a Virtual Stringed Instrument image displaying 6 Virtual Strings and 5 individual Fret positions. The First Fret position, on the Right FIG. 35, 291, will display the Chord Notes in their Lowest Octave position. FIG. 35, 292 will display the Chord Notes on their String positions one Octave up. FIG. 35, 293 will display the Notes on their String positions two Octaves up. Overall three Octave positions are accommodated in this Embodiment. Fret position Four, 294 and Fret position 5, 295 is assigned First and Second Chord Inversion alternative fingering for the advised Chord. When the Virtual Strings are activated within any of the 5 Fret positions the Software Application running in the Touchscreen Device will play the Notes assigned to the Strings in that Fret position. The Virtual Strings presented on the Touchscreen are the Activation Control Members for this Embodiment. As advised in the earlier Embodiment, for the selected Song "Hotel California", a Key/Mode of B Minor Melodic was advised and a Chord File was produced as described in FIG. 31. Using the data in FIG. 31, a Chord Scale Degree Timeline was developed. The structure, design and detail of the Scale Degree Timeline for the selected Song is disclosed earlier. The Scale Degree Timeline in FIG. 35 is constructed using the data outlined in FIG. 31 which shows the First Chord as being Bm, (FIG. 35, 270). When the Play button is activated, 217, the Cursor will move into the First Chord Sector identified as "Bm. The Software Application running in the Touchscreen Device will automatically assign the individual Note of the advised Chord, "Bm" to the associated Virtual Strings on the Virtual Fretboard as advised in the "Bm" Chord Assignment File. The Virtual Fretboard Note layout corresponds to the layout advised in the Chord Assignment File. The Notes assigned to the "Bm" Chord to the individual Virtual Strings in this Embodiment are as displayed in FIG.

35, 290 and are as follows: Note "X" which advises that there is no Note assigned to the Top String position, Note "B" in the Second String position, Note "F #" in the third String position, Note "B" in the fourth String position, Note "D" in the fifth String position and Note "F #" in the Bottom String position. When the Virtual Strings on the Touchscreen are activated, the Notes associated with each Virtual String will be played by the Software Application in response to the activation detected for the Virtual String Control Member. The volume of the output sound, for each selected String, can be varied from high to low by selecting the activation point within each individual Virtual String Fret boundary, from Left to right of the image. Vibrato can be applied to a Note by selecting and holding a Virtual String and thereafter moving the finger in a vertical motion.

To add some variation and colour to the playing of Stringed Musical Instruments, Chord Inversions are used extensively. With Fretted Stringed Instruments there can be many fingerings options offered for each Chord. In this Embodiment the Software displays and assigns the Notes of a First and Second Inversion of the advised Chords to Fret position Four and Five, as shown in FIG. 35 as 294 and 295 of the Virtual Fretboard. The Chord Assignment File contains the Chord Inversions assignment details and is editable.

When a String is held down with two fingers in any of the First three Fret column positions and thereafter the two fingers are dragged along the Virtual String into one or more of the Fret Columns, the scale Notes of the selected Key will be played, sequentially, starting from the Note assigned to that String up to the point where the dragging stops, whereas, the velocity of the Note playing will correspond to the speed of the horizontal finger movement along the selected String, either up or down, one or more Octaves. As an option, the Software can automatically play the sounds of each Note assigned to the Chord in the Scale Degree Timeline as the Cursor enter each Sector. The Midi Note stream from the triggering of the Control Members is accessible to be played on any Midi supported Software or Hardware Device. The Midi stream information can be captured, saved and be edited using most standard Midi Creation Software Applications.

A time down indicator is provided, 158, to advise when the next Chord change will occur. The Chord Scale Degree Timeline can be slowed down (FIG. 17, 263) to assist the user in learning the Note/String associations and Note/Chord associations.

As an alternative to the availability of Touch screen selection, the individual Strings can be selectable by the assignment of each String in its Octave and Inversions Position to specific Key on a Keyboard, i.e. the First Octave Strings from the Top to Bottom are assigned to the Keys Z-N, the Second Octave to the Keys A-H with the Third Octave assigned to the Keys Q-Y. The First Inversion assigned to the Numeric Keys 1-6 with the Second Inversion assigned to the Keys 7,8,9,0.

Figure 38:
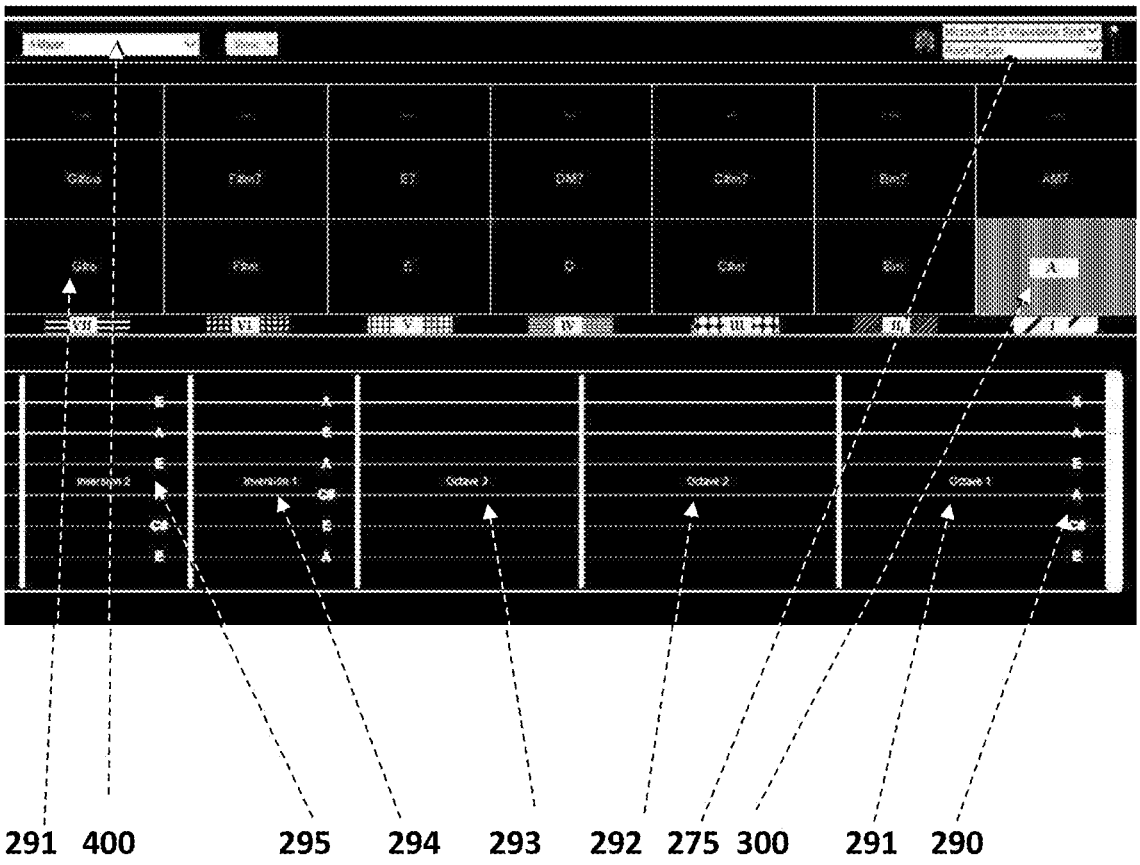
FIG. 38. Create Original Musical content with Strings Embodiment.

FIG. 38 shows a further example of the present invention to assist users with learning to quickly author original creations employing a Virtual Stringed Instrument Embodiment and a means is provided to play the Chord Notes of the selected Chords quickly and easily on the Virtual Stringed Instrument. By selecting from the dropdown menu the option Strings, as shown in FIG. 41, 403. A Virtual Stringed Instrument will be presented showing a Stringed Instrument Fretboard displaying six Virtual Strings and five individual Fret positions together with a Chord Selection Matrix Template image.

For each and every Musical Key/Mode or Combination Key/Mode that is selectable, an associated Chord Selection Matrix Template has been developed, where each Chord Represented as an Element of the Matrix Template has a Chord Assignment File associated with that Element, The Chord Assignment File contains the Note assignment names, the Notes assigned to the individual Activation Control Member for different Embodiments and the MIDI Note identifier number for each Note assigned to an Activation Control Member. The Chord Assignment File is editable by the user. When the user selects an Element, the Software Application will assign the Note name and MIDI Number from the associated Chord Assignment File to the individual Virtual Strings in the exact order that they are defined in the Chord Assignment File for that Embodiment.

When the user activates any of the Virtual Strings on the Touchscreen, the audio sounds of the individual Notes assigned to each of the Virtual Strings will be played in response to the Virtual String activations.

As shown in FIG. 38, the First Fret position on the Touchscreen shown as 291, will display the Note identifiers adjacent to their assigned Virtual String in their Lowest Octave settings. FIG. 38, 292, displays the Notes on their String positions one Octave raised. FIG. 38, 293, displays the Notes on their String positions two Octaves raised. Overall three Octave positions are accommodated in this example. In Fret position 4 shown as 294 and Fret position 5, shown as 295, is displayed the Note assignments for a First and Second Chord Inversion alternative for the selected Chord. When the Virtual Strings are activated within any of the 5 Fret positions, the Software Application running in the Touchscreen Device will play the Notes which are assigned to the individual Strings. The Virtual Strings presented on the touchscreen are the Activation Control Members for this Embodiment.

Figure 40:
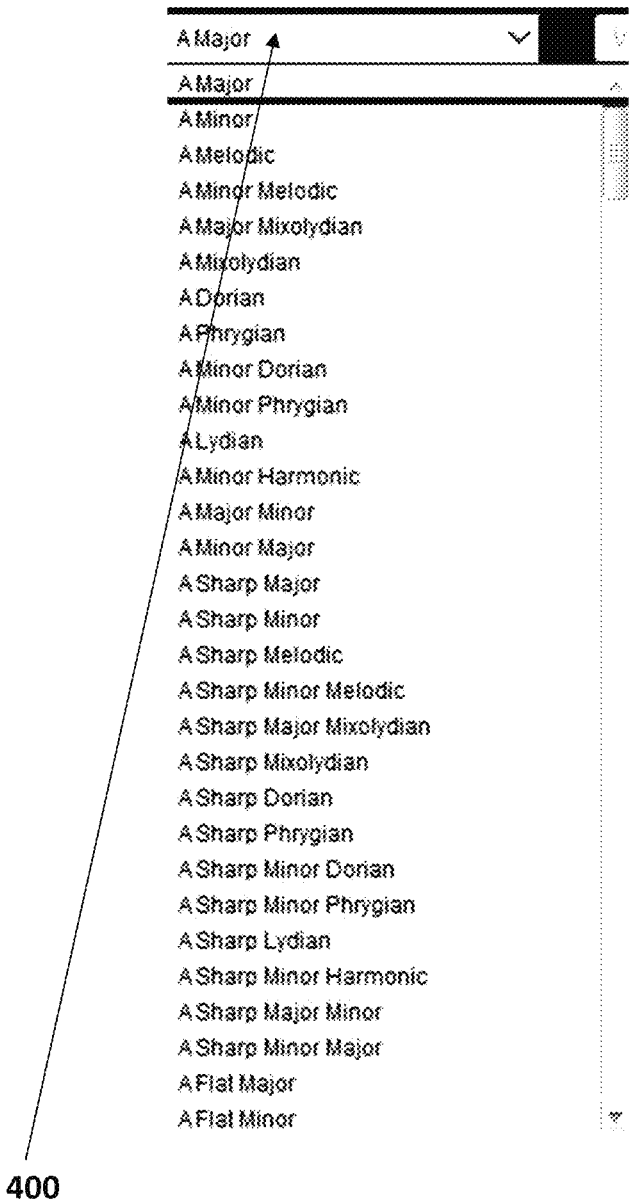
FIG. 40. Key/Mode Selection in creative mode showing Key of "A" Key/Modes

In this Embodiment, for a Touchscreen Device, the selection will be Strings (FIG. 41 403) together with Chord Selection Matrix Template (Fretboard) FIG. 41, 401. Select the desired Key/Mode or Combination Key that is favoured for the Musical Creation. In this Embodiment, as an example only, the Key of "A" Major is selected (FIG. 38. 400) from a menu of Key "A" options (FIG. 40. 400). For a Single Key Song, the Matrix Templates will display the basic Triad Chord of the selected Key on the Bottom Row. In this example, FIG. 38, the basic Triads for the Key of "A" Major are displayed on Row 1 in their Scale Degree positions. The Seventh Chords for the Key of "A" Major are displayed in the Middle Row of the Matrix. For a Single Key Song, the Top Row remains blank but could contain any other advanced Chords in their Scale Degree positions.

A Combination Key/Mode is advising that there is a predominance of Chords in a primary Key and that some high probability Chords are being Borrowed from another scale. The Key/Mode identifier will always display the primary Key Label First followed by the borrowed scale name. This Key/Mode identification naming order is important for the construction and presentation of the Chord Selection Matrix Template. As an example, FIG. 14, 220, is advising a Key of "B" Minor Melodic. The identification of a Combination Key/Mode, such as "B" Minor Melodic, is stating that the primary Key is B Minor and that there are Chords Borrowed from the "B" Melodic Scale. For a Combination Key, the Matrix will be constructed as follows. For example, In FIG. 4A and FIG. 14 the basic Triads for "B" Minor are displayed on Row 1 in their Scale Degree positions (106).

The Seventh Chords of "B" Minor are displayed in the Middle Row in their Scale Degree positions (FIG. 14, 106). The Borrowed Chords are always displayed on the Top Row. In this example, the Chords of "B" Melodic which are not common to the "B" Minor scale are displayed on the Top Row in their Scale Degree positions.

In this Embodiment, FIG. 38, when the Tonic Chord, in the Scale Degree position indicated with the Roman Numeral "I" and with a unique colour code identifier is selected (FIG. 38, 300), the Software Application running in the Touchscreen Device will automatically display and assign the individual Note of the "A" Chord to the associated Virtual Strings as advised in the Chord Assignment File to all the 5 Fret positions. The Notes assigned to the "A" Chord in this Embodiment are shown with their name identifiers and their String assignment positions in FIG. 38, 290, in the Lowest Octave position. FIG. 38, 292, shows the Fret area where the "A" Chord Notes are assigned raised by one Octave. FIG. 38, 293, shows the Fret area where the "A" Chord Notes have been raised by two Octaves. FIGS. 38, 294 and 295, shows the Fret area where First and Second Chord Inversion Notes are assigned and displayed.

When an Element in the Matrix is selected, the Software Application running in the Touchscreen Device will display and assign the Notes associated with that Chord Element to the individual Virtual Strings across the 5 Fret positions, so that, when any Virtual String is activated, the Software Application will play the audio sounds in response to the activation of the Virtual String Control Member. The volume of the output sound, for each selected String, can be varied from high to low by selecting the activation point within each individual Virtual String Fret boundary, from Left to right of the image. Vibrato can be applied to a Note by selecting and holding a Virtual String and thereafter moving the finger in a vertical motion.

To add some variation and colour to the playing of Stringed Musical Instruments, Chord Inversions are used extensively. With Fretted Stringed Instruments there can be many fingerings options offered for each Chord. In this Embodiment the Software displays and assigns the Notes of a First and Second Inversion of the advised Chords to Fret position 4 and 5 (FIGS. 35, 294 and 295) of the Virtual String Instrument. The Chord Assignment File contains the Chord Inversions assignment details and is editable.

When a String is held down with two fingers in any of the First three Fret column positions and thereafter the two fingers are dragged along the Virtual String into one or more of the Fret Columns, the scale Notes of the selected Key will be played, sequentially, starting from the Note assigned to that String up to the point where the dragging stops, whereas, the velocity of the Note playing will correspond to the speed of the horizontal finger movement along the selected String, either up or down, one or more Octaves. As an option, the software can automatically play the sounds of the Notes assigned to each Element once the Element has been selected. The Midi Note stream from the triggering of the individual String Control Members or from the individual Chord Element selection is accessible to be played on any Midi supported Software or Hardware Device. The Midi stream information can be captured, saved and be edited using most Midi Creation Software Applications.

As an alternative to the availability of Touch screen selection, the individual Strings can be selectable by the assignment of each String in its Octave and Inversions Position to specific Key on the Keyboard, i.e. the First Octave Strings from the Top to Bottom can be assigned to the Keys Z-N, the Second Octave to Keys A-H with the Third Octave assigned to the Keys Q-Y. The First Inversion assigned to Numeric Keys 1-6 with the Second Inversion assigned to the Keys 7,8,9,0 –,=.

Figure 36:
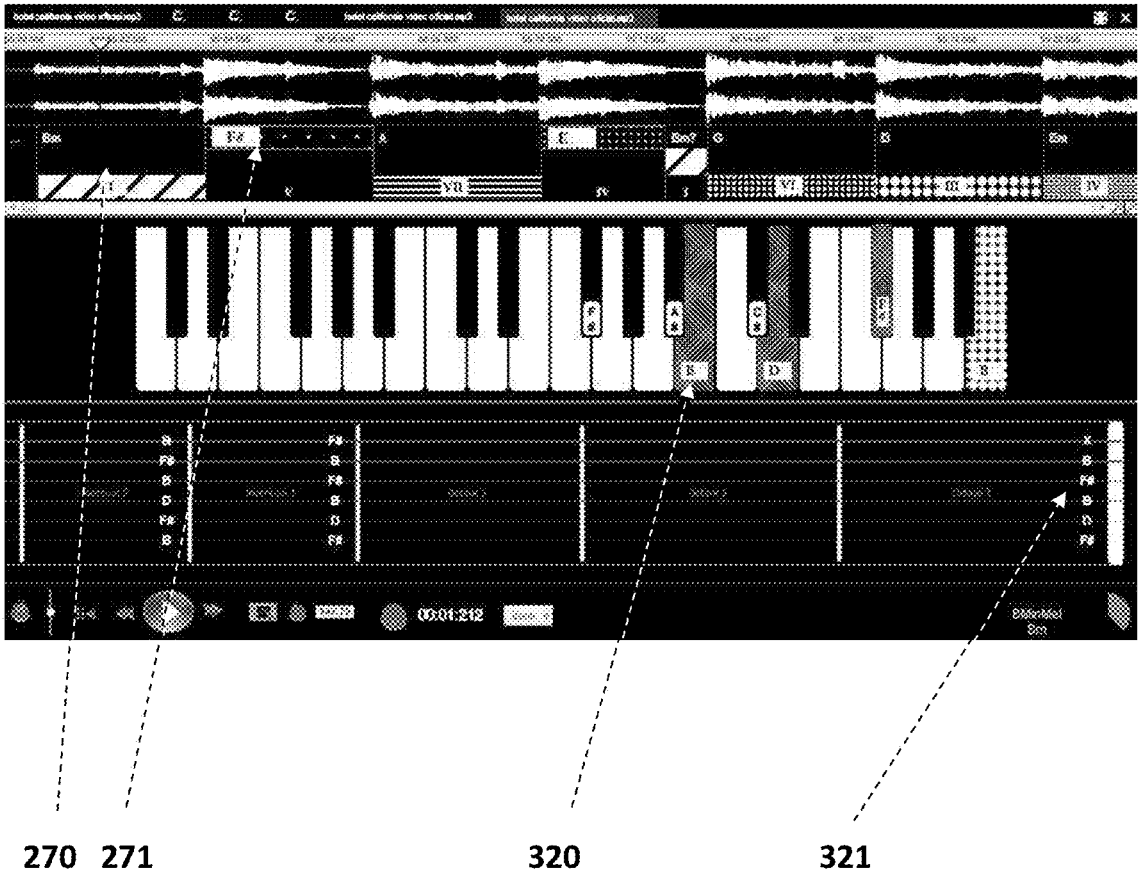
FIG. 36. Embodiment with Keyboard and Strings for Play along with selected Song.

In FIG. 36, a means is provided to assist in learning to quickly play along with any selected Song employing a Combination of both a Virtual Stringed Instrument Embodiment and a Virtual Keyboard Embodiment and where a Means is provided to play the Chord Notes of the selected Song quickly and easily.

FIG. 36 shows a Chord Scale Degree Timeline for the selected Song, a Virtual Keyboard (FIG. 36, 320) and a Virtual Stringed Instrument (FIG. 36, 321) showing 6 Strings and 5 Fret positions. The Embodiment in FIG. 36 is a Combination of the Embodiments as outlined for FIG. 34 and FIG. 35 and performs in a similar manner as the separated Virtual Instrument Embodiments as described for FIG. 34 and FIG. 35.

Figure 39:
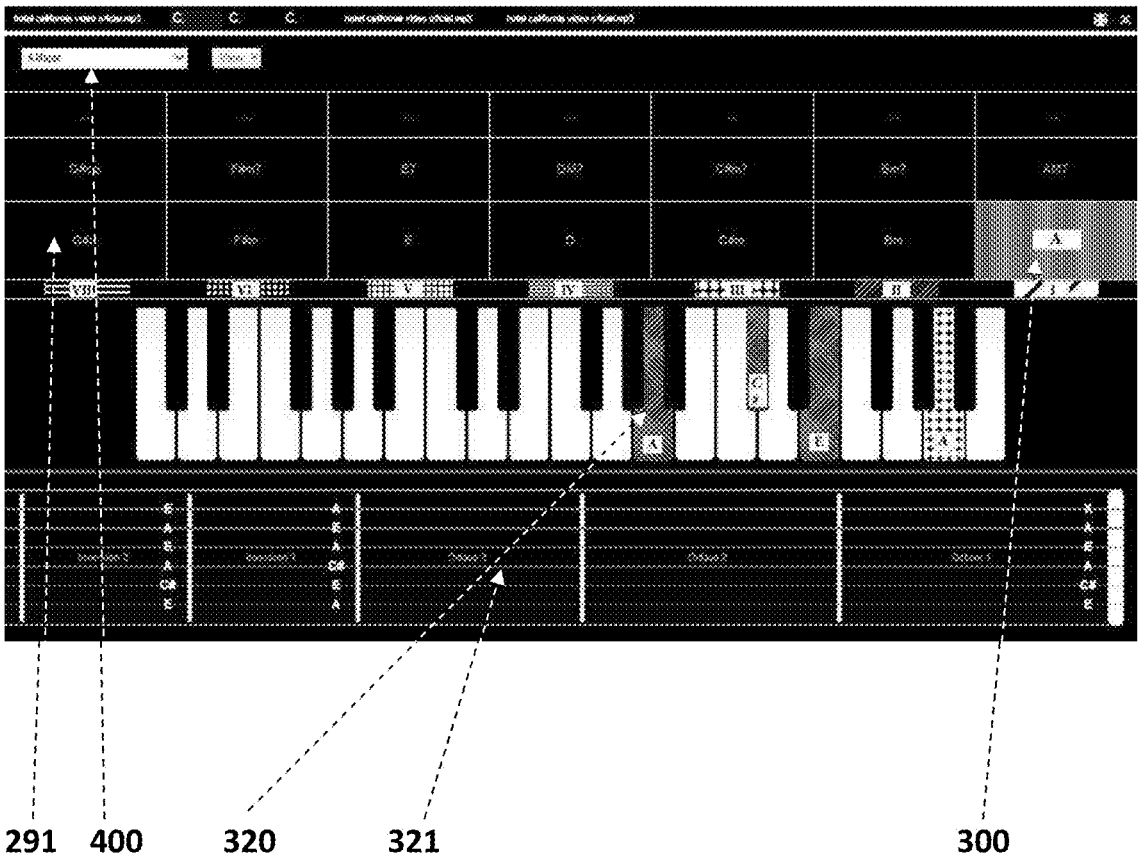
FIG. 39. Create Original Musical content with Keyboard and Strings Embodiment.

In a Further Embodiment, FIG. 39), a means is provided to assist with learning to quickly author original Creations employing a Combination of both a Virtual Stringed Instrument Embodiment and a Virtual Keyboard Embodiment and where a Means is provided to play the Chord Notes of the selected Chords quickly and easily.

FIG. 39 shows a Chord Selection Matrix Template (FIG. 39, 291), together with a Virtual Keyboard (FIG. 39,320) and a Virtual Stringed Instrument (FIG. 39, 321) showing 6 Strings and 5 Fret positions. The Embodiment in FIG. 39 is a Combination of the Embodiments as outlined for FIG. 37 and FIG. 38 and performs in a similar manner as the separated Virtual Instrument Embodiments as described for FIG. 37 and FIG. 38.

Figure 44:
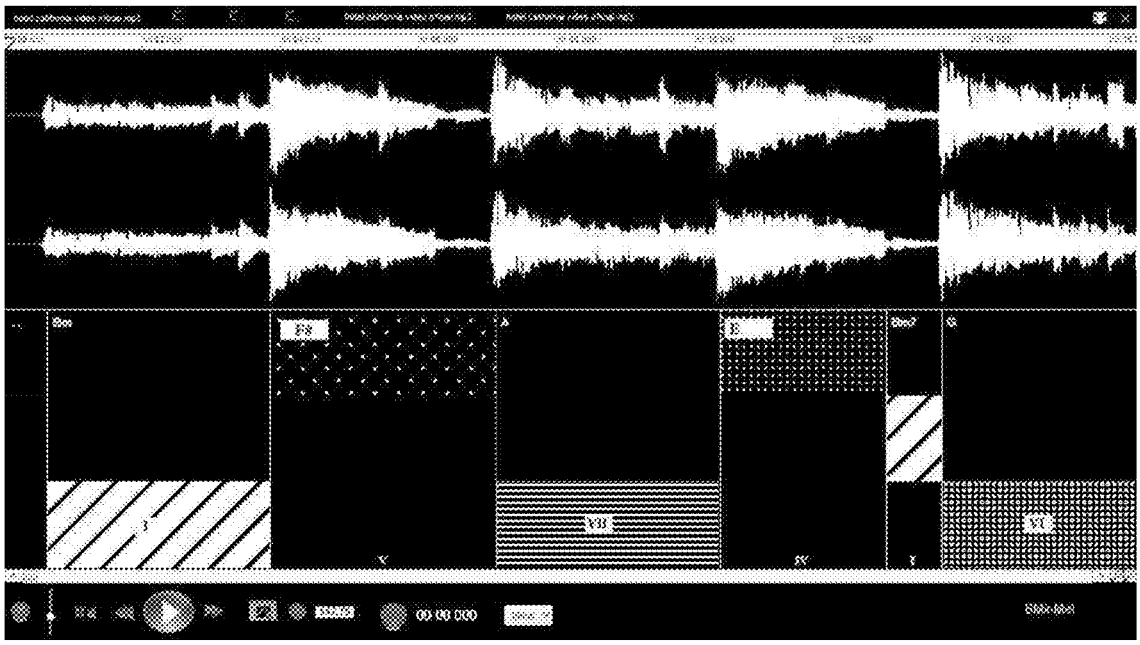
FIG. 44. Displays Chord Scale Degree Timeline for any selected Song.

In a Further Embodiment, FIG. 44, a Waveform and a Chord Scale Degree Timeline only are presented for a selected Song. The Chord Scale Degree Timeline displays each Chord in a separate time related Sector along the Scale Degree Timeline. Each Chord Sector displays the Chord name, its Scale Degree position as a Roman numeral identifier with a unique Scale Degree colour coded position identifier. In this Embodiment (FIG. 44) the Software Application running on a controlling Device will analyse the Chords of any Song in the user's library and from this further Analysis a Single Key/Mode or a Key/Mode Combination is calculated, where all the Chords notified in the Chord File will fit and conform with the Key scale of the Key/Mode or to the Key/Mode Combination that is advised (the process involved in the Chord Analysis exercise as advanced earlier). One of the objective of the Chord Analysis exercise is to identify and establish a Musical Key and thereafter to generate a Chord File for the selected Song, where all the notified Chords will have a Scale Degree position within the Musical Key/Mode or the Combination Key/Mode that is advised. Using the data provided by the Musical Key/Mode identification, together with the Chord File Data (FIG. 31), a Chord Scale Degree Timeline is developed for the selected Song which will assist in identifying very accurately the individual Chords for any selected Song.

Figure 45:
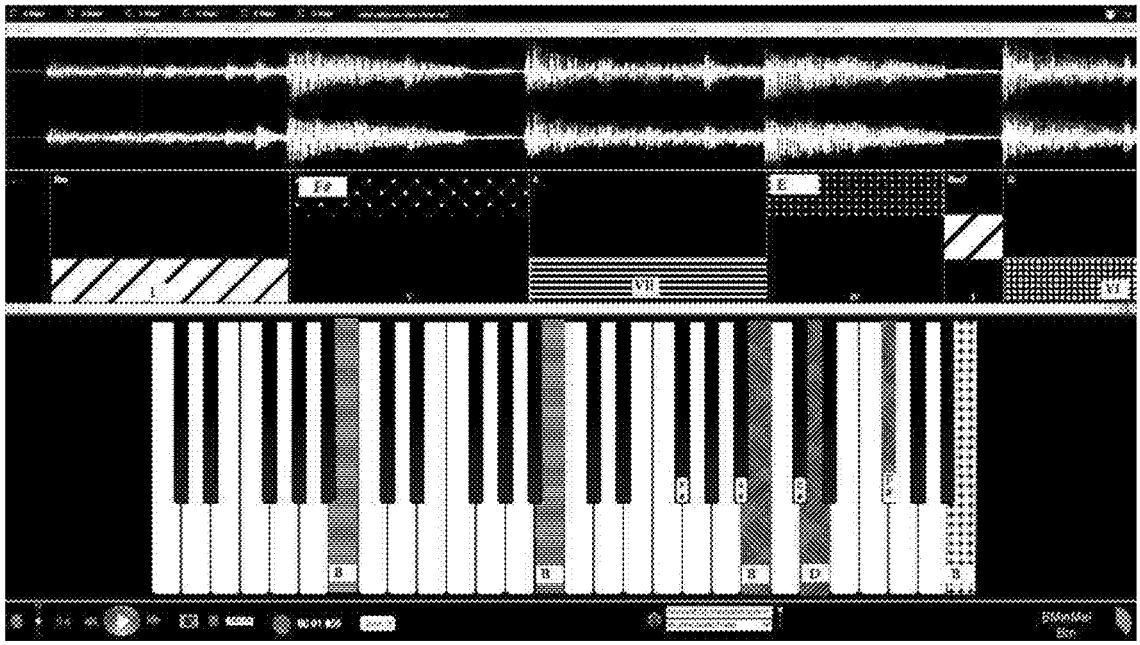
FIG. 45. Scale Degree TimeLine with Instructional Note selection for Keyboard Embodiment.

In a further Embodiment, FIG. 45 there is presented, on a conventional video display screen (non Touchscreen), a Chord Scale Degree Timeline for a selected Song, together with a Keyboard Musical Instrument image. As this Embodiment is not presented on a Touchscreen Device and only displays the Notes of the detected Chords on a conventional visual display Device, the triggering and activation of the Notes is not supported by touch enabled Virtual Keys. This Embodiment is quite similar to the Embodiment outlined in FIG. 34, but it does not support the selection and triggering of the Chord Notes with Touch. The Scale Degree Timeline in FIG. 45 is constructed as described earlier in FIG. 34. When the Play button is activated, the Cursor will move into the First Chord Sector identified as "Bm. The Software Application running in the Controlling Device will automatically highlight the individual Note positions of the advised Chord, "Bm" on the associated Keys on the Keyboard image as advised in the Chord Assignment File. The Keyboard Image Note layout corresponds to the layout shown in FIG. 43. The Notes assigned to the "Bm" Chord in this Embodiment are as follows: Note "B" in the position as shown in 277, Note "D" as shown in 278 and Note "F #" as shown in 279.

To add some variation to Musical Creation and to minimise the requirement to make significant movement of the hands between Chord selections, Chord Inversions are used extensively in Keyboard playing. In this Embodiment the Software Application shows the First Inversion where the Root Note is shown in a different colour a full Octave above the Root Note as shown at 280. Second Chord Inversion can also be displayed in a similar fashion. The Second Chord outlined in FIG. 31 is "F #" and shown in the Scale Degree Timeline (FIG. 34, 271). When the Play button is activated (FIG. 34, 217) the Cursor will move into the First Chord Sector identified as "Bm" shown in FIG. 34 as 270. The Software Application running in the Controlling Device will automatically highlight, in a subliminal fashion, the individual Note positions of the next advised Chord, which for the selected Song is "F #". The Keyboard Image Note layout corresponds to the layout shown in FIG. 43. The Notes assigned to the "F #" Chord in this Embodiment are as follows: Note "F # in the position as shown in FIG. 34, 283, Note "A #" as shown in FIG. 34, 284 and Note "C #" as shown in FIG. 34, 285. When the Cursor moves into the "F #" Chord Sector the subliminal colours will change to the activation colours and the Notes of the next upcoming Chord will be displayed in the subliminal colour in their Note assignment positions.

This Embodiment provides a low-cost solution that will assist users in identifying very accurately: common Chord Progressions, Chord Note Structures for Triad Chords and advanced Chords, Chord Note finger positioning on a standard Keyboard and Chord Inversions.

As shown in FIG. 34, a time down indicator may be provided to advise when the next Chord change will occur. The Chord Scale Degree Timeline can be slowed down, as shown in FIG. 17, 263, to assist the user in learning the Chords and their Note associations and Keyboard positions.

As an alternative to the availability of Touch screen selection, The Triad Notes with their Sevenths could be assigned to the Numeric Keys 1-4. The First and Second Inversions to Numeric Keys 5 and 6 with the Left Hand Lowest Octave to Numeric Key 7 and the Higher Octave Note to Numeric Key 8

Figure 46:
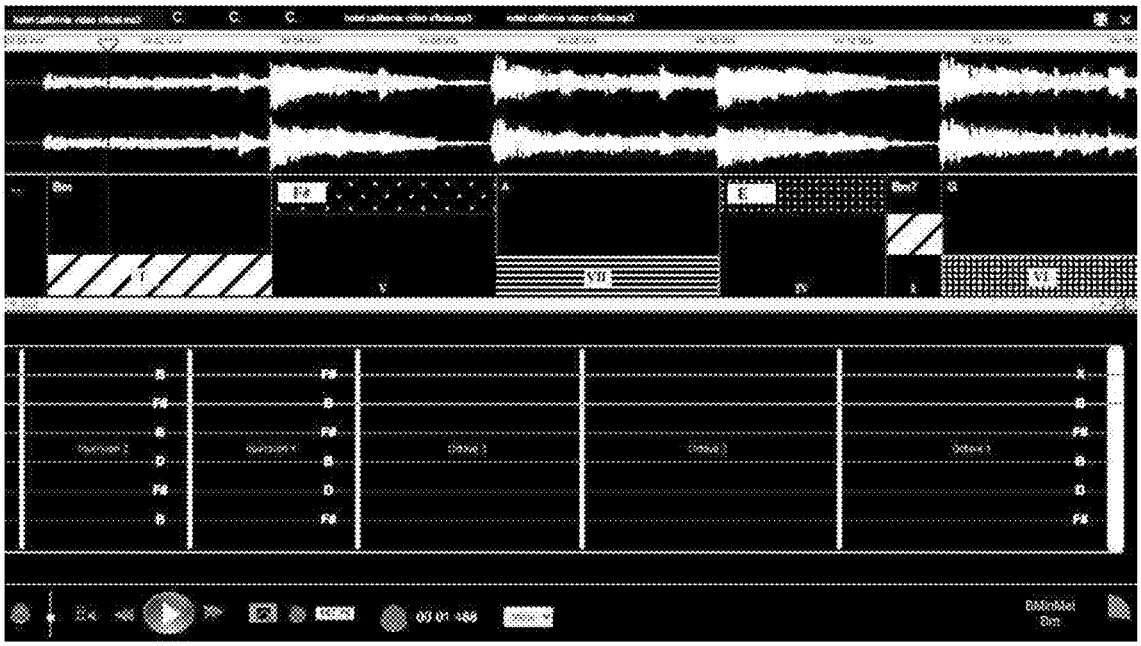
FIG. 46. Scale Degree TimeLine with Fretboard and Chord Notes and Chord Inversions

In a further Embodiment, FIG. 46 there is presented, on a conventional visual display screen (non Touchscreen), a Chord Scale Degree Timeline for a selected Song, together with a Stringed Fret Musical Instrument image. As this Embodiment is not presented on a Touchscreen Device and only displays the Strings and Fret positions with the assigned Notes on a conventional visual display Device, the triggering and activation of the Notes is not supported by touch enabled Virtual Strings. This Embodiment is very similar to the Embodiment outlined in FIG. 35 but does not support the selection and triggering of the Chord Note by touch.

As an alternative to the availability of Touch screen selection, The Triad Notes with their Sevenths could be assigned to the Numeric Keys 1-4. The First and Second Inversions to Numeric Keys 5 and 6 with the Left Hand Lowest Octave to Numeric Key 7 and the Higher Octave Note to Numeric Key 8

The Scale Degree Timeline in FIG. 46 is constructed as described earlier. When the Play button is activated (FIG. 35, 217), the Cursor will move into the First Chord Sector identified as "Bm. The First Fret position (FIG. 35, 291) will display the Note names on their Strings in their Lowest Octave positions. FIG. 35, 292 will display the Notes on their String positions one Octave Higher. FIG. 35,293 will display the Notes on their String positions two Octave Higher. Overall three Octave positions are accommodated in this Embodiment. In Fret position 4 and 5 (FIGS. 35, 294 and 295) is displayed First and Second Chord Inversion alternative fingering for the advised Chord.

When the Play button is activated as shown in FIG. 35, 217, the Cursor will move into the First Chord Sector identified as "Bm as shown at 270. The Software Application running in the Touchscreen Device will automatically display the individual Notes of the advised Chord "Bm" to the associated Strings on the Fretboard image as advised in the "Bm" Chord Assignment File. The Fretboard Note layout corresponds to the layout as in FIG. 33. The Notes assigned to the "Bm" Chord to the individual Strings in this Embodiment are as displayed in FIG. 35, 290 and are as follows: Note "X" which advises that there is no Note assigned to the Top String position, Note "B" in the Second String position, Note "F #" in the third String position, Note B in the fourth String position, Note "D" in the fifth String position and Note "F #" in the Bottom String position. This Embodiment provides a low cost solution that will assist users in identifying very accurately: common Chord Progressions, Chord Note Structures for Triad and advanced Chords, Chord Note assignment on a standard Stringed Instrument and the Notes associated for alternative Chord Inversions.

As an alternative to the availability of Touch screen selection, the individual Strings can be selectable by the assignment of each String in its Octave and Inversions Position to specific Key on the Keyboard, i.e. the First Octave Strings from the Top to Bottom can be assigned to the Keys Z-N, the Second Octave to the Keys A-H with the Third Octave assigned to the Keys Q-Y. The First Inversion assigned to the Numeric Keys 1-6 with the Second Inversion assigned to the Keys 7,8,9,0 –,=.

It is to be understood that the positioning of the Chord Selection Matrix Template relative to the Virtual Instruments as presented in the Embodiments are not fixed in position and can be changed relative to each other's position to allow choices for access to the Chord Element selection and for the activation of the Virtual Keys and Virtual Strings. For FIG. 38 the Virtual Stringed Instrument with 5 Frets and 6 Strings can be moved 180 degrees for alternative hand operation. The Chord Selection Matrix Template and the Virtual Stringed Instrument as displayed in FIG. 38 can be fixed vertically as an alternative Chord selection and Virtual String activation positioning.

The Chord Selection Matrix Template as displayed in FIG. 37 can be positioned vertically at either side of the Virtual Keyboard for alternative Chord selection and Virtual Key activation positioning.

It is to be understood that the invention is not limited to the specific details described herein and which are given by way of example only and that various modifications and alterations are possible without departing from the scope of the invention.

The invention claimed is:

1. A computer system comprising:

a display screen;

one or more data processors; and one or more non-transitory computer readable storage media containing instructions of a computer software application configured to cause the one or more processors to perform operations including:

displaying a Chord Selection Matrix Template on a first region of the display screen, the Chord Selection Matrix Template being divided into a plurality of selectable Chord Elements positioned in a row and column configuration, each Chord Element representing the scale degree position and the Chord value of an individual Chord within a calculated musical Key or Key combination selected by a user, or within an identified musical Key or Key combination for a digital music file selected by a user, displaying a Chord Scale Degree Timeline on a second region of the display screen, the Chord Scale Degree Timeline being configured to assist a user to play along and learn the selected digital musical file, the Chord Scale Degree Timeline being divided into a plurality of Chord Sectors along the Timeline, each Chord Sector representing the scale degree position and the Chord value of an individual Chord within the identified musical Key or Key combination for the selected digital musical file, wherein the Chord Scale Degree Timeline displays the Chords of the selected musical file in their identified scale degree position and in the order and for the duration that they need to be played, wherein the Chord Scale Degree Timeline is generated based on a Chord File generated for the selected digital music file, the Chord File at least comprising identified parameters of the selected digital music file including Chords, and a Chord Timeline indicating the time duration and playing order of the detected Chord, wherein each Chord Sector on the Scale Degree Timeline corresponds to a Chord Element in the Chord Selection Matrix Template for the selected musical Key or Key combination, wherein each Chord Element is associated with a Chord Assignment file comprising at least the Note names, the order of the Notes, and the Note assignments to individual Activation Control Members of a musical instrument;

assigning, in response to a user selection of a musical instrument and user selection of one of the selectable Chord Elements, the Notes associated with the selected Chord Element to the corresponding Activation Control Member in accordance with the Chord Assignment File;

receiving a triggering input comprising user activation of the Activation Control member associated with the selected Chord Element in the Chord Selection Matrix Template;

and playing audio sounds associated with the individual Notes assigned to the selected Activation Control Members when each of the individual Activation Control members is activated.

2. The system of claim 1, wherein each identified Chord in the Chord file is assigned a scale degree position within the identified Key or Key combination.

3. The system of claim 1, wherein each identified Chord is displayed within the Chord Sector associated with the scale degree position defined in the Chord File.

4. The system of claim 1, wherein each identified Chord is displayed within a Chord Scale Degree Timeline in the order defined by the Chord Timeline.

5. The system of claim 1, wherein the selected musical instrument is displayed in the form of a virtual musical instrument on a second region of the display screen.

6. The system of claim 1, wherein the triggering input comprises the selection of an Activation Control Member of the selected musical instrument.

7. The system of claim 1, wherein the display screen is a touchscreen display.

8. The system of claim 1, wherein the triggering input comprises a user interaction on a User Experience (UX) Interface running on the display screen, the user interaction including a touch on a region of the display screen, a swipe on a region of the display screen, a mouse pointer selection of function within the UX Interface, voice activation, a wirelessly received signal initiated by a remote device, or a hardwired electrical signal initiated by a device connected to the system.

9. The system of claim 1, wherein each Activation Control Member in the Chord Assignment File is assigned a standard MIDI number.

10. The system of claim 1, wherein each Activation Control Member in the Chord Assignment File is assigned a reference identifier to pre-recorded Sample audio sounds for the selected musical instrument.

11. The system of claim 1, wherein the audio sounds are played at the amplitude level detected by the triggering of the Activation Control Member.

12. The system of claim 1, wherein the layout of each Chord Selection Matrix Template is pre-defined and stored in a file for a broad range of musical Keys or Key Combinations and is editable for additions and modifications.

13. The system of claim 1, wherein the speed of the Chord Scale Degree Timeline is defaulted to the calculated Tempo of the selected musical file.

14. The system of claim 8, wherein the speed and view of the Chord Scale Degree Timeline in the UX Interface is adjustable.

15. The system of claim 1, wherein the Chord Scale Degree Timeline is displayed on a third region of the display screen.

16. The system of claim 1, wherein the Chord Scale Degree Timeline displays each Chord in a separate time related Chord Sector.

17. The system of claim 1, wherein the Chord Scale Degree Timeline at least displays the Chords of the selected musical file in their identified scale degree position and in the order that need to be played.

18. The system of claim 1, wherein displaying the Chord Selection Matrix Template includes highlighting, using a unique colour coded identifier, the Chord Element comprising the currently playing Chord as identified by the Chord Scale Degree Timeline.

19. The system of claim 1, wherein displaying the Chord Selection Matrix Template includes highlighting, using a unique colour coded identifier, at least one Chord Element comprising the Chord following the currently playing Chord as identified by the Chord Scale Degree Timeline.

20. The system of claim 1, wherein assigning the notes of the selected Chord Element further includes highlighting, using a unique colour identifier, the corresponding Activation Control Members of the selected music instruments.

21. The system of claim 1, wherein assigning the notes of the selected Chord further includes highlighting, using a unique colour identifier, the corresponding Activation Control Members of the selected music instruments for Chord Inversions and for Chord Root Notes, across two octaves, for left hand playing of Virtual Keyboard Instruments.

22. The system of claim 1, wherein the Chord File comprises a Chord Timeline indicating the time duration and playing order of the detected Chord.

23. The system of claim 1, wherein displaying the Chord Selection Matrix Template includes highlighting, using a unique colour coded identifier, the Chord Element comprising the Chord currently identified by the Chord Scale Degree Timeline.

24. The system of claim 1, wherein displaying the Chord Selection Matrix Template includes the display of at least one unique colour coded bar within the Chord Sectors of the Scale Degree Timeline indicating the Scale Degree column and row position of the identified Chord.

25. The system of claim 1, wherein each Chord Sector on the Chord Scale Degree Timeline displays in each Chord Sector the Chord name identifier with an associated Roman Numeral scale degree identifier.

26. The system of claim 1, wherein each Chord Sector on the Scale Degree Timeline comprises three Row positions for the Chord identified as bottom, middle and top Row positions, wherein if the colour coded identifier is placed on the bottom Row position indicates that the Chord is a basic Triad Chord, wherein if the colour coded identifier is placed in the middle Row position indicates that the Chord is a seventh of that Chord, and wherein if the colour coded identifier is placed at the top Row position indicates that the Chord is a Borrowed Chord from another scale.

27. A computer implemented method for generating a Chord File from a selected digital music file, comprising:

receiving a digital music file selection from a user database;

performing, by a processor, a Chord analysis to identify the Chords of the selected digital music file and generate at least one Chord Timeline File indicating the order of the identified Chords, wherein the Chord Analysis is based on the selection of a predetermined Chord Vocabulary comprising suggested Chords for the selected digital music file;

performing, by the processor, a Tempo Analysis to analyse the selected digital music file and provide a Beat Timeline File which identifies the Down-Beat positions that facilitate the identification of Bars within the selected digital music file;

performing, by the processor, a Chord Timeline Correction Analysis to detect errors in the Chord Timeline File by processing the at least one Chord Timeline File;

generating, by the processor, the Corrected Chord Timeline for the selected digital music file and align it with the identified Beat Timeline;

performing, by the processor, a musical Key Identification Analysis to identify the Key or Key combination for the selected digital music file, wherein the Key Identification Analysis involves corrections, substitutions, deletions and adjustments, as appropriate, being made by the processor, to the Chord Scale Degree Timeline using different identified single Keys and Multi-Keys, comparing, by the processor, the resulting Key proposal from each of the processed single Keys and Multi-Keys to identify the best matching Key proposal for the selected digital music file; and generating a Chord File for the selected digital music file comprising the identified Chords, the identified Key or a Key combination, and a Chord Timeline indicating the time duration and playing order of the detected Chord.

28. The computer implemented method of claim 27, wherein the Chord Analysis is performed three times, each time using a different Chord Vocabulary.

29. The computer implemented method of claim 28, wherein the Chord Vocabularies used in the Chord Analysis include, a Major/Minor Chord Vocabulary, a Custom Vocabulary, and an extended Vocabulary.

30. The computer implemented method of claim 28, wherein a Chord Timeline File is generated from each Chord Analysis performed using a different vocabulary.

31. The computer implemented method of claim 27, wherein the Chord Analysis includes comparing the resulting Chord Timeline Files generated from each Chord Analysis and selecting the Chord Timeline File having the highest matching probability with the identified Chords.

32. The computer implemented method of claim 27, wherein the Chord Timeline Correction Analysis includes the finding and fixing of erroneous Chords includes identifying anomalies in repeated patterns, in Chord progression, in Chord lengths, in Chord offsets.

33. The computer implemented method of claim 32, wherein the finding and fixing of erroneous Chords includes the use of counters calculated from the Timeline, for Tonics, Subdominants and Dominants.

34. The computer implemented method of claim 32, wherein the finding and fixing of erroneous Chords includes identifying differences between the Chords Timelines Files generated from each Chord Vocabulary and provides suggested actions including deleting Chords (DEL), insert new Chords (INS), or substitute Chords (SUB).

35. The computer implemented method of claim 27, wherein the Key Identification Analysis includes assigning to each resulting Key proposal a score, which is calculated based on the number of Chords in the Chord Timeline that fit in each Key proposal either a main scale or a combination of two scales associated with a main scale and a borrowed Chords scale.

36. The computer implemented method of claim 27, wherein the Key Identification Analysis includes identifying the best single Key proposal, identifying the best multi-Key proposal, and selecting from the two proposals the one with the highest score.

37. The computer implemented method of claim 27, wherein the Key Identification Analysis includes evaluating the Key proposal and accordingly performing a number of actions including, dropping proposals where the number identified Tonics are below a certain threshold, dropping proposal where the number of identified Chords not in the correct Key exceed a threshold, dropping proposal with key runs below a threshold, dropping proposals that are classified as scale degree variants.

38. An apparatus comprising a display screen running a User Experience Interface, activation control members;

one or more data processors, and one or more non-transitory computer readable storage media containing instructions configured to cause the one or more processors to perform operations including:

displaying a Chord Selection Matrix Template on a first region of the display screen, the Chord Selection Matrix Template being divided into a plurality of user selectable Chord Elements positioned in a row and column configuration, each Chord Element representing the scale degree position and the Chord Value of an individual Chord within a user selectable musical Key or Key combination, wherein the Chord Selection Matrix Template is selected based on a selected Musical Key or key Combination;

wherein each Chord Element represents a Chord for the selected Musical Key or Key combination, the Chord Element is associated with a Chord Assignment file comprising at least the Note names, the order of the Notes, and the Note assignments to the individual Activation Control Members of the apparatus;

assigning, in response to a user selection of a musical instrument and the user selection of one of the user selectable Chord Elements, the Notes associated with each of the selected Chord Elements to the corresponding Activation Control members in accordance with the Chord Assignment File;

receiving a triggering input comprising the user selection of a Chord Element in the Chord Selection Matrix Template;

playing audio sounds associated with the individual Notes assigned to the selected Activation Control Members when each of the individual Activation Control members is activated.

39. The apparatus of claim 38, wherein the apparatus comprises selection means for selecting the Chord Selection Matrix Template being displayed on the UX interface.

40. The apparatus of claim 38, wherein the apparatus resembles a musical instrument.

41. The apparatus of claim 38, wherein the apparatus resembles a guitar.

42. The apparatus of claim 38, wherein display screen is a touchscreen display.

43. A computer implemented system comprising:

a display screen;

one or more data processors; and one or more non-transitory computer readable storage media containing instructions configured to cause the one or more processors to perform operations including:

displaying a Chord Scale Degree Timeline on a first region of a display screen, the Chord Scale Degree Timeline being configured to assist a user to play along and learn a user selected digital musical file, the Chord Scale Degree Timeline being divided into a plurality of Chord Sectors along the Timeline, each Chord Sector representing the scale degree position and the Chord value of an individual Chord within an identified musical Key or Key combination for the selected digital music file, wherein the Chord Scale Degree Timeline is generated based on a Chord File generated for the selected digital music file, the Chord File at least comprising identified parameters of the selected digital music file including Chords, and a Chord Timeline indicating the time duration and playing order of the detected Chord, wherein each Chord Sector on the Chord Scale Degree Timeline represents a Chord from the Chord File for the selected musical Key or Key combination, wherein each Chord Sector is associated with a Chord Assignment file comprising at least the Note names, the order of the Notes, and the Note assignments to individual Activation Control Members of a musical instrument;

assigning, in response to a user selection of a musical Instrument and in accordance with the Chord Assignment File, the Notes to each of the Activation Control members as the Scale Degree Timeline is playing;

receiving a triggering input comprising the activation of the assigned Activation Control Members; and playing audio sounds associated with the individual Notes assigned to the selected Activation Control Members.

44. The computer implemented system of claim 43, wherein display screen is a touchscreen display.

* * * * *